US012185775B1

(12) United States Patent
Winegan

(10) Patent No.: US 12,185,775 B1
(45) **Date of Patent: *Jan. 7, 2025**

(54) VERSATILE WEARABLE ITEM AND METHOD OF USING A WEARABLE ITEM

(71) Applicant: Ryan A. Winegan, Mareno di Piave (IT)

(72) Inventor: Ryan A. Winegan, Mareno di Piave (IT)

( * ) Notice: Subject to any disclaimer, the term of this patent is extended or adjusted under 35 U.S.C. 154(b) by 53 days.

This patent is subject to a terminal disclaimer.

(21) Appl. No.: 17/967,912

(22) Filed: Oct. 18, 2022

Related U.S. Application Data

(63) Continuation of application No. 16/512,142, filed on Jul. 15, 2019, now Pat. No. 11,503,866.

(51) Int. Cl.
*A41D 15/00* (2006.01)
*A41D 1/22* (2018.01)

(52) U.S. Cl.
CPC ..... *A41D 15/00* (2013.01); *A41D 1/22* (2013.01)

(58) Field of Classification Search
CPC ..... A41D 15/00; A41D 15/007; A41D 1/22; A41D 23/00; A41D 2023/004
See application file for complete search history.

(56) References Cited

U.S. PATENT DOCUMENTS 2,064,399 A * 12/1936 Abrams ..... A41D 15/00 2/74
2,419,513 A * 4/1947 Wahlberg ..... A41D 15/00 D2/757
D154,621 S * 7/1949 Morgan ..... D2/757
2,521,020 A * 9/1950 Prescott ..... A41D 11/00 2/70
2,549,494 A * 4/1951 Licht ..... A41D 1/22 D2/758
2,690,564 A * 10/1954 Kingston ..... A41D 15/00 2/92
2,721,328 A * 10/1955 Rosenbaum ..... A41D 15/00 2/95
2,804,625 A * 9/1957 Leser ..... A41D 15/00 2/65
D182,324 S * 3/1958 Chapman ..... D2/758
D182,919 S * 5/1958 Moran ..... D2/794
D188,980 S * 10/1960 Chapman ..... D2/794
(Continued)

*Primary Examiner* — Heather Mangine

(57) ABSTRACT

Some embodiments provide a method (903) of using a wearable item and some wearable items (1, 2, 3, 4 and 5) that are versatile, used for a variety of configurations and have a plurality of garment components (9) at least included as being a plurality of components (6). At least two of the plurality of garment components (9) are a panel (12) and versatile and comprise at least one dimension (341), side (342), free end (313), edge (343) and opposed ends (344). In at least one configuration, the wearable item is adapted to be used as at least one versatile garment and has at least two of the plurality of garment components (9) at least (a) attached together at an intersecting area with at least one of the two garment components extending from a side edge of the attached other garment component and without having an opposite end of any of the at least two of the plurality of garment components (9) attached to any of the plurality of garment components (9), and (b) used in at least one direction (D).

24 Claims, 42 Drawing Sheets

(56) References Cited

U.S. PATENT DOCUMENTS 3,008,147 A * 11/1961 Yelton ..... A41D 15/00 2/70
3,322,102 A * 5/1967 Windle ..... A62B 35/0006 244/151 R
3,605,121 A * 9/1971 Suzuki ..... A41D 23/00 2/207
4,055,854 A * 11/1977 Jones ..... A41D 7/00 2/105
4,062,062 A * 12/1977 Basaldua ..... A41D 1/22 2/72
4,142,253 A * 3/1979 Roscoe ..... A41D 1/22 2/74
4,425,712 A * 1/1984 Ratliff ..... A41D 1/22 33/12
4,667,345 A * 5/1987 Jachowski ..... A41D 15/00 2/91
4,731,884 A * 3/1988 Lawrence ..... A41D 15/00 2/72
4,815,145 A * 3/1989 Chow ..... A41D 7/00 2/72
5,083,316 A * 1/1992 Kuehner ..... A41D 7/00 D2/737
5,592,691 A * 1/1997 Ronald ..... A41D 15/00 2/243.1
5,680,652 A * 10/1997 Paine ..... A41D 15/00 2/119
5,894,600 A * 4/1999 Chenefront ..... A41D 15/00 2/243.1
6,226,799 B1 * 5/2001 Lane ..... A41D 23/00 2/207
6,584,617 B1 * 7/2003 Turner ..... A41D 23/00 2/88
8,214,923 B2 * 7/2012 Lee ..... A41D 15/00 2/88
D695,492 S * 12/2013 Tarr ..... D2/792
8,793,815 B1 * 8/2014 Kelley-Mozsy ... A41D 13/0058 2/247
2007/0028366 A1 * 2/2007 Weis ..... A41D 25/00 2/244
2009/0300817 A1 * 12/2009 Fata ..... A41D 1/22 2/243.1
2012/0079644 A1 * 4/2012 Benderradji ..... A41D 23/00 2/207
2012/0160885 A1 * 6/2012 Larch ..... A47D 13/025 224/158
2012/0248159 A1 * 10/2012 Rahni ..... A47D 13/02 29/428
2013/0239286 A1 * 9/2013 Gray ..... A41D 15/00 2/69
2013/0283493 A1 * 10/2013 Clyburn ..... A41D 23/00 2/69
2014/0123365 A1 * 5/2014 Yoo ..... A41D 15/00 2/74
2014/0150160 A1 * 6/2014 Sundaram ..... A41D 1/22 2/74
2014/0298563 A1 * 10/2014 Cavero ..... A41D 1/22 2/74
2014/0352026 A1 * 12/2014 Ruth Ann ..... A41D 27/02 2/69
2016/0021950 A1 * 1/2016 Rafieiankopaei ..... A41D 15/00 2/243.1
2017/0049246 A1 * 2/2017 Lau ..... A47D 13/025
2017/0135421 A1 * 5/2017 Treyger ..... A41D 27/10
2017/0172230 A1 * 6/2017 Macfarlane ..... A41D 15/00
2017/0360126 A1 * 12/2017 Treyger ..... A41D 27/10
2018/0255853 A1 * 9/2018 Spathas ..... A41D 1/21
2020/0128889 A1 * 4/2020 Torano ..... A41B 9/00
2020/0329795 A1 * 10/2020 Rhodes ..... A41D 13/0058
2021/0015186 A1 * 1/2021 Winegan ..... A41D 1/22
2021/0045472 A1 * 2/2021 Abedinzadeh Kivi ..... A62B 18/025
2021/0085000 A1 * 3/2021 DeAngelo ..... A41D 15/04
2021/0169163 A1 * 6/2021 Brown ..... A41D 27/10
2023/0255282 A1 * 8/2023 Gitlin ..... A41D 27/08 2/70

* cited by examiner

VERSATILE WEARABLE ITEM AND METHOD OF USING A WEARABLE ITEM

CROSS-REFERENCE TO RELATED APPLICATIONS

This application is a continuation of U.S. patent application Ser. No. 16/512,142, filed on Jul. 15, 2019, which is hereby incorporated by reference herein in its entirety.

STATEMENT REGARDING FEDERALLY SPONSORED RESEARCH AND DEVELOPMENT

Not applicable.

USAGE AND TERMINOLOGY

Reference throughout this specification to "an embodiment", "one embodiment", "another embodiment", "exemplary embodiment(s)", "other embodiments", "described embodiment(s)", "some embodiments", "some other embodiments", "this embodiment", "these embodiments", "various embodiments", "any other embodiment", "first embodiment of", "second embodiment of", "third embodiment of" and so forth, and the like mean that the embodiment(s) of the invention so described or any other variation thereof might be included in the practice of the invention or in at least one embodiment of the present invention, but not necessarily in all embodiments. Thus, respective appearances of the phrases "in an exemplary embodiment", "in one embodiment", "in (still) other embodiments", "in (still) some embodiments", "in some other embodiments", "in this embodiment", "in the described embodiment(s)", "in these embodiments", "in (still) various embodiments", "in any other embodiment", "in a first embodiment", "in a second embodiment", "in a third embodiment" and so forth, and the like in various places throughout this specification do not necessarily refer to the same embodiment(s), although they may. It will be noted that in this discussion: the phrase "described embodiment(s)" is intended to mean 'presently described embodiment(s) and example(s) of the present invention', as well as any other variation thereof; and the phrase "in the described embodiment(s)" is intended to mean 'in the presently described embodiment(s) and example(s) of the present invention', as well as any other variation thereof. Additionally, it will be noted that in this discussion, the phrase "some other embodiments" is intended to mean 'some of the other embodiments of the present invention'.

It will be understood that: where the specification states an ordinal number (e.g., "first", "second", "third", "fourth" and so forth), the ordinal number is being used to describe a common object and indicate that different instances of like objects are being referred to; and when the ordinal number(s) is/are being used as an adjective, such adjectives are not intended to imply the objects so described must be in every embodiment of the invention nor in a given sequence, ranking, and so forth. It will be noted that the ordinal numbers can be interchangeable.

Additionally, reference throughout this specification to the phrase "any other embodiment" is to be interpreted as referring generally to any of the other embodiments of the invention (e.g., component(s), removable part(s), configuration(s), method(s), side(s), edge(s), dimension(s), opposed end(s), free end(s), aperture(s), fastener device(s), closure device(s), item(s), border(s), other disclosed and undisclosed embodiments, any other embodiment that may or may not be illustrated and listed but that all fit within the scope of the invention, and any other variation thereof). It is to be noted that in some embodiments, the phrase "any other embodiment" can also be interpreted as (but not limited to) referring generally to a "wearable item", a method of using (but not limited to) a wearable item, or a combination thereof.

Moreover, reference throughout this specification to "respective embodiment(s)" and to any variation thereof is intended to refer generally to at least any wearable item of the present invention, any other embodiment, any variation thereof, or any combination thereof.

It will be understood that where the specification states that a component, feature, attribute, structure, and so forth "may", "might", "should", "can" or "could" be included, that particular component, feature, attribute, structure, and so forth is not required to be included.

Throughout this application, with respect to all reasonable derivatives of such terms, and unless otherwise specified (or unless the particular context clearly dictates otherwise), each use of:

- the abbreviation 'e.g.' and phrases such as, but not limited to, 'by way of example', 'by (still) another way of example', 'for example', 'in this example', 'in these examples', 'for instance', 'in this illustration', 'in the illustrated . . . ', 'for exemplary purposes', and the like are also used herein to refer to one or more "example(s)" and "exemplary embodiment(s)". It will be understood that the invention is not limited to neither any particular tangible means of implementation nor to the provided examples and embodiments (by way of example and not limitation, Figures (illustrations), wearable item(s), component(s), design(s), location(s), position(s), direction(s), directional phrase(s), element(s), material(s), methodology, use(s), user(s), configuration(s), style(s), border(s), dimension(s), application(s), method(s), part(s) and so forth) nor to any of the provided descriptions thereof, which are: (i.) being used to describe exemplary embodiments only; (ii.) not intended to limit the scope of the invention in any way whatsoever; and (iii.) not required in every embodiment of the invention. Other variations thereof are possible in other embodiments of the invention.
- the singular shall include the plural (e.g., the use of the singular form "a", "an", "another", "any", "other", "at least", "someone", "something", "said," and "the" include the plural reference (i.e., at least one or more thereof)) and may be vice versa, and each masculine, feminine and neuter reference shall include and refer also to the others.
- the term "single" means 'one'.
- the term "multiple" and the term "a plurality of" mean 'more than one'.
- the term "number" is to be interpreted in an inclusive (i.e., non-exclusive) sense and as having an open-ended meaning. By way of example, the term "number" can be interpreted as referring to 'one', 'any number being greater than one (e.g., two, three, four, and so forth)', 'one or more', 'unlimited', 'any indefinite quantifier (e.g., few, some, many, a plurality of, a variety of, numerous, and so forth)', 'any other indefinite quantity', and the like. It is to be noted that where the specification states "unlimited number of", the phrase should be interpreted as meaning 'not limited or restricted in terms of number, quantity, or extent'.

the term "at least" and any other variation thereof should be interpreted as any or a combination of the following: generally meaning 'at least and not limited to', 'at least without being limited to' and the like; or meaning 'having a minimum of, but not limited to, a number of something or someone'. By way of example: the expression "at least one (of something or someone)" means 'at least one or more (of, but not limited to, the something or someone)', refers to having a minimum of (but not limited to) one or more of the something or someone, and might also include a number of something or someone else in some embodiments of the invention; the expression "at least two (of something or someone)" follows the same pattern (e.g., the expression "at least two (of something or someone)" means 'at least two or more (of, but not limited to, the something or someone)', refers to having a minimum of (but not limited to) two or more of the something or someone, and might also include a number of something or someone else in some embodiments of the invention, and so forth.

the phrase "any combination of" can be interpreted as referring to, but not being limited to, 'at least any combination(s) of', 'at least any combination of two or more of,' 'at least any combination of all of', or any other variation thereof.

the terms "comprising", "comprise(s)", "comprised of", "including", "include(s)", "has", "have", "having", "consisting of", "consist(s) of", and any other variation thereof are all intended to be understood in an inclusive (i.e., non-exclusive) sense, and to be interpreted as having an open-ended meaning (e.g., being synonymous with phrases such as, but not limited to, 'including at least', 'include(s) at least', 'has a minimum of (but not limited to)', 'have a minimum of (but not limited to)', 'having a minimum of (but not limited to)', 'the respective any other variation thereof and not being limited to', and the like).

the conjunctive word "or" means 'and/or', the conjunctive words "and" and "or" should be interpreted in the inclusive (not the exclusive sense), and it will be understood that a number of other alternatives, as well as any combination of such alternatives, are possible in other embodiments of the invention.

the term "versatile" refers to being at least able to adapt or at least be adapted to being used in a plurality of ways or for at least more than one purpose to serve a function of being any or any combination of, but not limited to, a convertible item, a multi-functional item, a multi-use item, a transformable item, or the like.

the term "wearable item" refers to at least one of or any combination of the following: (i) a versatile wearable item; (ii) an item that can be, but not limited to, wearable, used in many ways, and converted into and used for a variety of configurations; or (iii) the wearable item used in, but not limited to, the method of using a wearable item. It is to be noted that the term "wearable item" is alternatively defined as a 'versatile wearable item' in various embodiments and may be vice versa in other embodiments.

the term "method" is intended to also refer broadly to technologies, manners, means, techniques, procedures, actions and the like for accomplishing a given task including, but not limited to, those technologies, manners, means, techniques, procedures, actions and so forth generally either known to, or readily developed from any known technologies, manners, means, techniques, procedures, actions and so forth, by practitioners of the art to which the invention belongs. It is to be noted that the method of using a wearable item is not limited to being used just for a wearable item. By way of example, the method of using a wearable item can also be used with or for, but not limited to, other items that may have other functions, uses, characteristics and so forth, and can be used for other purposes.

the term "component" refers generally to any part, piece, section, element, and so forth that forms or is at least a part of something. It is to be noted that in various embodiments, one or more of the components or of the any other embodiment may not be or may be used as at least a part of a garment.

the term "garment component" is used to refer generally to any component that is at least suitable for being used as a component for, but not limited to, a garment.

the term "removable" is used to refer generally to something (e.g., a component, any other embodiment, and so forth) that is at least capable of being detached as well as, but not limited to, reattached.

the term "attached" refers broadly to any component, part, section, and so forth that is joined, fastened, connected or that operates together either directly or indirectly (e.g., through the use of at least an intermediate component), so long as a link occurs.

the term "dimension" is to be interpreted as referring to a length, a width, a height, a measurement or the like, any combination thereof, or any other variation thereof.

the term "user" could mean a human user, a non-human user or a combination thereof, and is also meant to refer to users at any stage of the usage process, to include and without limitation, any direct user, any indirect user, any intermediate user, and any end user benefiting in any way, directly or indirectly, from the use of, or interaction with, at least some aspect of the present invention. It is to be noted that although the "user" is also a 'wearer' in some embodiments and can be vice versa in various embodiments of the invention, the "user" might not be the 'wearer' in other embodiments. Additionally, it will be understood that the meaning of "user", or any similar term, is not to be otherwise inferred or induced by any pattern of description, embodiments, examples, or referenced prior-art that may (or may not) be provided in the present application.

Headings, terminology, phraseology, and titles provided herein are used for the purpose of describing particular embodiments only and are not intended to limit the scope of the invention in any way, and it will be understood that other headings, terminology, phraseology, titles, and the like can be used in other embodiments. Unless defined otherwise, all technical and terminology used herein generally have the same meanings as commonly understood by one of ordinary skill in the art to which this invention belongs.

FIELD OF THE INVENTION

The present invention relates generally to wearable items, and more particularly to a versatile wearable item and to a method of using a wearable item.

BACKGROUND OF THE INVENTION

Wearable items that are versatile are capable of being used for many purposes, such as, to create the appearance of different configurations, to fulfill a need, to adapt the item(s)

to various occasions and circumstances, to reduce the need of having to spend a lot of money on purchasing multiple items, and for other purposes. Apparel items and accessories are some examples of common items that are wearable, capable of being made in a plurality of different ways, and suitable for being designed to fulfill a specific use or alternatively, to be versatile.

U.S. Pat. No. 4,062,062 issued to Basaldua on Dec. 13, 1977 discloses a multi-style garment comprising a lower and an upper tubular portion. The upper portion forms an extension of the lower tubular portion and comprises a pair of spaced apart scarves. Each one of the scarves has a lower end connected to the tubular portion and an upper free end opposite the lower end, and the scarves also extend from a first edge at the front of the garment around to a second edge at the rear of the garment. According to another claimed embodiment of the invention, a garment is provided that is capable of being worn in a plurality of different styles and comprises a lower tubular portion and a pair of opposed scarves that extend upwardly from the tubular portion. Each one of the pair of scarves have a lower end connected to the tubular portion and an upper free end opposite the lower end. The pair of scarves also form an extension of the lower tubular portion and have respective side edges when viewed in elevation, and opposed front and rear edges that taper upwardly and outwardly. However, it can be observed that: (a) a lower portion or alternatively, a lower tubular portion is needed for the multi-style garment; and (b) none of the garments have another versatile part or component with at least one free end extending in at least one different direction from any of the disclosed pair of scarves at an edge not being opposite the free end of any of the respective scarves, which create some limitations to how such items can be styled and used.

In addition, U.S. Pat. Appl. No. 20150250239 issued to Yoo on Sep. 10, 2015 discloses a strapless multi-use garment having a plurality of panels attached to a gathered skirt which extend downwardly from a waistband and are adaptable for multiple configurations that allow the garment to be worn in a wide range of styles. The panels do not have any other panels extending therefrom and are shown not extending in any other direction when the garment is used in an unstyled configuration.

There is a need to provide a versatile item that can be an improvement for wearable items having any versatile characteristic and which exhibits an advantage in functionality over prior art. There is also a need for a method for how to use such items. While all the disclosed prior art and other prior art are suitable for the particular purpose to which they address, the prior art would not be suitable for the purposes of the present invention as heretofore described.

SUMMARY OF THE INVENTION

Some embodiments of the disclosure provide a wearable item that is versatile. Additionally, some embodiments of the disclosure provide a method of using a wearable item.

The wearable item comprises a plurality of components. In particular, a plurality of garment components are at least a plurality of the components. At least two of the plurality of garment components: (i) are a panel; (ii) have a position in at least one direction; (iii) are adapted to be positioned at a plurality of different locations, used in a plurality of different ways and manipulated in a plurality of different ways; and (iv) comprise at least one dimension, at least one side, at least one free end, at least one edge and at least one opposed ends. At least one edge is at least one end of the said at least one free end, and at least one end of the said at least one opposed ends is at least a said at least one free end and a said at least one edge.

According to some embodiments of the present invention: (i) in at least a number of configurations, the wearable item has at least two of the plurality of garment components at least positioned in different directions from each other; and (ii) in at least a number of configurations, the at least two of the plurality of garment components are at least attached together. Additionally, in at least one of the number of configurations having the at least two of the plurality of garment components: (a) the at least two of the plurality of garment components are at least positioned in different directions from each other, (b) the at least two of the plurality of garment components are at least attached together, and (c) at least one of the at least two of the plurality of garment components are at least attached together and not at an edge being opposite at least one free end of at least one of any of the at least two plurality of garment components.

According to some embodiments, the wearable item is converted into various styles and used for a variety of configurations. A number of the variety of configurations are made while having (i) the at least two of the plurality of garment components at least positioned in different directions from each other and (ii) at least one of the at least two of the plurality of garment components at least attached together and not at an edge being opposite at least one end of at least one of any of the at least two plurality of garment components. In still other embodiments, the wearable item is also at least capable of having at least two free ends in at least one of the variety of configurations.

In various embodiments, the wearable item is capable of being used for and converted into numerous other configurations. By way of example, a number of the variety of configurations could be: any configuration having at least one strap style configuration; any configuration having at least one strapless style configuration; any configuration having at least one shoulder style configuration; any configuration having at least one neckline style configuration; any configuration having at least one sleeve style configuration; any configuration having at least one sleeveless style configuration; any configuration having at least one asymmetrical configuration; any configuration having at least one symmetrical configuration; any configuration having at least one X shape or X-like form; any configuration having at least one T shape or T-like form; any configuration having at least one cut-out style configuration; any configuration having at least one configuration of any headwear; any configuration having at least two of the number of components not attached together; or one or more other configurations. By still way of example, a number of the variety of configurations could be any configuration having at least a part being used as, but not limited to, a garment train. It is to be noted that the variety of configurations can comprise other configurations.

In some embodiments, the wearable item has the following in at least one of the variety of configurations: (i) at least one of the plurality of garment components tapering vertically; and (ii) at least one of the plurality of garment components tapering horizontally. It will be noted that any of the number of components used in any embodiment of the present invention can be tapered in any direction, in one or multiple directions, and in the desired manner.

Variations of some embodiments of the wearable item, of a number of at least the variety of configurations and of the desired any other embodiment can have or be used with a number of at least one of any or any combination of, but not limited to, a style design, an aperture, a space for an opening, a fastener device, a closure device, a removable part, a decorative element, a component that is at least suitable for encircling a part of a user, or a border. It is to be noted that other components, structures, items, and so forth (which may or might not be a part of the wearable item or of any other respective embodiment) can be used.

In some embodiments, at least one of the plurality of components is a material. In some embodiments, at least one of the plurality of components is a garment body. In still some embodiments, the wearable item has at least one of or any combination of, but not limited to, the following: (i) an upper body portion; or (ii) a lower body portion. It is to be noted that in still some embodiments, at least one of any of (but not limited to) the desired respective embodiments can have or be used with, but not limited to, at least one of any or any combination of the following: (i) a number of components that may be used as, but not limited to, other garment components; (ii) a number of components that are garment components; or (iii) a number of components that might not be intended to be used as any garment component or any component for an accessory or any other apparel item.

According to some embodiments of the invention, the wearable item is generally worn in a number of configurations. However, in various embodiments, the wearable item and a number of the desired any other embodiment can also be used for purposes such as, but not limited to, being used in combination with at least a number of items in a number of configurations, being used by a user in a number of configurations, being used by themselves in a number of configurations, being used as a garment in a number of configurations, being used as an accessory item in a number of configurations, being used as a decorative item in a number of configurations, being converted into and used for a variety of configurations to create the desired look and to fulfill the desired need, and any other desired purpose.

According to some embodiments, the variety of configurations are made by using a number of methods. By way of example, one or multiple actions such as, but not limited to, accessorizing, adjusting, attaching, changing, detaching, doing the desired number of actions, fastening, holding, grabbing, manipulating, pulling, putting on, releasing, removing, repositioning, securing, styling, taking off, tucking in, twisting, tying, undoing an action, wearing, or wrapping are generally used in the number of methods. It will be noted that other actions and methods can be used in various embodiments of the number of methods. It will also be noted that the number of methods is not limited to being used for the variety of configurations. By way of example, the number of methods can be used for, but not limited to, any other embodiment of the invention, for fulfilling the desired need, and for other purposes.

The wearable item and any other embodiment can be made and used in the desired manner and in the desired number of unlimited dimensions, sizes, styles and ways.

It is an objective of the present invention to provide a wearable item and a method of using a wearable item that is suitable for, but not limited to, (i) being used for various occasions, circumstances, situations and the like, and (ii) being made for and used for individuals and other users, a vast variety of markets and business sectors, and other purposes.

The purpose of the foregoing abstract is to enable patent examiners, patent offices and the public, especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor it is intended to be limiting as to the scope of the invention in any way.

The foregoing has outlined, rather broadly, the preferred features and advantages of the present invention so that those skilled in the art may better understand the detailed description of the invention that follows. Additional objects, features and advantages of the invention will be described hereinafter that form the subject matter of the claims of the invention.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the invention. Moreover, those skilled in the art will also appreciate that they can readily use the disclosed conception and specific embodiments as a basis for modifying other structures, methods and systems for carrying out the same purposes of the present invention, and such modifications do not depart from the spirit and scope of the invention in its broadest form.

BRIEF DESCRIPTION OF THE DRAWINGS

Exemplary features of selected embodiments of the present invention will now be described with reference to the following Figures and detailed description below, and where like reference numerals refer to identical or functionally similar elements. The drawings are not rendered to any particular scale or proportion, and it will be understood that the particulars shown are provided by way of example and for the purpose of an illustrative discussion of what is believed to be the most useful and readily understood description of the principles and conceptual aspects of the invention. In the drawings, in which.

DETAILED DESCRIPTION OF THE PREFERRED EMBODIMENTS

Figure 1A:
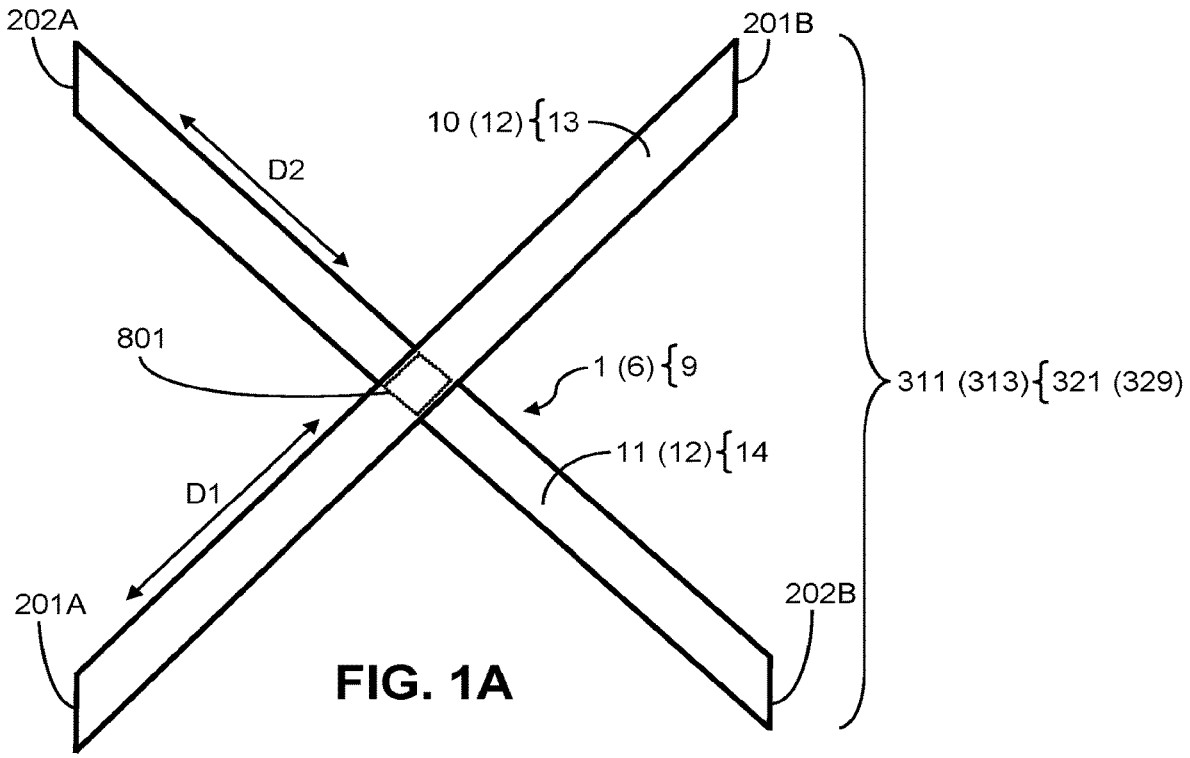
FIGS. 1A-1B are a front (A) and back (B) perspective view of a first embodiment of a wearable item and of some other embodiments of the present invention.

Several specific and more detailed descriptions of the preferred embodiments of the present invention are discussed herein below and with reference to the Figures in order to enhance the understanding and appreciation for the inventive principles and advantages thereof, to be a representative basis for teaching one skilled in the art to variously employ the invention, and for providing a basis for the claims. The detailed description herein with respect to these Figures is for explanatory purposes, and it will be understood that: (i) other Figures (illustrations), wearable items, components, designs, locations, positions, directions, directional phrases, elements, materials, methodologies, uses, users, configurations, styles, borders, dimensions, applications, methods, parts and so forth, as well as other modifications and variations thereof can be used in other examples, in other embodiments of the invention and in any embodiment of the invention (which may or might not be illustrated and disclosed in the detailed description herein but that all fit within the scope of the invention); and (ii) there are numerous modifications and variations of the invention that are too numerous to be illustrated and listed but that all fit within the scope of the invention. The Applicant hereby gives notice that new Claims may also be formulated to such features, combinations of such features, and other embodiments in accordance with the present invention during the prosecution of the present Application and any further Application derived therefrom.

In this discussion, the locations and directions of some of the described embodiments are described as seen from the point of view of the viewer facing the described embodiments shown in the respective Figure(s) and for exemplary purposes only.

As is well known to those skilled in the art many careful considerations and compromises typically must be made when designing for the optimal manufacture of a commercial implementation of any system, and in particular the embodiments of the present invention. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the invention may be suitably omitted, included, adapted, mixed and matched, or improved and/or optimized by those skilled in the art, using their average skills and known methods, to achieve the desired implementation that addresses the needs of the particular application. Moreover, those skilled in the art will readily recognize, in light of and in accordance with the teachings of the present invention, that any of the foregoing steps may be suitably replaced, reordered, removed and additional steps may be inserted depending upon the needs of the particular application.

It will be understood that features described in the context of separate embodiments may be provided in combination in a single embodiment. Furthermore, various features described in the context of a single embodiment may be provided separately or in any suitable subcombination in still other embodiments.

Any signal arrows in the drawings/Figures should be considered as only exemplary, and not limiting, unless otherwise specifically noted. State diagrams, flow diagrams or both may be used to describe embodiments; however, the present invention is not limited to those diagrams or to the corresponding descriptions. It will be understood that such diagrams do not need to move through each illustrated box or state, or in exactly the same order as illustrated and described.

It should be noted that portions of this discussion which are duplicative amongst the different embodiments are sometimes not repeated, to avoid obscuring the concepts. Furthermore, where certain elements of the present invention may be partially or fully implemented using known components, features, configurations, methods, and other factors known to those skilled in the art, only those portions thereof that are necessary for an understanding of the principles and inventive aspects of the invention will be described.

The present disclosure is directed generally to wearable items and to methods of using a wearable item.

The wearable item, the method of using a wearable item, and any other embodiment can be used to give the users thereof the possibility to express themselves creatively, in many ways and in the desired manner.

The wearable item and any other embodiment can be made for and used for, but not limited to, niche markets, mass markets, luxury markets, high end fashion, haute couture, seasonal collections (e.g., holiday, autumn/fall, spring, summer, winter, and other seasonal-related themes), the military, retail, an item that may or may not be designed in a manner that results in any appearance of any configuration of any garment in the original configuration (i.e., when the item is not used in any alternative configuration) thereof, a non-versatile item, and a versatile item. By another way of example, various embodiments of the present invention can be made for and used for, but not limited to, different occasions and situations (e.g., business, ceremonies and events, daily activities, school, travel, work, entertainment, and other occasions and situations), casual wear, costumes, decoration, maternity wear, formal wear, informal wear, bridal wear, lingerie, nightwear, loungewear, medical clothing, smart clothing, semi-formal wear, sportswear, activewear, swimwear, the indoors, the outdoors, protective gear, technological items, toys, humans, animals, objects and other purposes.

Various embodiments of the wearable item, of a number of configurations and of any other embodiment can have or at least be used with, but not limited to, a number of items (e.g., an item that is at least suitable for covering a part of a body, an item that is at suitable for being worn on a part of a body, an item that may or may not be versatile, an accessory, a fabric, a collar, a yoke, a facing, a cuff, a pocket, a hood, a band, a strap, a sleeve, a string, a rope, a chain, a strip of something, a label, a badge, a gusset, some glue, a thread, a seam, some paint, some ink, a device, a technological item, a metal, a stone, a tool, some food, some glass, some paper, some plastic, some wood, and other items). By way of example, in still some embodiments, the number of items can be a number of garments such as, but not limited to, a number of any or any combination of the following: (i) one-piece garments; (ii) multi-piece garments; (iii) tops, shirts, blouses and the like; (iv) jackets, coats and the like; (v) skirts; (vi.) skirt-looking panels; (vii) dresses, gowns and the like; (viii) underwear; (ix) any article of clothing with, but not limited to, one or multiple individual leg portions for at least one leg; (x) trousers, pants, shorts and the like; (xi)

swimsuits, swim shorts, swim tops and the like; and (xii) any other desired garment. It will be noted that other embodiments of a number of items could also be used for, but not limited to, a functional purpose, a decorative purpose and other purposes; and an unlimited number of any type or any other variation of, but not limited to, a number of items can be used and could be used in other ways, as well as in the desired manner.

Various embodiments of the wearable item, of a number of configurations and of any other embodiment can be used with a number of accessories such as, but not limited to, bags, bands, belts, bridal accessories, brooches, capes, cloaks, cufflinks, cummerbunds, earmuffs, fans, foulards, gloves, hair bows, handbags, hats, jewelry, leather accessories, mittens, pageant sashes, pareos, pins, pocket squares, ponchos, purses, reflective accessories, shawls, scarves, single or double lay of materials, stoles, sunglasses, suspenders, ties, tiaras, umbrellas, wallets, wearable technology accessories, and other accessory items.

In some embodiments, instructions may be provided and updated for how to use, but not limited to, any of the respective embodiments. In still some embodiments, on-line (web) content, digital content, one or multiple websites, published content, printed content, written content, visual content and other content may be provided to share information related to, but not limited to, any of the respective embodiments. In various embodiments, a kit may be provided having at least one wearable item included therein, and which may also have other items, parts, sections, and so forth included therein.

Various embodiments of the wearable item and of any other embodiment generally are, but not limited to, at least one of or any combination of the following: (i) made from one or multiple patterns; (ii) made without the use of any pattern; (iii) tailored to an individual body-form and/or any other desired form; (iv) made a custom size; (v) made-to-measure; (vi) hand-made; (vii) man-made; (viii) factory-made; (ix) machine-made; (x) assembled; (xi) ready-to-wear; or (xii) made in conformity with the standard measurements (e.g. extra-small, small, medium, large, plus sizes, one-size, and so forth) used in, but not limited to, the fashion and apparel industries for the manufacturing and the retailing of any kind of wearable item.

Those skilled in the art will understand that an unlimited number of methods can be used for: (i) making, but not limited to, at least any respective embodiment; and (ii) the implementation of, but not limited to, at least any respective embodiment. An unlimited number of any desired method can also be used in any embodiment of the method for using a wearable item. For instance, one or multiple methods could be predetermined, selected, computer generated, calculated, taken from a dress form, taken from a design, copied from another method, determined by an individual, determined by artificial intelligence, any combination thereof, or determined in other ways. By another way of example, one or multiple methods may involve using, but not limited to, a measurement from one or multiple parts of a body. By still another way of example, one or multiple methods may involve using, but not limited to, machinery, manual labor, craftsmanship, computerized technology, or other means of production. All of the described embodiments and provided exemplary Figures disclosed herein have been predetermined (by way of example and in an exemplary predetermined manner) for this discussion.

Those skilled in the art will also appreciate that any respective embodiment can be used in the desired quantity and can be used in any desired manner.

Various embodiments of the wearable item and of the desired any other embodiment generally are, but not limited to, at least one of or any combination of the following: (i) designed to have or be without a removable component; (ii) designed to have a number of non-removable and removable components; (iii) designed to have a number of components and the desired any other embodiment that can be, but not limited to, distinguishable (i.e., different from each other), indistinguishable (i.e., not different from each other), or a combination thereof; (iv) designed to have a number of components and the desired any other embodiment that can be, but not limited to, inside-out (or be, but not limited to, at least used inside-out); (v) designed to have a number of components and the desired any other embodiment that can be, but not limited to, reversible; (vi) designed to serve a single purpose or a number of purposes to achieve the desired result; (vii) made having the desired layout and with the desired attributes, thickness, color, form, shape, texture, transparency, and style; or (viii) made and used for other purposes. Although the detailed description herein provides several specific and more detailed descriptions of the described embodiments, of the attached Figures and of other details related to the present invention, it will be understood that: (i) some embodiments of a wearable item, of a method of using a wearable item and of any other embodiment are discussed herein; and (ii) other embodiments of the invention can be constructed, designed, made, styled, shaped, implemented, manipulated, modified and used in other ways.

Various embodiments of the wearable item, of the method of using a wearable item, and of any other embodiment can be used for a wide range of configurations. By way of example, various embodiments of the desired any respective embodiment are generally used for and transformed into, but not limited to, one or multiple configurations comprising any of at least one of or any combination of the following:

(i) a number of configurations having at least a number of components;

(ii) a number of configurations having at least two of the number of components being at least a number of garment components;

(iii) a number of configurations having at least two of the number of garment components at least attached together;

(iv) a number of configurations having at least two of the number of garment components positioned in at least one direction;

(v) a number of configurations having at least two of the number of garment components at least positioned in different directions from each other, and which in some embodiments of the invention, is also intended to refer to a number of configurations having (a) at least two of the number of garment components positioned in different directions from each other and (b) at least one of the number of garment components not positioned in a different direction from at least one of the number of garment components;

(vi) a number of configurations having at least two of the number of garment components comprising at least one dimension, at least one side, at least a number of free ends, at least a number of edges and at least a number of opposed ends, and wherein at least one of the number of edges is at least one of the number of free ends, at least one of the number of opposed ends is at least one of the number of edges, and at least one end of the number of opposed ends is at least one of the number of free ends in at least a number of configurations; or (vii) a number of configurations having at least one of the at least two of the number of garment components not attached to at least one of the at least two of the number of garment components at an edge being opposite at least one of a number of free ends of at least one of any of the at least two of the number of garment components, and which in some embodiments, is also intended to refer to a number of configurations having (a) at least one of the at least two of the number of garment components not attached to at least one of the at least two of the number of garment components at an edge not being opposite of at least one of a number of free ends of at least one of any of the at least two of the number of garment components and (b) at least one of the at least two of the number of garment components attached to at least one of the number of garment components at an edge being opposite of at least one of a number of free ends of at least one of any of the number of garment components.

In still various embodiments, the desired any respective embodiment can at least be used for and transformed into, but not limited to, one or multiple other configurations. By way of example, the one or multiple other configurations generally comprise any of, but not limited to, at least one of or any combination of the following:

(i) a number of configurations having a garment style configuration, and which in some embodiments, is also intended to refer to a number of configurations having the appearance of at least any single garment or multiple garments, clothing, and the like;

(ii) a number of configurations having a strap style configuration, and which in some embodiments, is also intended to refer to (a) a number of configurations having the appearance of at least any single strap or multiple straps, (b) a number of configurations having at least one strap style configuration with or without any component being, but not limited to, at least any strap, or (c) a number of configurations having at least any combination thereof;

(iii) a number of configurations having a strapless style configuration, and which in some embodiments of the invention, is also intended to refer to (a) a number of configurations having at least no appearance of any strap, (b) a number of configurations having at least one strapless style configuration without or with any component being, but not limited to, at least any strap, or (c) a number of configurations having at least any combination thereof;

(iv) a number of configurations having a shoulder style configuration, and which in some embodiments, is also intended to refer to a number of configurations having the appearance of at least any single shoulder style or multiple-shoulder style;

(v) a number of configurations having a neckline style configuration, and which in some embodiments, is also intended to refer to a number of configurations having the appearance of at least any single neckline or multiple necklines;

(vi) a number of configurations having a sleeve style configuration, and which in some embodiments of the invention, is also intended to refer to (a) a number of configurations having the appearance of at least any single sleeve or multiple sleeves, (b) a number of configurations having at least one sleeve style configuration without or with any component being, but not limited to, at least any sleeve, or (c) a number of configurations having at least any combination thereof;

(vii) a number of configurations having a sleeveless style configuration, and which in some embodiments of the invention, is also intended to refer to (a) a number of configurations having at least no appearance of any sleeve, (b) a number of configurations having at least one sleeveless style without or with any component being, but not limited to, at least any sleeve, or (c) a number of configurations having at least any combination thereof;

(viii) a number of configurations having at least two of the number of components not attached together;

(ix) a number of configurations having at least a part being used as, but not limited to, a garment train, and which in some embodiments of the invention, is also intended to refer to (a) a number of configurations having the appearance of at least any kind of garment train, (b) a number of configurations having any single train or multiple trains (which may or may not be part of a respective embodiment) at least attached to a part of a respective embodiment, or (c) a number of configurations having at least any combination thereof;

(x) a number of configurations having a cut-out style configuration, and which in some embodiments, is also intended to refer to (a) a number of configurations having the appearance of having at least one or multiple components, sections, and so forth cut out or removed, (b) a number of configurations having at least one or multiple components cut out or removed, or (c) a number of configurations having at least any combination thereof;

(xi) a number of configurations having a configuration of any headwear, and which in some embodiments of the invention, is also intended to refer to (a) a number of configurations having the appearance of at least any headwear, (b) a number of configurations having at least a part (which may or may not be part of a respective embodiment) being used as, but not limited to, at least any headwear, or (c) a number of configurations having at least any combination thereof;

(xii) a number of configurations having at least one 'X' shape or 'X-like' form, and which in some embodiments, is also intended to refer to (a) a number of configurations having the appearance of at least one 'X' shape or 'X-like' form, (b) a number of configurations having at least a part (which may or may not be part of a respective embodiment) being used as, but not limited to, at least one 'X' shape or 'X-like' form, or (c) a number of configurations having at least any combination thereof;

(xiii) a number of configurations having at least one 'T' shape or 'T-like' form, and which in some embodiments, is also intended to refer to (a) a number of configurations having the appearance of at least one 'T' shape or 'T-like' form, (b) a number of configurations having at least a part (which may or may not be part of a respective embodiment) being used as, but not limited to, at least one 'T' shape or 'T-like' form, or (c) a number of configurations having at least any combination thereof;

(xiv) a number of configurations that are at least symmetrical, and which in some embodiments, is also intended to refer to a number of configurations having the appearance of at least any symmetrical configuration;

(xv) a number of configurations that are at least asymmetrical, and which in some embodiments, is also intended to refer to a number of configurations having the appearance of at least any asymmetrical configuration;

(xvi) any other variation thereof; or (xvii) the desired any other configuration.

In some embodiments, the wearable item, the method of using a wearable item, and any other embodiment are also generally used for, but not limited to, any of or any combination of the following: (i) making and manipulating at least a number of configurations; (ii) creating a variety of, but not limited to, garment style configurations and any other desired configuration; (iii) putting on, but not limited to, a respective embodiment; (iv) the removal of, but not limited to, a respective embodiment; or (v) other uses.

In some embodiments, the wearable item and the desired any other embodiment are also generally used for, but not limited to, any of or any combination of the following: (i) hanging freely without or with being at least tied to a component or any other item in a number of configurations; (ii) hanging freely without or with being at least secured to a component or any other item in a number of configurations; (iii) being tied to a component in a number of configurations; (iv) being used without anything or in combination with something in a number of configurations; (v) being at least worn in a number of configurations; (vi) being worn on, but not limited to, a part of a body in a number of configurations; (vii) being worn on, but not limited to, a user in a number of configurations; or (viii) other uses. One or multiple body parts (e.g., a number of limbs, shoulders, feet, heads, torsos and other body parts, without limitation) are used in some embodiments. In various embodiments, a respective embodiment can be used for a number of configurations that might not be for the body (e.g., for other forms, items, configurations, and so forth), as well as in still other ways and for other purposes.

Now turning to the Figures, FIGS. 1A-1B to FIG. 7 will now be discussed and described. In the described embodiments: a first embodiment of a wearable item 1 is shown in a front perspective view in FIG. 1A and back perspective view in FIG. 1B; a second embodiment of a wearable item 2 is shown in a front perspective view in FIG. 2, and in a more detailed front perspective view in FIG. 3; a third embodiment of a wearable item 3 is shown in a front perspective view in FIG. 4A and back perspective view in FIG. 4B, and in another front perspective view in FIG. 5A and back perspective view in FIG. 5B; a fourth embodiment of a wearable item 4 is shown in a front perspective view in FIG. 6A and back perspective view in FIG. 6B; and a fifth embodiment of a wearable item 5 is shown in a front perspective view in FIG. 7. It will be understood that various characteristics, features, aspects, details and other inventive aspects and principles related to any embodiment of a wearable item could be applied to, but not limited to, any other embodiment, and may be vice versa in other embodiments.

Figure 1B:
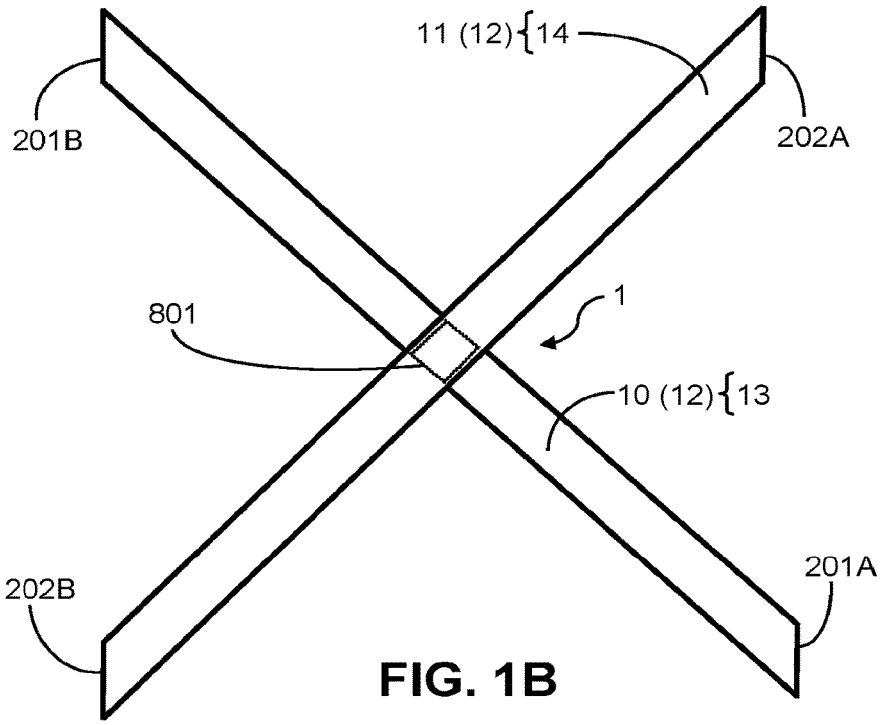
Figure 3:
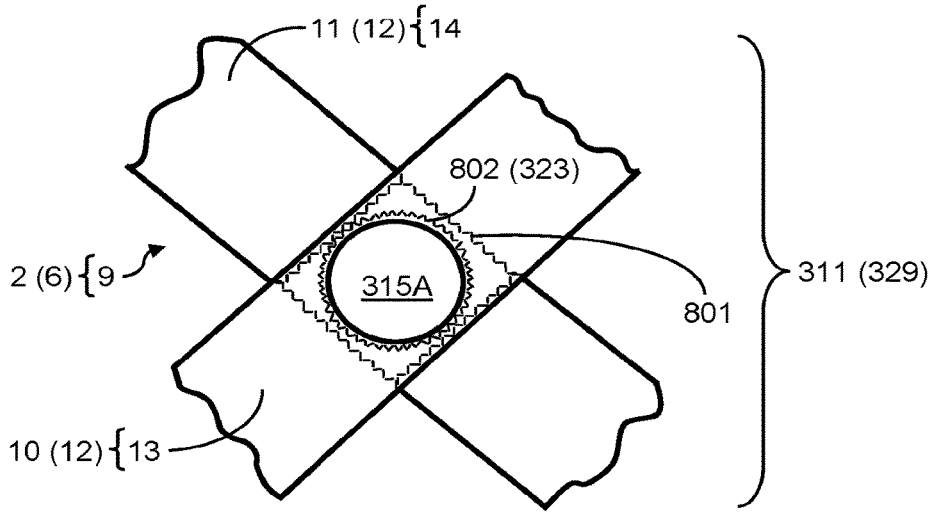
FIG. 3 is a front perspective view of a more detailed view of the second wearable item.
Figure 7:
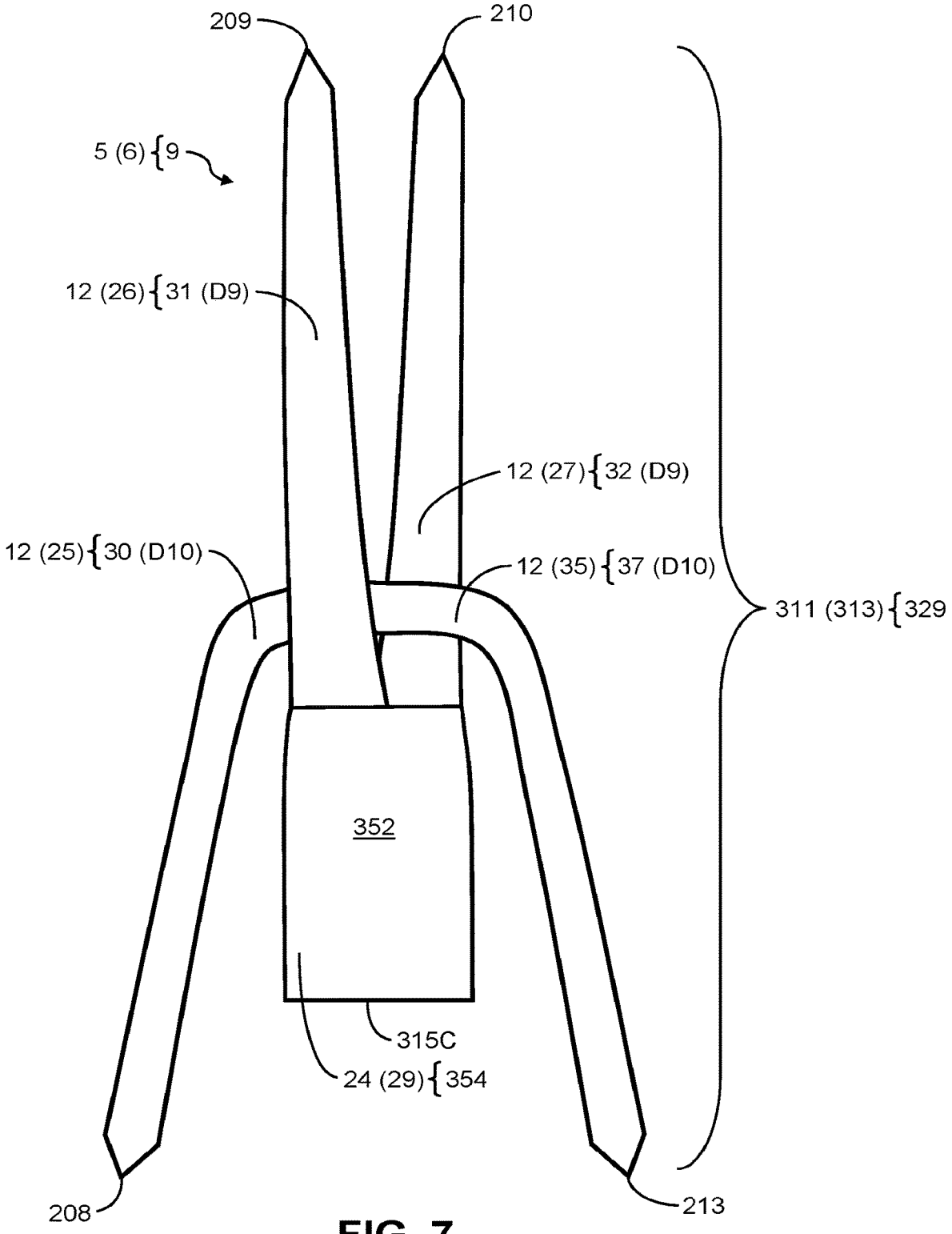
FIG. 7 is a front perspective view of a fifth embodiment of a wearable item and of some other embodiments.
Figure 8:
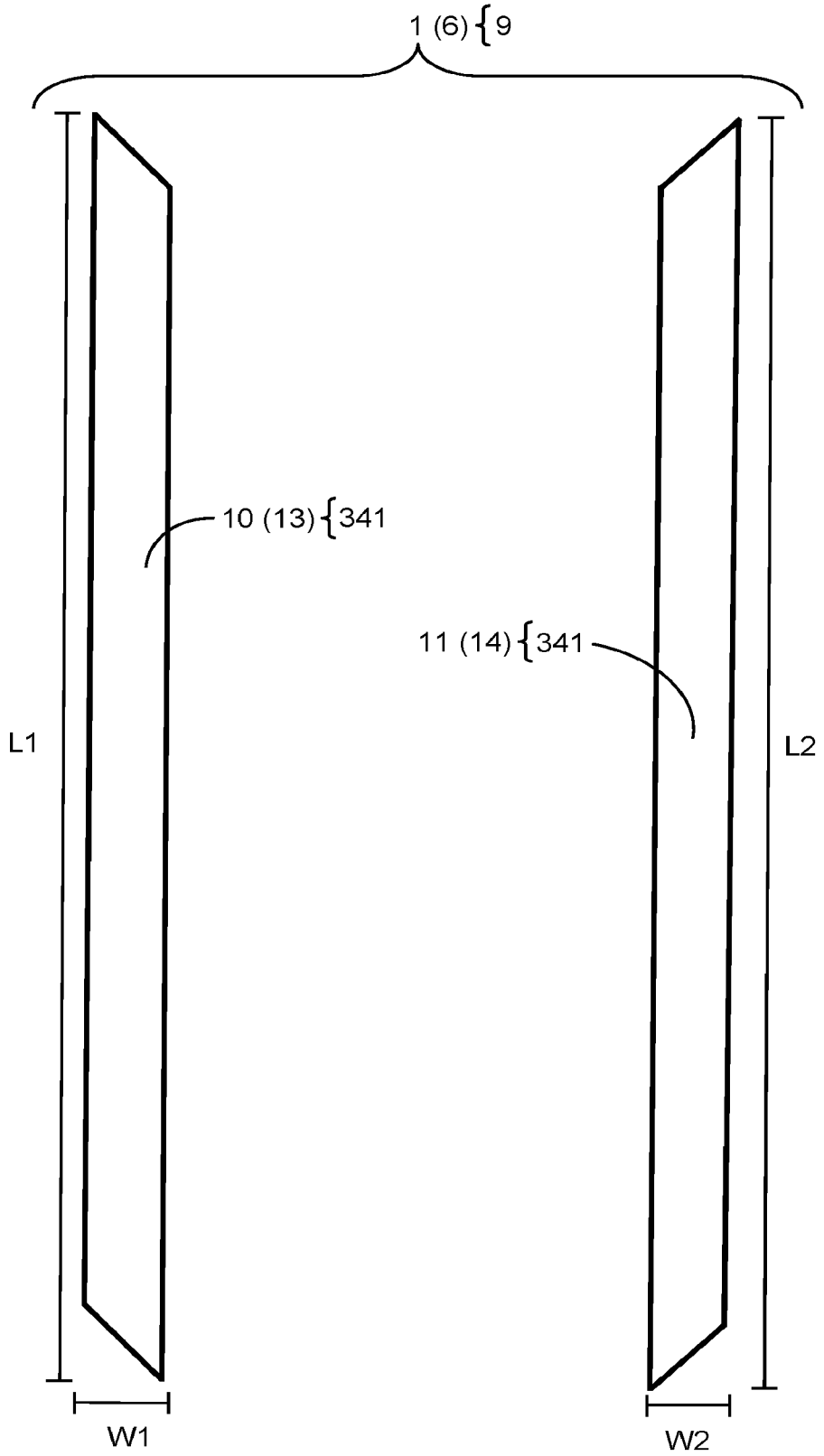
FIG. 8 is a front perspective view of the first wearable item, illustrating some of the components thereof (which were modified in the second wearable item) and a first embodiment of at least one dimension.
Figure 9:
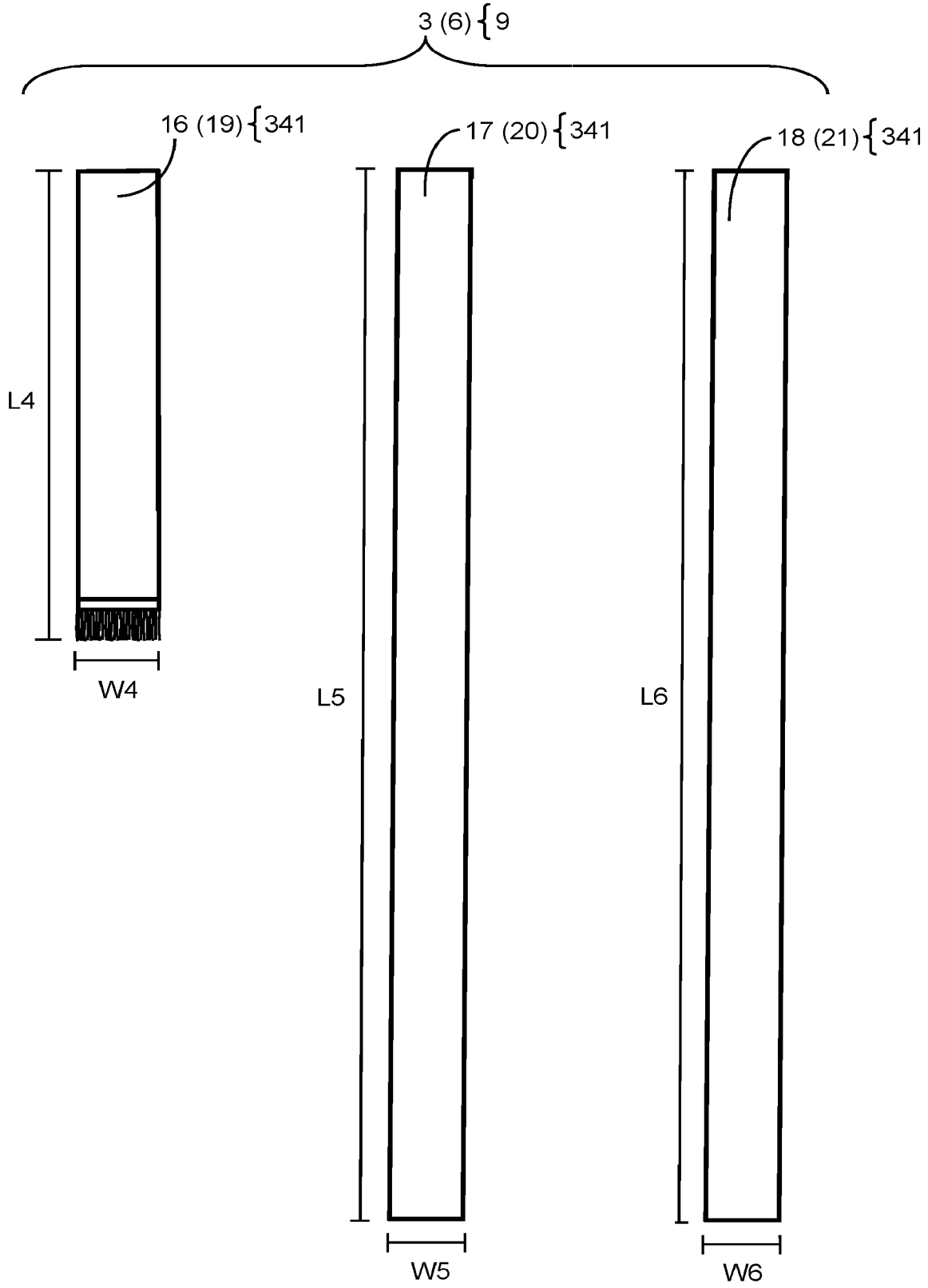
FIG. 9 is a front perspective view of the third wearable item, illustrating some of the components thereof and a second embodiment of at least one dimension.
Figure 10:
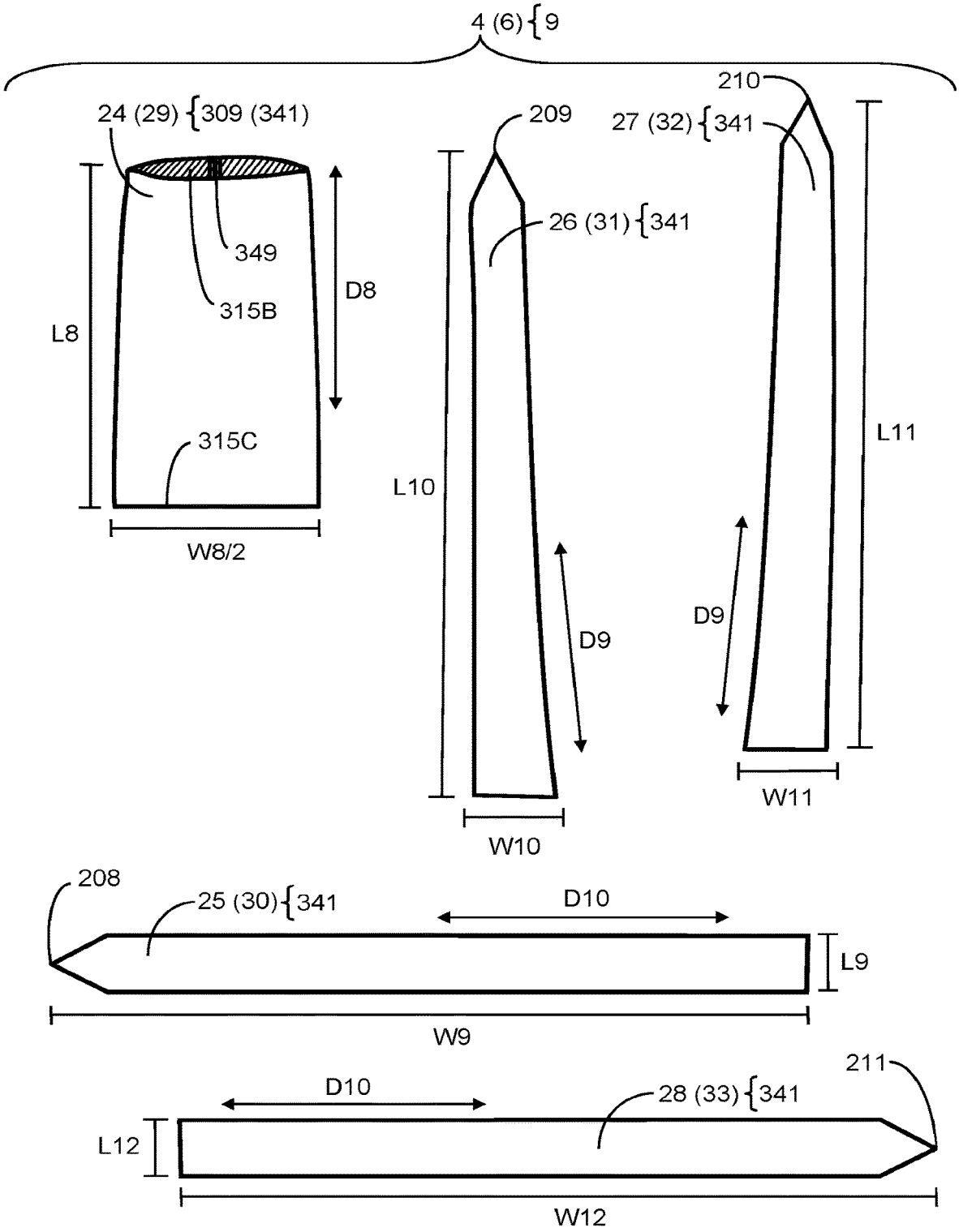
FIG. 10 is a front perspective view of the fourth wearable item, illustrating some of the components thereof, a third embodiment of at least one dimension, and another embodiment.

FIGS. 1A-1B to FIG. 7 also show some embodiments of the following: a plurality of components 6; at least two of the plurality of components 6 being used as at least a plurality of garment components 9; at least one configuration having at least two of the plurality of components 6 used as at least the plurality of garment components 9 at least attached 311 together; at least one free end 313 (except for FIG. 3, in which the at least one free end 313 cannot be seen in this illustration); and at least one configuration having at least two of the number of components 6 used as at least the number of garment components 9 with at least one free end 313 (also not illustrated in FIG. 3).

Some embodiments of the present invention have a characteristic of having at least one or multiple free ends 313 that generally are, but not limited to, at least one of or any combination of the following: (i) used in the making of the desired number of configurations; (ii) at least suitable for being manipulated and used in other ways (e.g., generally for, but not limited to, being tied, criss-crossed, wrapped, twisted, tucked, repositioned, styled, used without being styled, and used in other ways); or (iii) used for other purposes.

In the present disclosure, each component 6 might not be repeated separately in the description of some of the embodiments herein throughout the discussion. However, it should be noted that reference to any one or multiple components (as well as any one or multiple specific components) could be intended to also include reference to any one or multiple garment components (as well as any one or multiple specific components) or any other component (which may not or may be any garment component) or may be vice versa in still some embodiments, but might not be intended to refer to each other in other embodiments.

In FIGS. 1A-1B, the described embodiments illustrate wearable item 1 having a first component 10 and a second component 11 included as being a plurality of components 6 used as at least two garment components 9. In the described embodiments: components 10 and 11 are also a panel 12; component 10 is used as a first garment component 13 and has free ends 201A and 201B; component 11 is used as a second garment component 14 and has free ends 202A and 202B; components 10 and 11 are attached together at location 801; and stitches are used at location 801 to join components 10 and 11 together. It will be understood that the use of a number of stitches in not required in every embodiment. Additionally, other embodiments of the invention could have an unlimited number of other stitches and any stitch, which can also be used in other ways.

Figure 2:
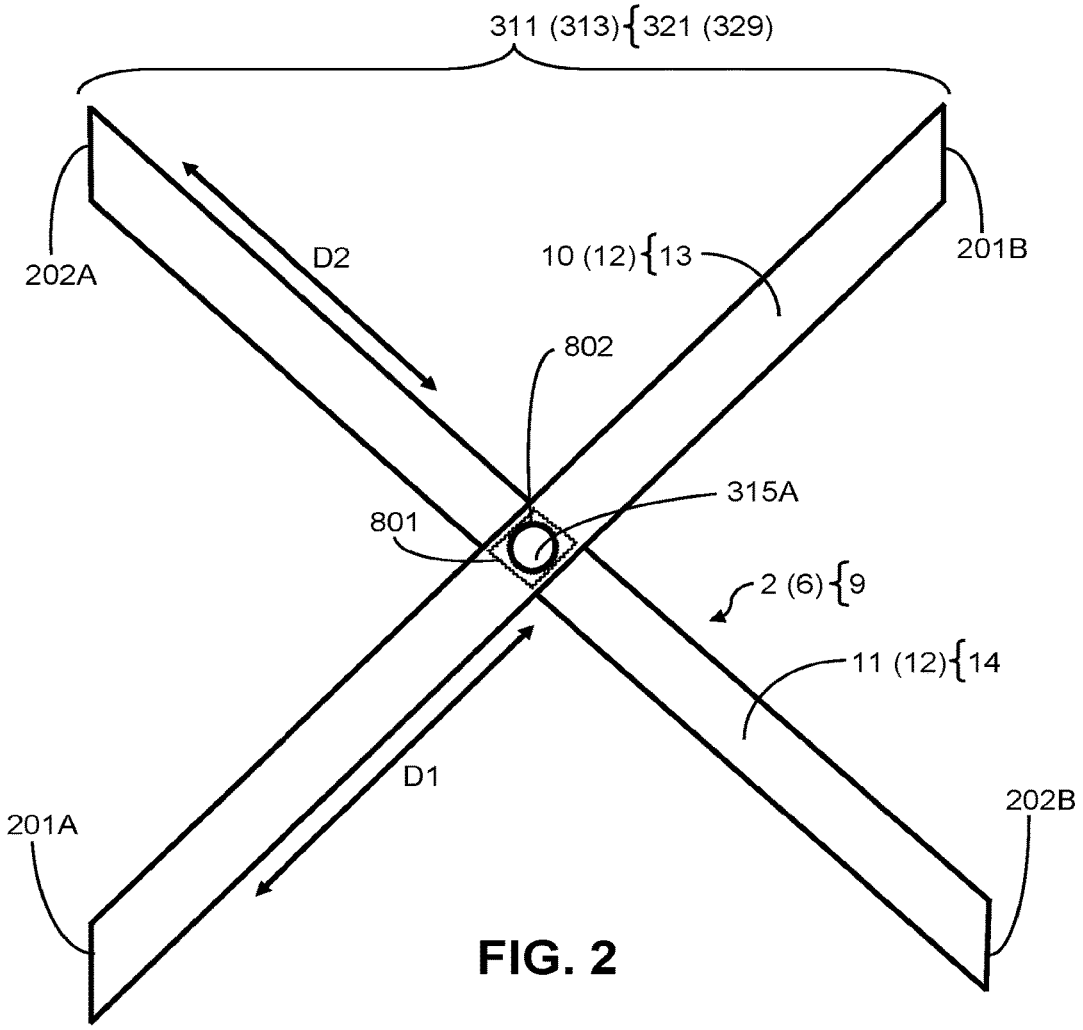
FIG. 2 is a front perspective view of a second embodiment of a wearable item and of some other embodiments.

In FIG. 2, the described embodiments illustrate wearable item 2 having most of the previously mentioned characteristics described for wearable item 1 (therefore, the same characteristics thereof will not be repeated in this discussion). However, in the described embodiments, components 10 and 11 are shown having a first embodiment of an aperture 315A and are also attached together at another location 802 and with a number of other stitches, as seen in FIG. 3.

Figure 4A:
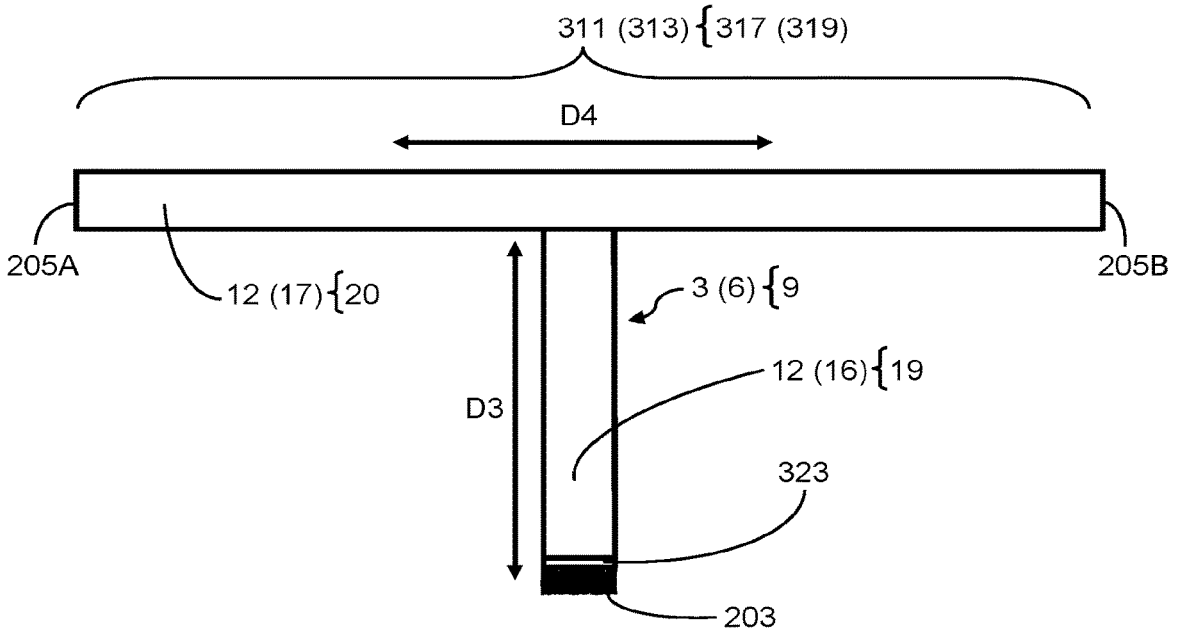
FIGS. 4A-4B are a front (A) and back (B) perspective view of a third embodiment of a wearable item and of some other embodiments.
Figure 4B:
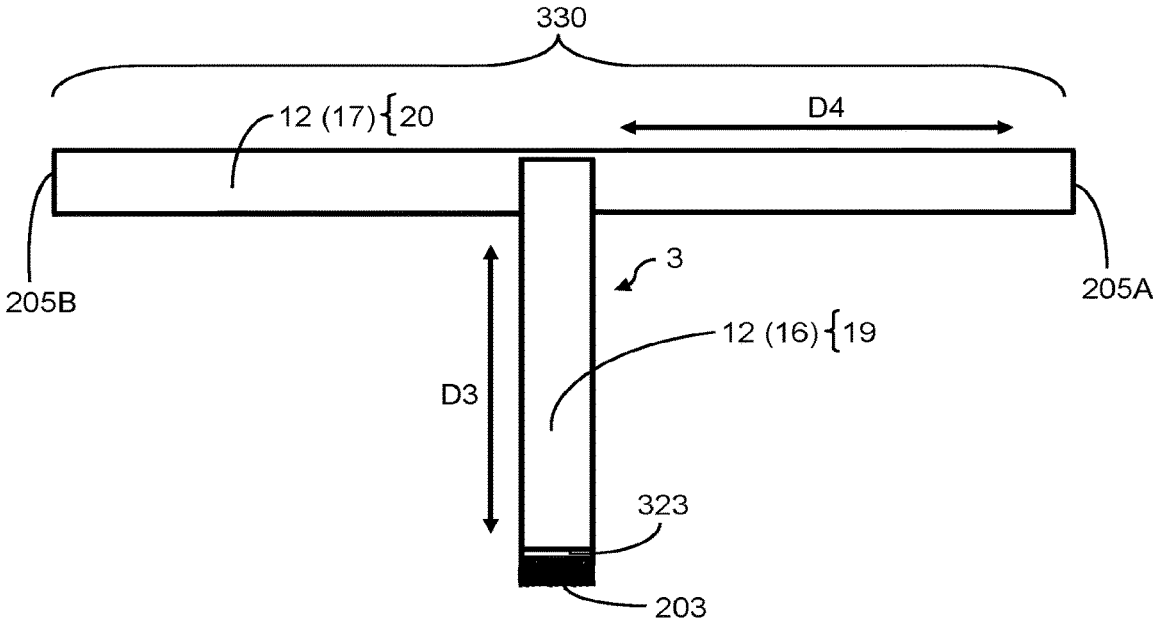

Now turning to FIGS. 4A-4B and FIGS. 5A-5B, in which the illustrations of the described embodiments show wearable item 3 having a first component 16 (see FIGS. 4A-4B), a second component 17 (see FIGS. 4A-4B and FIGS. 5A-5B) and a third component 18 (see FIGS. 5A-5B) included as being at least two of the number of components 6 used as at least a number of garment components 9. In the described embodiments: components 16, 17 and 18 are used to illustrate one embodiment of a number of removable components 317; components 16, 17 and 18 are also a panel 12; component 16 is used as a first garment component 19 and has a free end 203; component 17 is used as a second garment component 20 and has free ends 205A and 205B; component 18 is used as a third garment component 21 and has free ends 206A and 206B; components 16 and 17 are shown attached together in FIGS. 4B-4B; and components 17 and 18 are shown attached together in FIGS. 5A-5B. Additionally, in the described embodiments, wearable item 3 and components 16 and 17 are used to show one embodiment of a configuration having a T shape or at least a T-like form 319 (as seen in FIGS. 4A-4B). In other embodiments of the invention, components 10 and 11, components 24, 25, 26 and 27 (as shown in FIGS. 6A-6B and in FIG. 7), component 28 (illustrated in FIGS. 6A-6B), component 35 (illustrated in FIG. 7), the desired any other component 6 in any other embodiment, and the desired any other embodiment can be or at least have a number of removable components 317.

Figure 5A:
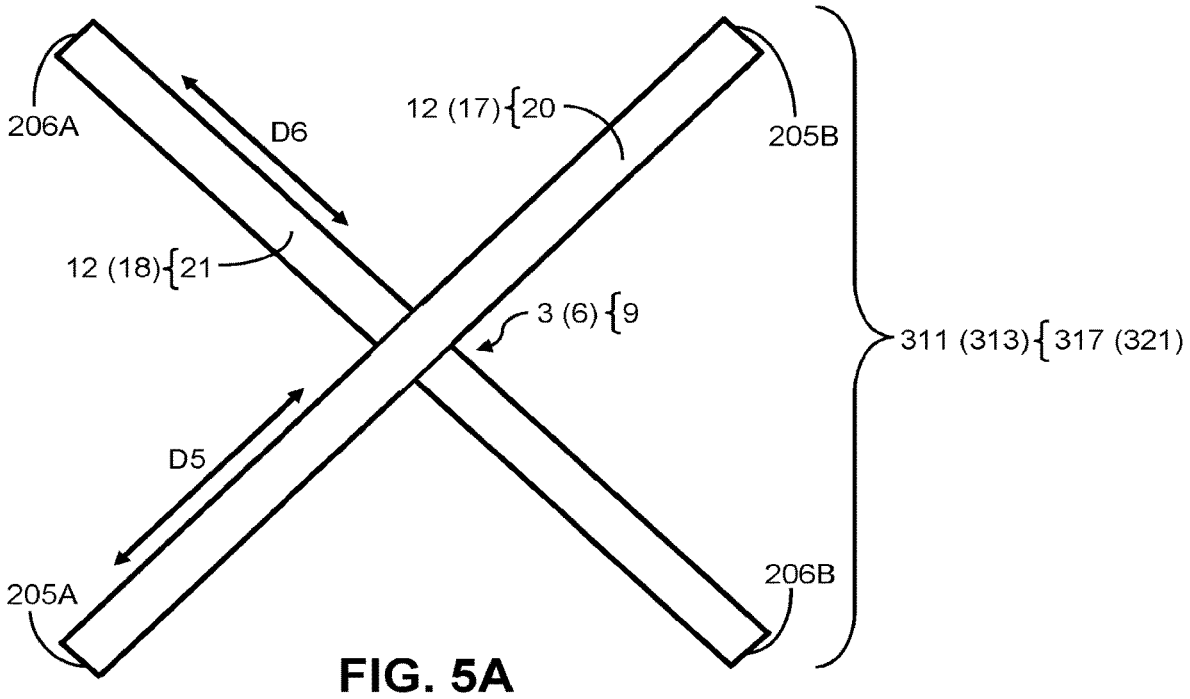
FIGS. 5A-5B are a front (A) and back (B) perspective view of the third wearable item and of some other embodiments.
Figure 5B:
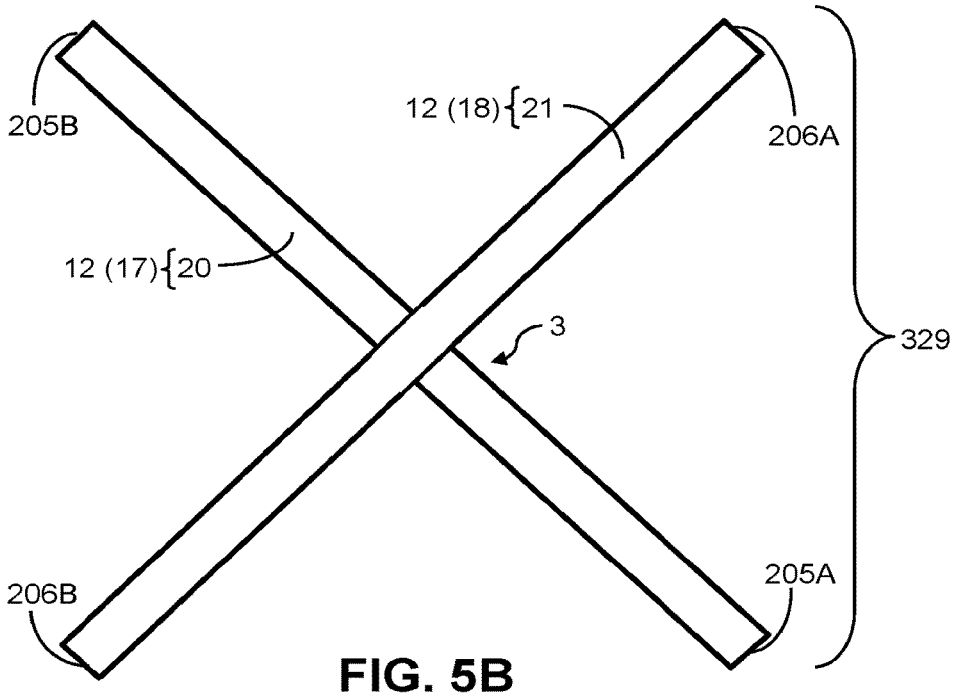

In the described embodiments, wearable item 1 and components 10 and 11 (as seen in FIGS. 1A-1B), wearable item 2 and components 10 and 11 (as seen in FIG. 2), and wearable item 3 and components 17 and 18 (as seen in FIGS. 5A-5B) are used to show some embodiments of a configuration having an X shape or at least an X-like form 321.

In the described embodiments, stitches have been used for components 10 and 11 and at location 802 in wearable item 2 (as shown in FIG. 3) and a strip of fabric has been used for component 16 in wearable item 3 (as shown in FIGS. 4A-4B) to show some embodiments of a number of borders 323. Some embodiments of the present invention have a characteristic of having one or multiple borders that generally are used for, but not limited to, at least one of any or any combination of the following: (i) decoration; (ii) aesthetic purposes; (iii) securing a part of something or multiple things; (iv) a functional purpose; or (v) other purposes.

Figure 6A:
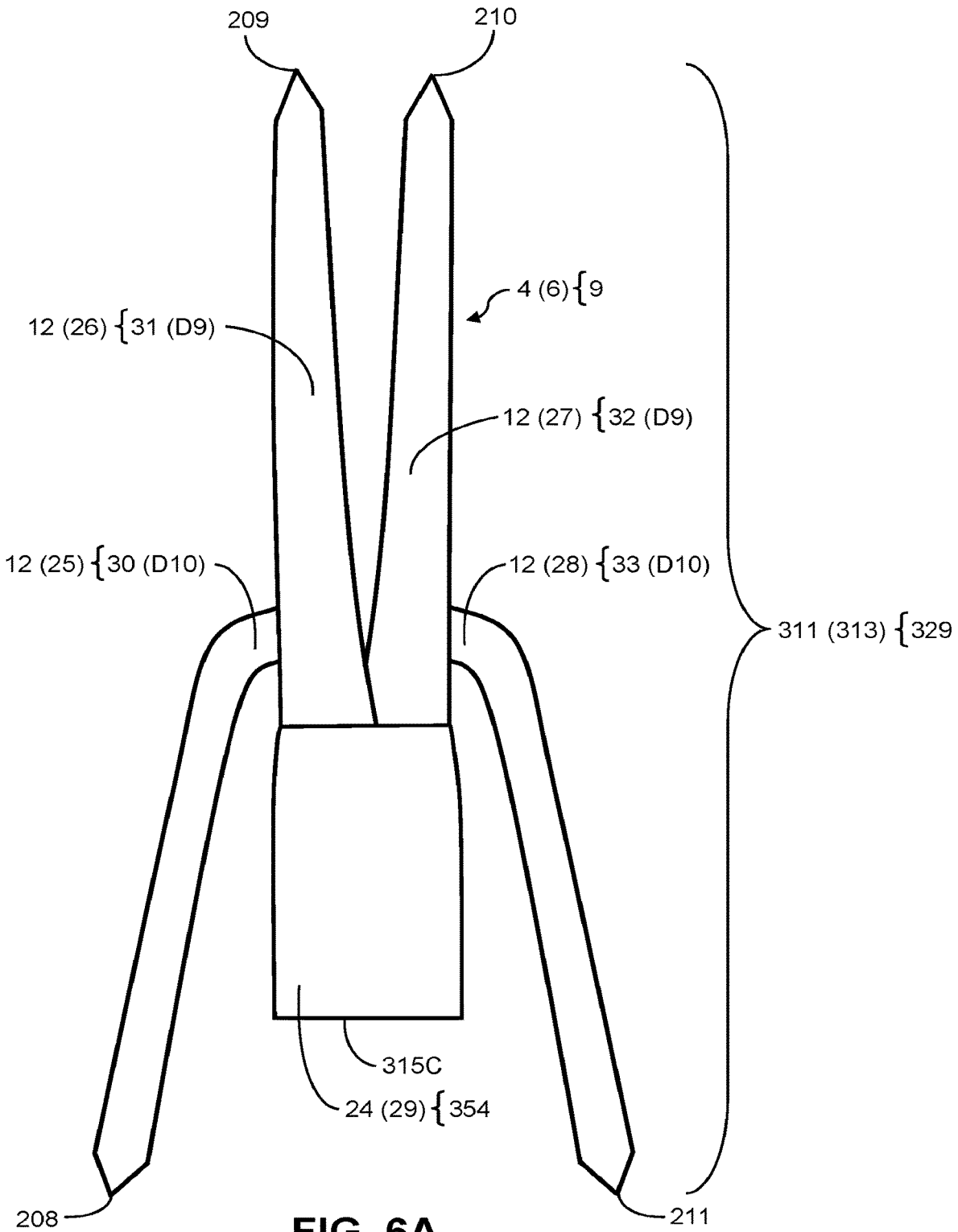
FIG. 6A is a front perspective view of a fourth embodiment of a wearable item and of some other embodiments.
Figure 6B:
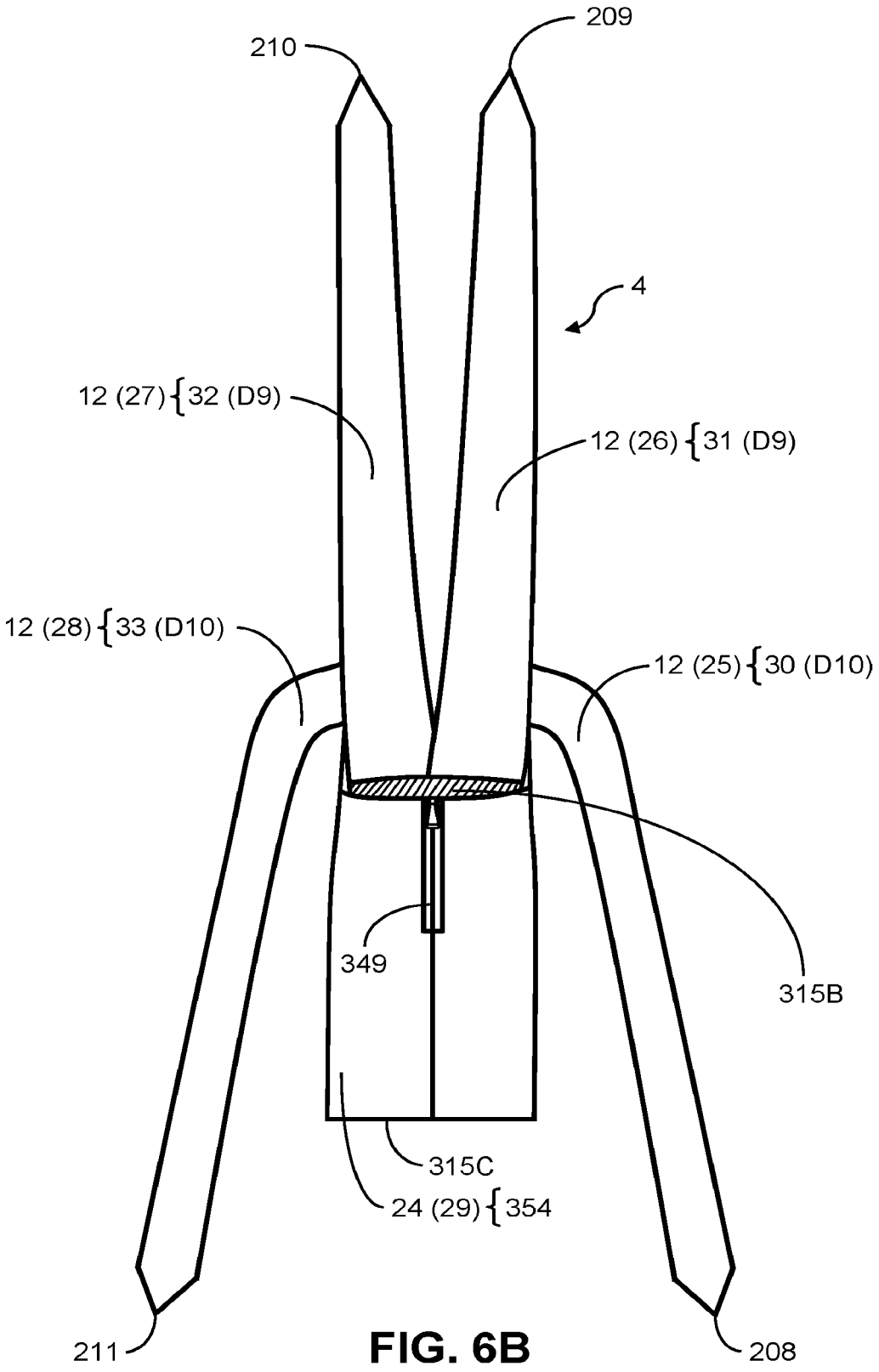
FIG. 6B is a back perspective view of the fourth wearable item with a closure device.

In FIGS. 6A-6B, the described embodiments illustrate wearable item 4 having a first component 24, a second component 25, a third component 26, a fourth component 27 and a fifth component 28 included in the quantity as being at least two of the plurality of components 6 used as at least two of a plurality of garment components 9. In the described embodiments: components 25, 26, 27 and 28 are also a panel 12; component 24 is used as a first garment component 29; component 25 is used as a second garment component 30 and has a free end 208; component 26 is used as a third garment component 31 and has a free end 209; component 27 is used as a fourth garment component 32 and has a free end 210; component 28 is a fifth garment component 33 and has a free end 211; and component 24 is shown attached to components 26 and 27, components 25 and 26 are also shown attached together, and components 27 and 28 are also shown attached together.

In FIG. 7, the described embodiments illustrate wearable item 5 having most of the previously mentioned characteristics described for wearable item 4 (and the same characteristics thereof will not be repeated in this discussion). However, in the described embodiments: component 28 is not used in wearable item 5, but a fifth component 35 is used instead and is included in the quantity as also being at least one of the plurality of garment components 9 used as at least a quantity of the plurality of components 6; component 35 is also a panel 12 and a different length from component 25; component 35 is longer than the length used for component 25; component 35 is used as a fifth garment component 37 and has a free end 213; and component 26 is shown attached to components 25 and 35.

Furthermore, in the described embodiments: component 24 is used to illustrate a second embodiment of an aperture 315B and a third embodiment of an aperture 315C, as shown in FIG. 6B of wearable item 4 (but with only aperture 315C indicated in FIG. 6A) and in FIG. 7 of wearable item 5 (with only aperture 315C indicated in the FIG). In the described embodiments, the back view (not illustrated) of wearable item 5 is similar to the back view of wearable item 4 shown in FIG. 6B, with the exception of wearable item 5 not having component 28, but having component 35 attached to component 26 and positioned either in front of or behind component 27 (at the user's discretion) in this example.

Although panels 12 are used in the described embodiments of wearable items 1, 2, 3, 4 and 5 and in some of the other described embodiments mentioned herein, other embodiments of the invention could be comprised of, but not limited to, one or multiple components 6 that might not necessarily be a panel 12, but which may be a substitution for the panel 12 or used as an alternative for the panel 12. By way of example, other substitutions may be, but not limited to, a number of extensions, a number of strips of something, a number of other components, and so forth.

Additionally, in the described embodiments: wearable item 1 (see FIGS. 1A-1B), wearable item 2 (see FIG. 2 to FIG. 3), wearable item 3 (see FIGS. 5A-5B), wearable item 4 (see FIGS. 6A-6B), and wearable item 5 (see FIG. 7) are used to show some embodiments of an asymmetrical configuration 329; and wearable item 3 (see FIGS. 4A-4B) is used to show one embodiment of a symmetrical configuration 330. As a reminder, it will be understood that in various embodiments, an unlimited number of any or any combination of (i) the described embodiments or (ii) the desired any other asymmetrical configuration, any other symmetrical configuration, any variation thereof, or any combination thereof can be used for (but not limited to) any respective embodiment.

Those skilled in the art will understand that an unlimited number of any or any combination of, but not limited to, (i) other shapes, forms, layouts or arrangements and (ii) any shape, any form, any layout or any arrangement can be used in other embodiments.

Some of the details regarding the previously mentioned FIGS. 1A-1B to FIG. 7 will be referred to in some parts of the following discussion regarding FIG. 8 to FIGS. 46A-46B. Suggestions for use for some embodiments of the present invention, and some of the other advantages, characteristics, features, attributes and qualities of the invention will be discussed and are all provided by way of example in the following FIGS. and discussion hereinafter.

Now turning to FIG. 8 to FIG. 11, which illustrate a front view of the described embodiments of at least two of a plurality of components 6 used as at least a plurality of garment components 9 having at least one dimension 341. In the described embodiments, the dimensions 341 of both a 'LENGTH' or 'L+a number' and a 'WIDTH' or 'W+a number' are used by way of example, for identification purposes only and for identifying like embodiments shown in these illustrations. Furthermore, in the described embodiments: component 10 has length L1 and width W1, and component 11 has length L2 and width W2 in FIG. 8 of wearable item 1 (and which also apply to wearable item 2, not illustrated); component 16 has length L4 and width W4, component 17 has length L5 and width W5, and component 18 has length L6 and width W6 in FIG. 9 of wearable item 3; component 24 has length L8 and width W8/2, this embodiment of width W8/2 is a width being half of a circumference in this example, component 25 has length L9 and width W9, component 26 has length L10 and width W10, component 27 has length L11 and width W11, and component 28 has length L12 and width W12 in FIG. 10 of wearable item 4 and in FIG. 11 of wearable item 5 (with the exception of component 28 not being used in this embodiment of wearable item 5); and component 35 has length L14 and multiple widths W14A and W14B in FIG. 11 of wearable item 5. Additionally, in the described embodiments shown in FIG. 11: some sides 87A, 87B and 87D of component 35 are identified in the illustration; side 87A is an exemplary slightly angled side (for the purpose of creating a more suitable form that is adapted to this design of the curved part of component 26 (as seen in FIG. 7) in this embodiment); and side 87B is this embodiment of width W14A and a predetermined slightly longer width in this example compared to the described embodiment of width W14B used for side 87D.

Various embodiments of the present invention generally have a length L and a width W. Moreover, some embodiments of the invention generally are or at least include any length being, but not limited to, any or any combination of the following: (i) a length that is "at least floor length", which should be interpreted as referring generally to any length in which at least any respective embodiment is (a) exactly or (b) at least slightly (or alternatively, any other synonym, word, phrase, terminology and the like having a similar meaning thereof) in contact with a floor; (ii) a length that is "at least longer than floor length", which should be interpreted as referring generally to any length in which at least any respective embodiment exceeds the "at least floor length"; (iii) a length that is "at least shorter than floor length", which should be interpreted as referring generally to any length in which at least any respective embodiment does not have any contact with a floor; or (iv) any other desired length. As used herein and in accordance with some embodiments of the invention: the term "floor" should also to be interpreted as referring to terms related to 'ground', 'pavement,' and the like; and the term "floor length" should also to be interpreted as referring to any 'ground-length', 'pavement-length', and the like.

In other embodiments, the respective embodiment can be or at least include one or more than one length, width, any other desired dimension, or any combination thereof.

Now turning to FIGS. 12A-12B to FIGS. 15A-15B, which illustrate the following: some embodiments of at least one configuration having at least two of a plurality of garment components 9 at least included as being a plurality of components 6 and having at least one side 342, at least one edge 343 and at least one opposed ends 344; and the described embodiments having exemplary embodiments of at least one edge 343 being a said at least one free end 313, and at least one end of said at least one opposed ends 344 being at least a said at least one free end 313 and a said at least one edge 343.

According to some embodiments of the present invention: (i) the at least one side 342 generally is any side being, but not limited to, a right side, a wrong side, a front side, a back side, a lateral side, a top side, a bottom side, an inner side, an outer side, a hidden side, a visible side, or any other variation of a side; (ii) the at least one side 342 can be, but not limited to, a side that is one-sided, multi-sided or any other variation thereof; (iii) the at least one side 342 can be, but not limited to, any desired surface; (iv) at least one of a number of edges 343 can be, but not limited to, a finished edge, an unfinished edge, a raw edge, a decorated edge, an undecorated edge, a personalized edge, any other variation of an edge, or any combination thereof; and (v) other variations of a number of opposed ends 344 can be used in various embodiments. In addition, an unlimited number of surface textures, layers, designs, layouts and attributes, and any other variation thereof can be used in other embodiments of the invention.

Figure 12A:
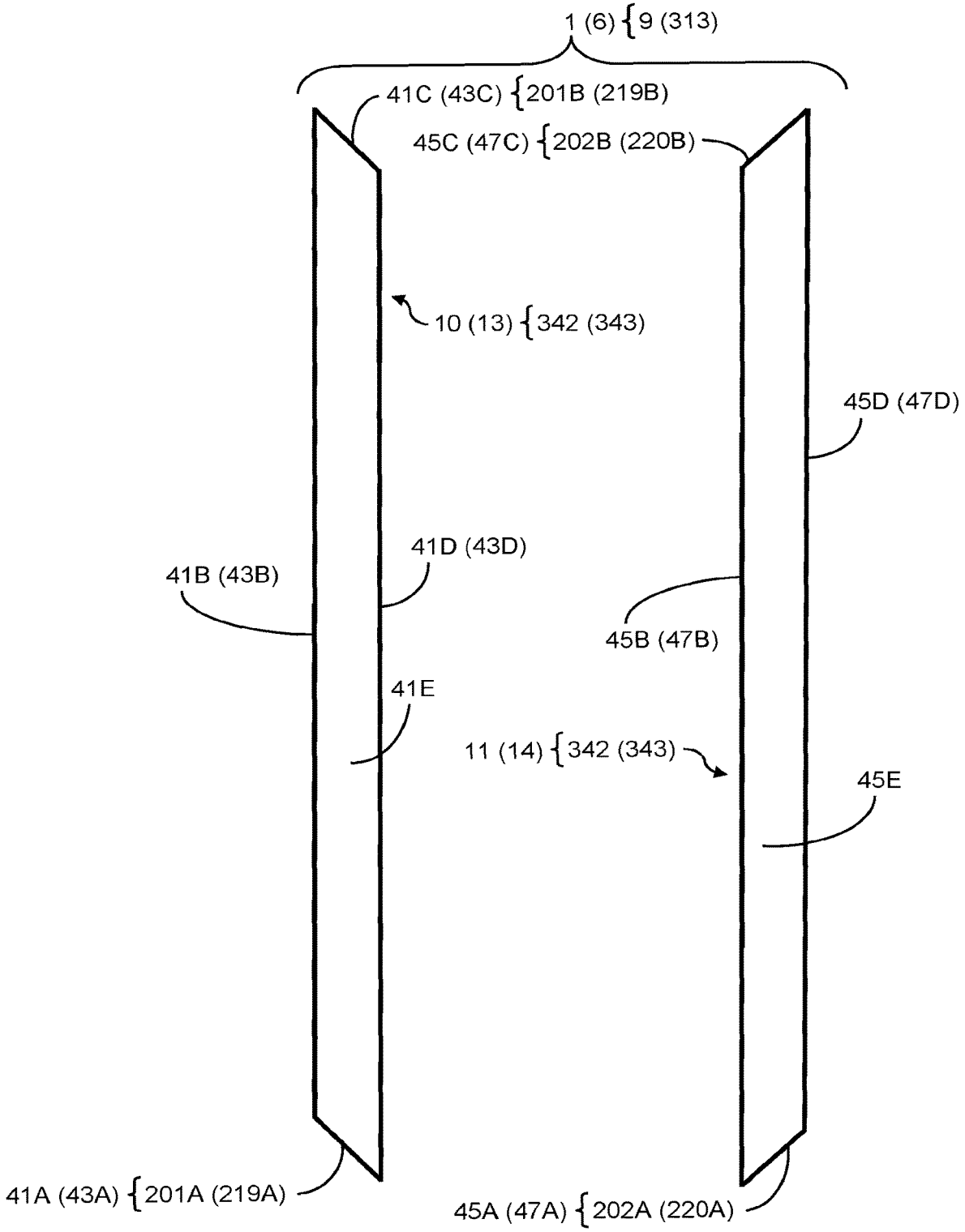
FIGS. 12A-12B are a front (A) and back (B) perspective view of the components used in the first wearable item (which were modified in the second wearable item), illustrating some of the features thereof and a first embodiment of a plurality of components used as at least two garment components.
Figure 12B:
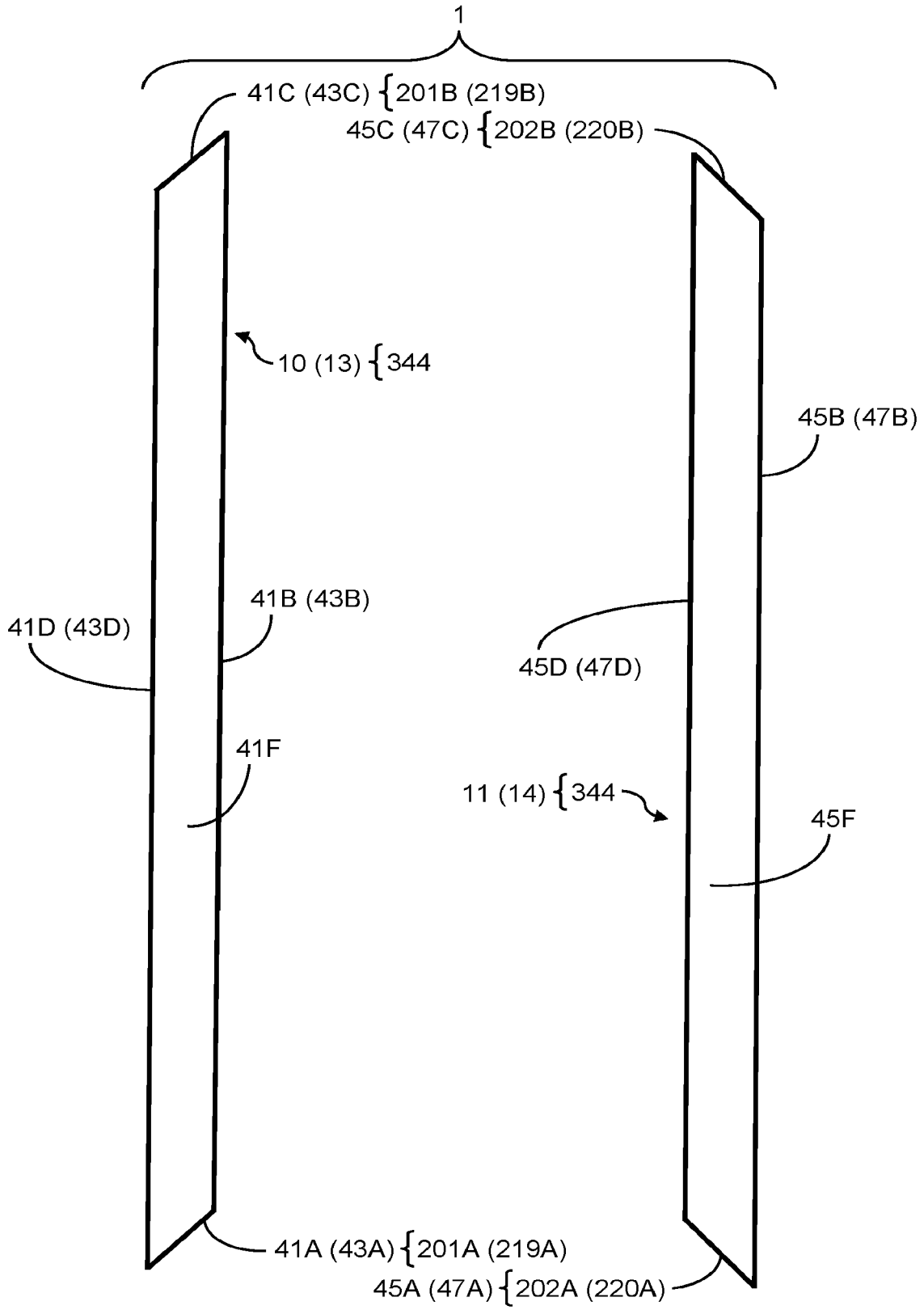

In FIGS. 12A-12B, the described embodiments illustrate: a front perspective view in FIG. 12A and a back perspective view in FIG. 12B of components 10 and 11 used for wearable item 1 and which are also used in wearable item 2 (not illustrated); component 10 having sides 41A, 41B, 41C and 41D, edges 43A, 43B, 43C and 43D, free ends 201A and 201B, and opposed ends 219A and 219B; and component 11 having sides 45A, 45B, 45C and 45D, edges 47A, 47B, 47C and 47D, free ends 202A and 202B, and opposed ends 220A and 220B.

In FIG. 12A, the described embodiments also illustrate: component 10 having a front side 41E; and component 11 having a front side 45E. In FIG. 12B, these embodiments further illustrate: component 10 having a backside 41F; and component 11 having a back side 45F.

Figure 13A:
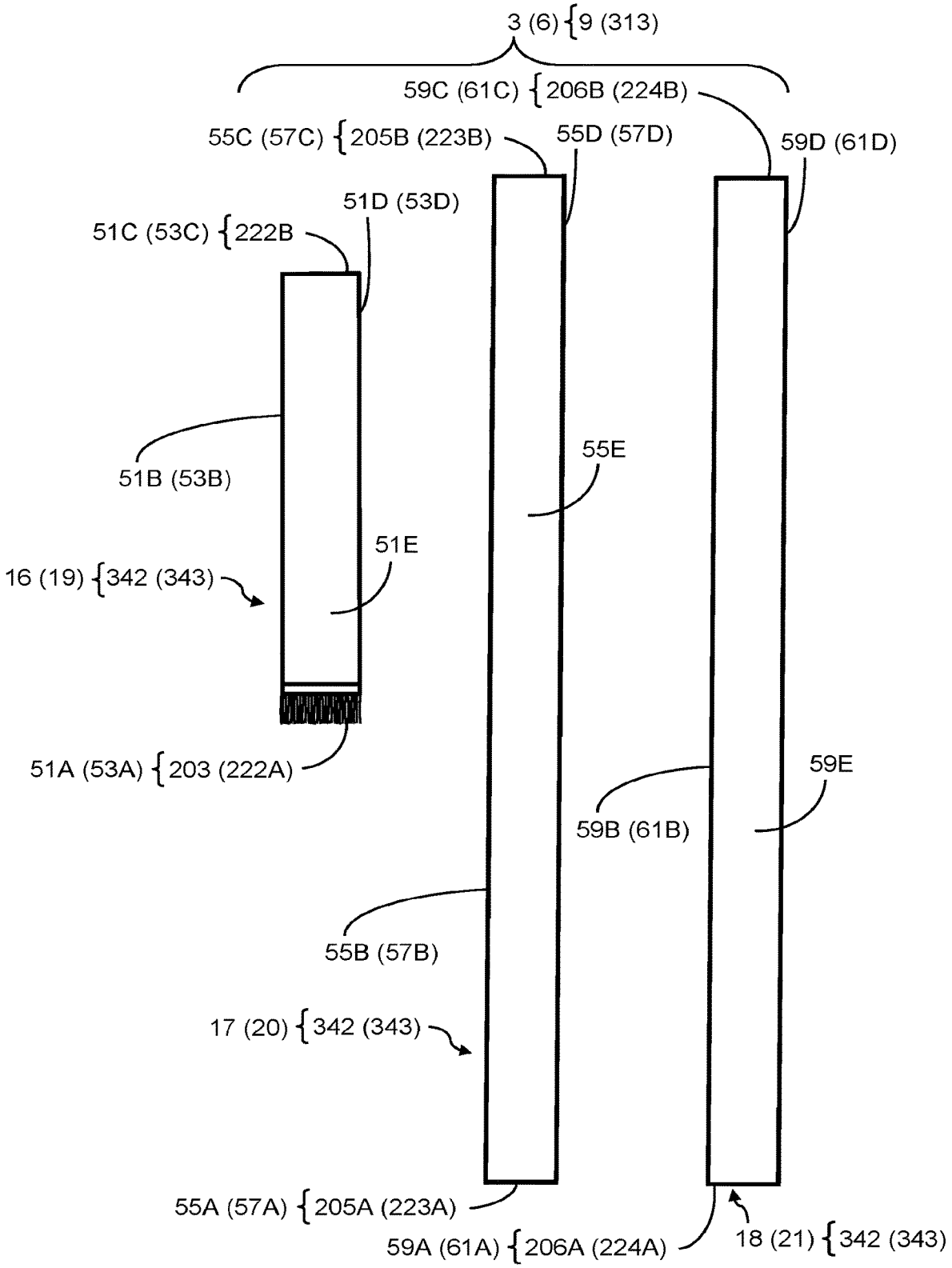
FIG. 13A is a front perspective view of the components used in the third wearable item, illustrating some of the features thereof and a second embodiment of a plurality of components used as at least two garment components.
Figure 13B:
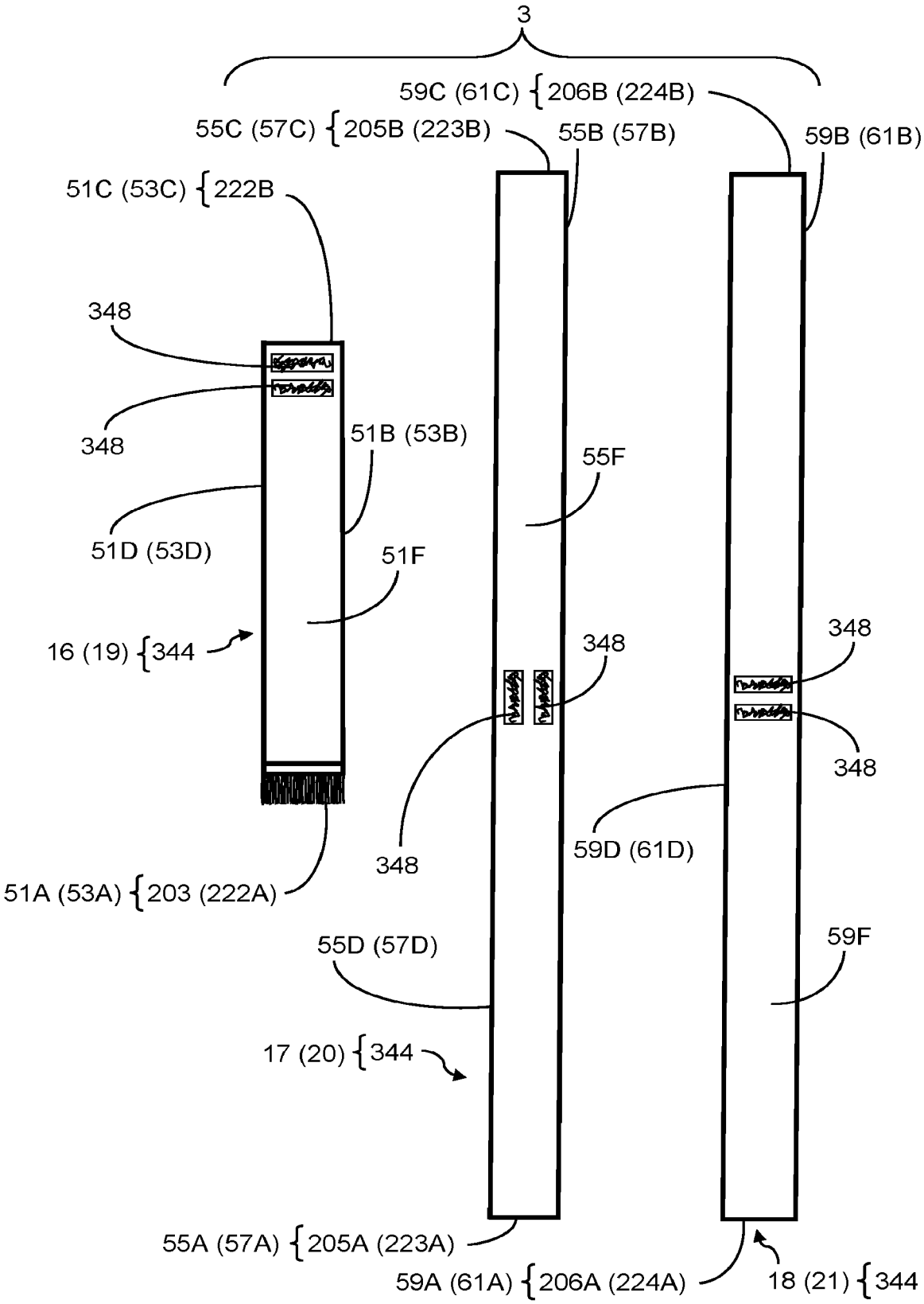
FIG. 13B is a back perspective view of the components illustrated in FIG. 13A, illustrating still some of the features thereof and some fastener devices.

In FIGS. 13A-13B, the described embodiments illustrate: a front perspective view in FIG. 13A and a back perspective view in FIG. 13B of components 16, 17 and 18 used for wearable item 3; component 16 having sides 51A, 51B, 51C and 51D, edges 53A, 53B, 53C and 53D, free end 203, and opposed ends 222A and 222B; component 17 having sides 55A, 55B, 55C and 55D, edges 57A, 57B, 57C and 57D, free ends 205A and 205B, and opposed ends 223A and 223B; and component 18 having sides 59A, 59B, 59C and 59D, edges 61A, 61B, 61C and 61D, free ends 206A and 206B, and opposed ends 224A and 224B.

In FIG. 13A, these embodiments also illustrate: component 16 having a front side 51E; component 17 having a front side 55E; and component 18 having a front side 59E. In FIG. 13B, the described embodiments further illustrate: component 16 having a back side 51F; component 17 having a back side 55F; and component 18 having a back side 59F.

In various embodiments of the present invention, an unlimited number of fastener devices 348 (e.g., adhesive fastener(s), button(s), buttonhole(s), brooch(es), buckle(s), clip(s), cord(s), cuff link(s), D-ring(s), eyelet(s), frog fastener(s), grommet(s), hook-and-eye fastener(s), hook-and-loop fastener(s), magnetic fastener(s), metal fastener(s), pin(s), plastic fastener(s), ring(s), rope(s), safety pin(s), slide fastener(s), snap fastener(s), string(s), stud fastener(s), toggle fastener(s), Velcro fastener(s), wooden fastener(s), zip fastener(s), permanent fastener device(s), detachable fastener device(s), or other fastener elements or fastener devices) can be used for (but not limited to) any respective embodiment, and can be used in other ways. Additionally, by way of example, in the described embodiments: wearable item 3 and components 16, 17 and 18 are used to illustrate one embodiment of a number of fastener devices 348; VELCRO® strips are used as these embodiments of the fastener devices 348, as shown in FIG. 13B; the VELCRO® strips used for components 16 and 17 have been attached together to create the configuration shown in FIGS. 4A-4B; and the VELCRO® strips used for components 17 and 18 have been attached together to create the configuration seen in FIGS. 5A-5B.

Figure 14A:
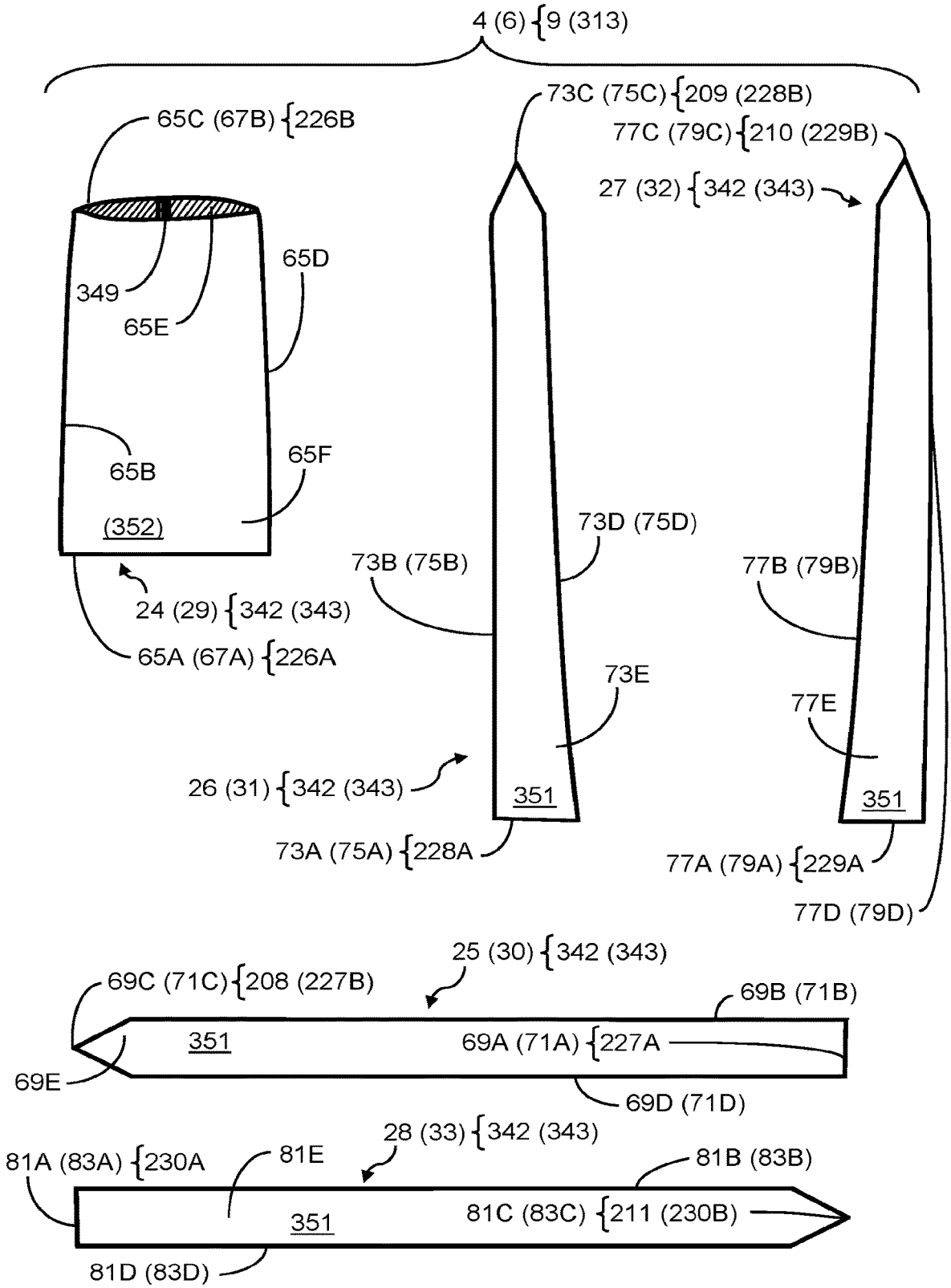
FIGS. 14A-14B are a front (A) and back (B) perspective view of the components used in the fourth wearable item, illustrating some of the features thereof and a third embodiment of a plurality of components used as at least two garment components.
Figure 14B:
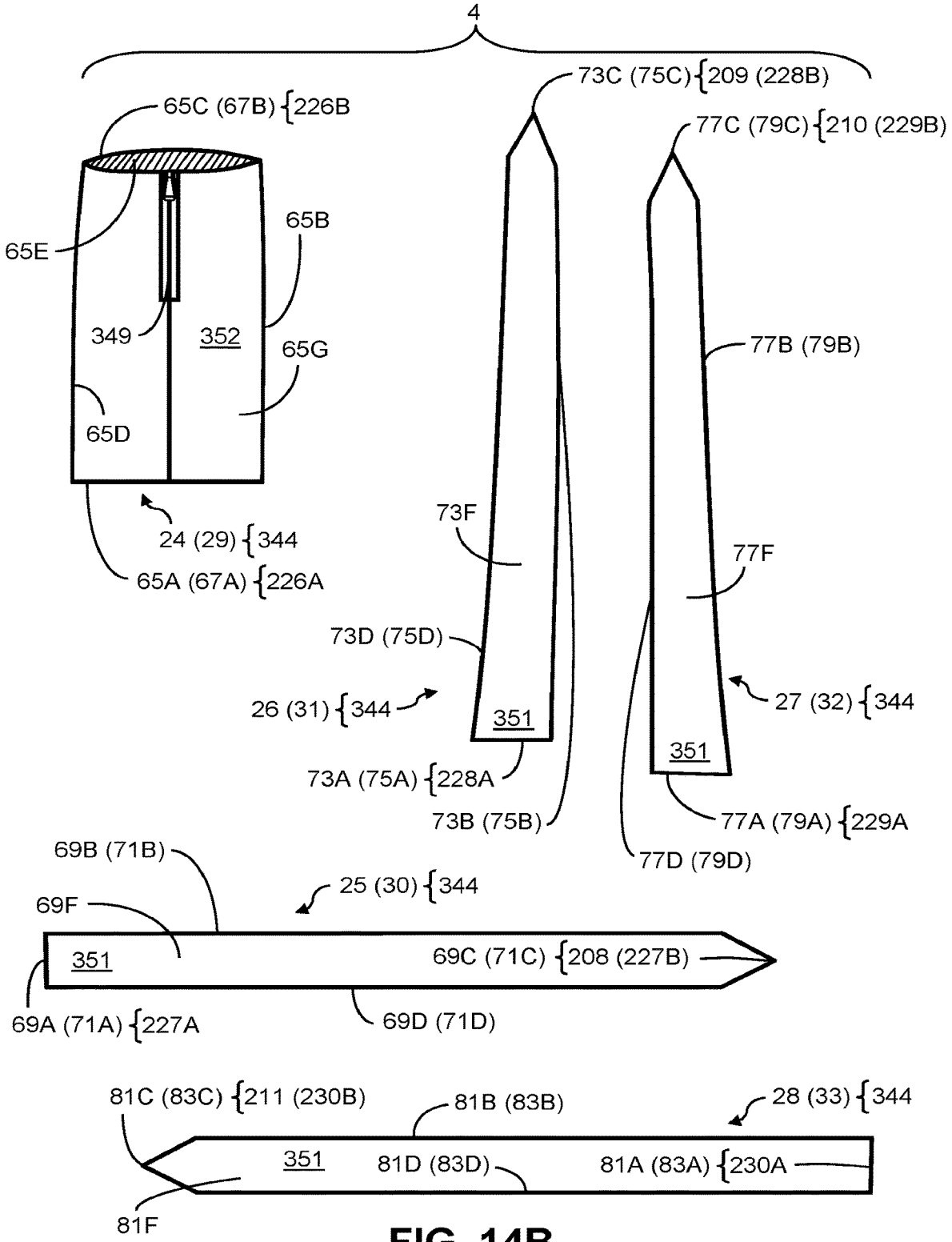

In FIGS. 14A-14B, the described embodiments illustrate: a front perspective view in FIG. 14A and a back perspective view in FIG. 14B of components 24, 25, 26, 27 and 28 used for wearable item 4; component 24 having sides 65A, 65B, 65C, 65D and 65E, edges 67A and 67B, and opposed ends 226A and 226B; component 25 having sides 69A, 69B, 69C and 69D, edges 71A, 71B, 71C and 71D, free end 208, and opposed ends 227A and 227B; component 26 having sides 73A, 73B, 73C and 73D, edges 75A, 75B, 75C and 75D, free end 209, and opposed ends 228A and 228B; component 27 having sides 77A, 77B, 77C and 77D, edges 79A, 79B, 79C and 79D, free end 210, and opposed ends 229A and 229B; and component 28 having sides 81A, 81B, 81C and 81D, edges 83A, 83B, 83C and 83D, free end 211, and opposed ends 230A and 230B.

In FIG. 14A, these embodiments also illustrate: component 24 having a front side 65F; component 25 having a front side 69E; component 26 having a front side 73E; component 27 having a front side 77E; and component 28 having a front side 81E. In FIG. 14B, the described embodiments further illustrate: component 24 having a back side 65G; component 25 having a back side 69F; component 26 having a back side 73F; component 27 having a back side 77F; and component 28 having a back side 81F.

Figure 15A:
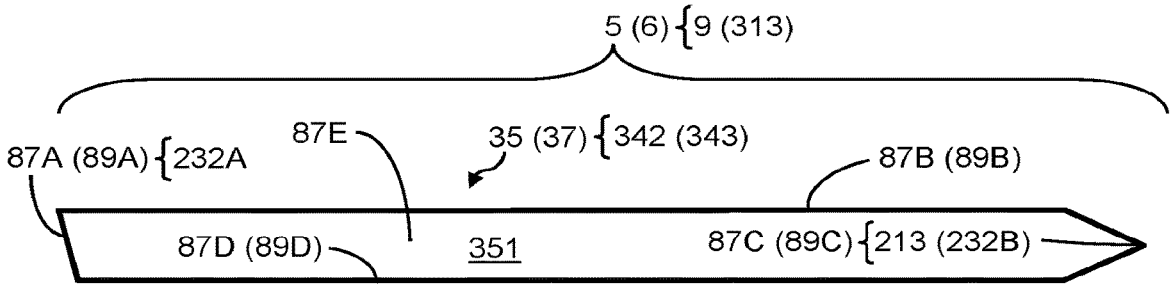
FIGS. 15A-15B are a front (A) and back (B) perspective view of one of the garment components used in the fifth wearable item, illustrating some of the features thereof and another embodiment.
Figure 15B:
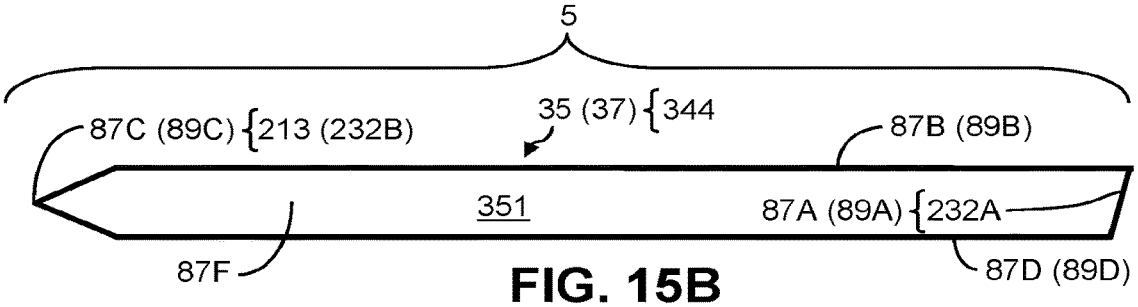

In FIGS. 15A-15B, the described embodiments illustrate: a front perspective view in FIG. 15A and a back perspective view in FIG. 15B of component 35 used for wearable item 5; and component 35 having sides 87A, 87B, 87C and 87D, edges 89A, 89B, 89C and 89D, free end 213, and opposed ends 232A and 232B. Although not illustrated, the described embodiment of wearable item 5 also has components 24, 25, 26 and 27 and the characteristics thereof.

In FIG. 15A, these embodiments also illustrate component 35 having a front side 87E. In FIG. 15B, the described embodiments further illustrate component 35 having a back side 87F.

In various embodiments of the present invention, an unlimited number of closure devices 349 (e.g., button closure(s), clasp closure(s), clip closure(s), frog-and-toggle closure(s), hook closure(s), hook-and-eye closure(s), permanent closure(s), detachable closure(s), hook-and-bar closure(s), latch closure(s), magnetic closure(s), metal closure(s), plastic closure(s), snap closure(s), tie closure(s), Velcro closure(s), zipper closure(s), or other closure elements or closure devices) can be used for (but not limited to) any respective embodiment, and can be used in other ways. Additionally, by way of example, in the described embodiments: component 24 is used in wearable items 4 and 5 to illustrate one embodiment of a number of closure devices 349 (see FIG. 6B, FIG. 10 and FIGS. 14A-14B for wearable item 4, and see FIG. 11 for wearable item 5) in this example; and a zipper is shown being used as this embodiment of a closure device 349.

Some embodiments of the present invention have an upper body portion 351 (i.e., the "upper body portion" refers to any part of a wearable item or of any other embodiment that generally covers (or that is at least suitable for covering), but not being limited to, any part of the body joined to or at least located at or above the torso (e.g., a torso, a chest, a back, a waist, a neck, a head, a shoulder, an arm, a hand and so forth)). By way of example, in the described embodiments, components 25, 26, and 27 in wearable item 4 (as shown in FIGS. 14A-14B) and which is also the same for this embodiment of wearable item 5 (not illustrated), component 28 in wearable item 4 (as also seen in FIGS. 14A-14B), and component 35 in wearable item 5 (as shown in FIGS. 15A-15B) are used to show some embodiments of an upper body portion 351.

Figure 16A:
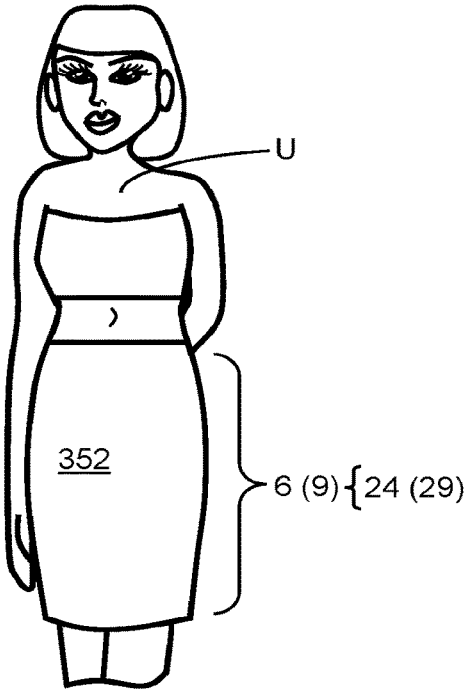
FIGS. 16A-16B are a front (A) and back (B) perspective view of one embodiment of a garment body and of one embodiment of a garment component that at least encircles a part of a user.
Figure 16B:
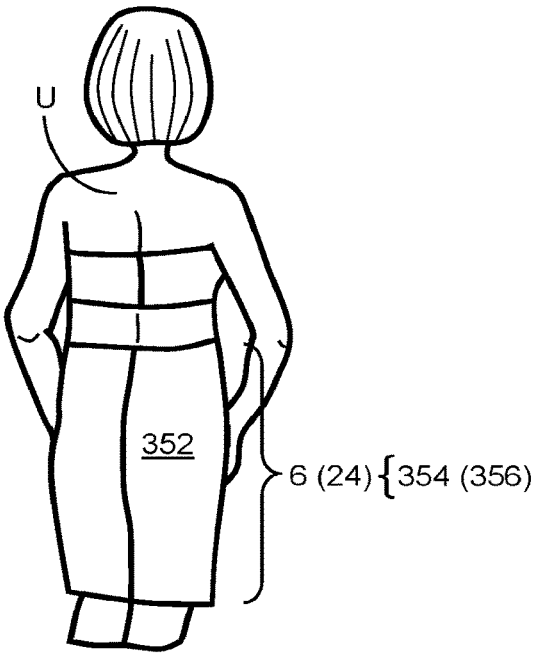

Some embodiments of the present invention have a lower body portion 352 (i.e., the "lower body portion" refers to any part of a wearable item or of any other embodiment that generally covers (or that is at least suitable for covering), but not being limited to, any part of the body joined to or at least located below the torso (e.g., a groin, a hip, a leg, a foot, and so forth)). By way of example, in the described embodiments, component 24 in wearable item 4 (see FIGS. 14A-14B), in wearable item 5 (see FIG. 7), and in FIGS. 16A-16B is used to show some embodiments of a lower body portion 352. It will be understood that other embodiments of the invention could have both an upper body portion 351 and a lower body portion 352 or any other variation thereof, one without the other, or other components 6 that may not necessarily be any upper body portion 351 or lower body portion 352, and such component(s) could be used in other ways.

Figure 11:
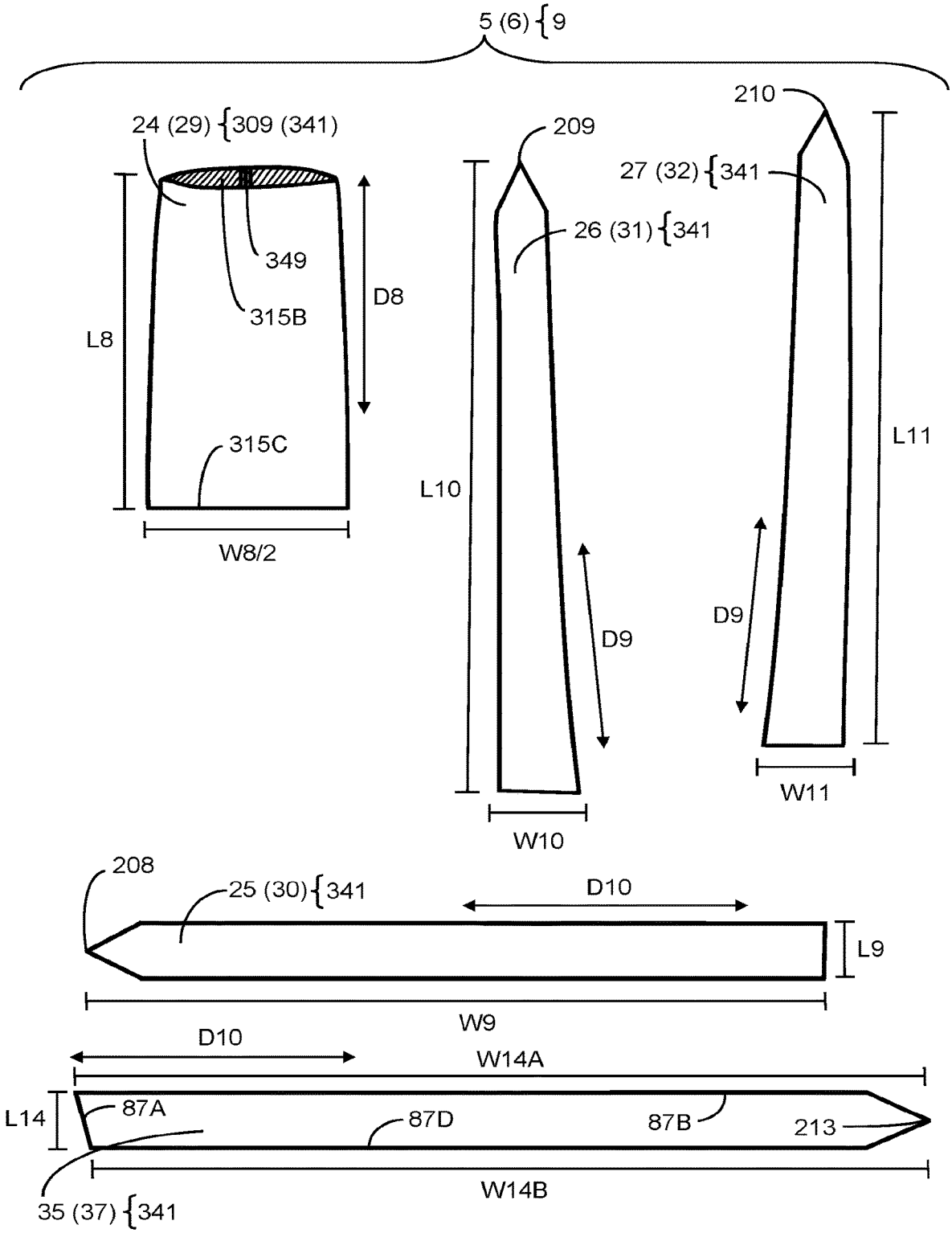
FIG. 11 is a front perspective view of the fifth wearable item, illustrating some of the components thereof, a fourth embodiment of at least one dimension, and another embodiment.

Exemplary configurations showing exemplary embodiments of at least two of a plurality of components 6 used as at least a plurality of garment components 9 and of at least two of a plurality of components 6 at least positioned in different directions from each other will now be discussed and described. In the described embodiments, a "direction" or 'D+a number' is provided and is used by way of example, for identification purposes only and for identifying like embodiments illustrated in the presently described illustrations. Furthermore, in the described embodiments (which all also illustrate exemplary directions): component 10 is shown positioned in a first at least one direction D1 (e.g., being an upward direction) and component 11 in shown positioned in a second at least one direction D2 (e.g., being a diagonally downward direction) different from the at least one direction of component 10 in FIGS. 1A and 1*n* FIG. 2; component 16 is shown positioned in direction D3 (e.g., being a vertical direction) and with component 17 shown positioned in direction D4 (e.g., being a horizontal direction) in FIGS. 4A-4B, and component 17 is shown positioned in direction D5 (e.g., being another upward direction) with component 18 shown positioned in direction D6 (e.g., being another diagonally downward direction) in FIG. 5A; component 24 is shown positioned in direction D8 (e.g., being still another vertical direction), components 26 and 27 are shown positioned in direction D9 (e.g., being a vertical direction), and components 25 and 28 are shown positioned in direction D10 (e.g., being another horizontal direction) in FIG. 10; and component 24 and direction D8 thereof, components 26 and 27 and direction D9 thereof, component 25 and direction D10 thereof, and component 35 (e.g., shown positioned in direction D10) are shown in FIG. 11.

It will be appreciated that various embodiments of the wearable item and of any other embodiment can be, but not limited to, tapered in an unlimited number of directions (e.g., at least upwardly, at least downwardly, at least horizontally, at least vertically, at least diagonally, in any variation thereof, and in other directions). By way of example, in the exemplary directions used in the described embodiments: wearable item 1 (see FIG. 1A) and wearable item 2 (see FIG. 2) are shown having component 10 tapering in a diagonally upward direction being similar to direction D1 and having component 11 tapering in a diagonally downward direction being similar to direction D2; wearable item 3 is shown having component 16 tapering in a vertically downward direction and being partially similar to direction D3, and having component 17 tapering in a horizontal direction being similar to direction D4, and with the ends 205A and 205B positioned in opposite directions from each other in FIGS. 4A-4B, but with component 17 tapering in another diagonally upward direction being similar to direction D5 and component 18 tapering in another diagonally downward direction being similar to direction D6 in FIG. 5A; wearable item 4 (see FIG. 10) is illustrated having the free end 208 of component 25 tapering in a horizontally leftward direction and being partially similar to direction D10, the free end 209 of component 26 tapering in a vertically leftward direction and being partially similar to direction D9, the free end 210 of component 27 tapering in a vertically rightward direction and being partially similar to direction D9, and the free end 211 of component 28 tapering in a horizontally rightward direction and being partially similar to direction D10; and wearable item 5 (see FIG. 11) is shown having the previously mentioned components 24, 25, 26 and 27 and characteristics thereof described for wearable item 4, except for component 28, and with the free end 213 of component 35 tapering in a horizontally rightward direction and being partially similar to direction D10.

In various embodiments of the present invention, an unlimited number of directions (e.g., vertical, diagonal, slanted, horizontal, upwards, downwards, sideways, outwards, inwards, up, down, left, right, any other variation thereof, and other directions) can be used in (but not limited to) any respective embodiment, and can be used in other ways.

FIGS. 16A-16B illustrate the described embodiments showing details in relation to one embodiment of a component 6 that is at least one garment body 354 (as also seen in FIGS. 6A-6B, in FIG. 7 and in other previously mentioned FIGS. herein), and to one embodiment of a component 6 that at least encircles 356 a part of a user U. In the described embodiments: a front perspective view is illustrated in FIG. 16A and a back perspective view is illustrated in FIG. 16B; component 24 is used to show these embodiments of at least one garment body 354 and of the component 6 that at least encircles 356 a part of the user U; a wearer is shown being the user U; and components 26 and 27 are shown not attached to component 24. It will be understood that other embodiments of at least one garment body 354 is not limited to being a component 6 that at least encircles 356 a part of a user U. Likewise, other embodiments of a component 6 that at least encircles 356 a part of the user U is not limited to being a garment body 354. In addition, such components may also be (but not limited to) used as or at least be a garment component 9 in some embodiments of the invention. By way of example, garment component 29 is used in the described embodiment. Although not applicable to every embodiment of the invention, at least one garment body 354, a component 6 that at least encircles 356 a part of the user U, and the desired any other embodiment generally can be a loose fit, form-fitting, a combination thereof, or any other desired fit and size, as well as used in other ways.

Figure 17:
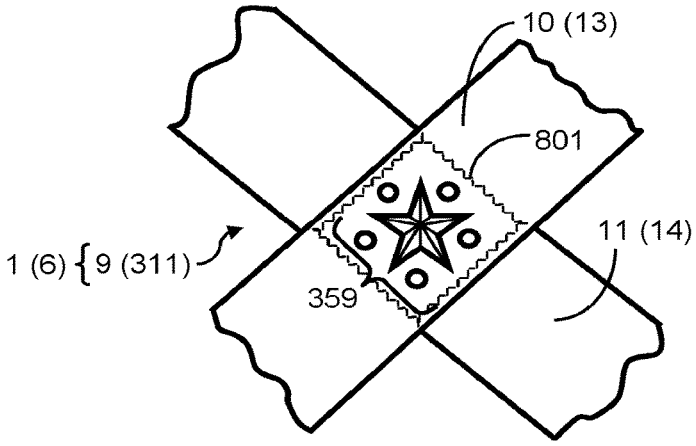
FIG. 17 is a more detailed view of a variation of the garment components and of the wearable item illustrated in FIG. 1A with a decorative item.

FIG. 17 illustrates a more detailed view of an exemplary variation of the illustrated front perspective view of wearable item 1 seen in FIG. 1A, with the described embodiments showing a partial view of components 10 and 11 at least attached 311 together with stitches at location 801. In the described embodiments, one embodiment of a decorative element 359 is also illustrated (being a 3-D star surrounded by some decorative circles in this example).

In various embodiments of the present invention, an unlimited number of decorative elements 359 (e.g., sequin(s), sticker(s), jewel(s), rhinestone(s), bead(s), printed design(s), painted design(s), some lace, some embroidery, piping(s), embellishment(s), tie-die decoration(s), plastic decoration(s), metal decoration(s), glass decoration(s), clothing embellishment(s), technological element(s), some glitter, or other decorative elements) can be used for (but not limited to) any respective embodiment, and can be used in other ways.

Figure 18A:
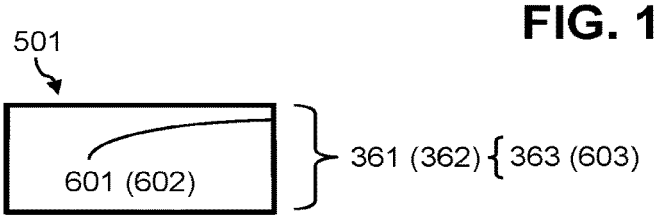
FIGS. 18A-18F are a front perspective view of more exemplary embodiments of garment components and of some other variations of some embodiments of the invention.
Figure 18B:
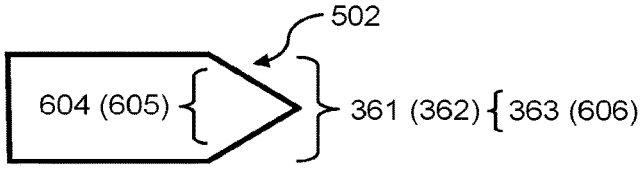
Figure 18C:
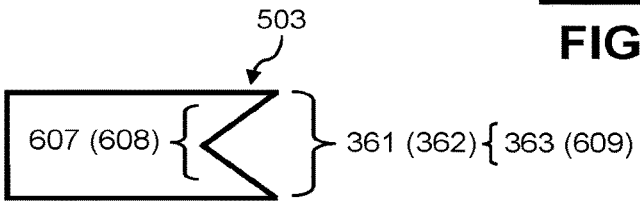
Figure 18D:
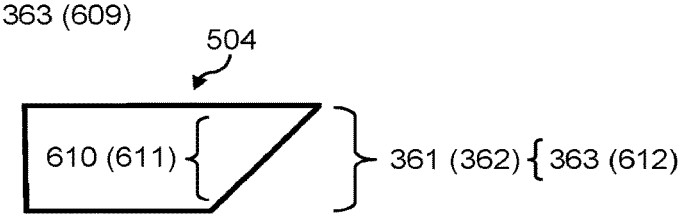
Figure 18E:
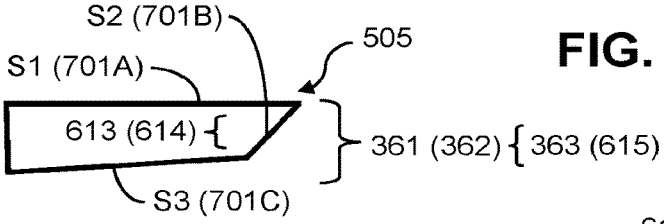
Figure 18F:
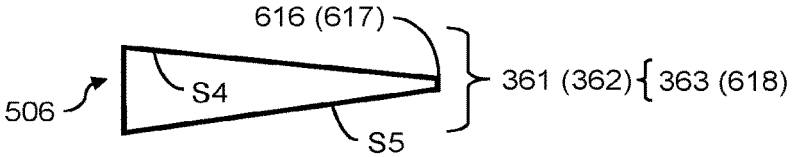

Now turning to FIGS. 18A-18F, which illustrate some exemplary embodiments of components 501, 502, 503, 504, 505 and 506, and which are also being used to illustrate some embodiments and some exemplary details, illustrations and descriptions of each of the following: at least one style design 361; at least one side having a style (which is referred to as 'styled side(s)' 362 in this discussion); and at least one free end having a style (which is referred to as 'styled free end(s)' 363 in this discussion). By way of example, in the described embodiments: FIG. 18A illustrates component 501 having at least one styled free end 601 and at least one styled side 602, and with the style design 603 having a number of right-angled (i.e., 90 degree angle) corners; FIG. 18B illustrates component 502 having at least one styled free end 604 and at least one styled side 605, and with the style design 606 being in a wedge-shaped form; FIG. 18C illustrates component 503 having at least one styled free end 607 and at least one styled side 608, and with the style design 609 being in a 'V' shape; FIG. 18D illustrates component 504 having at least one styled free end 610 and at least one styled side 611, and with the style design 612 having a number of angled-corners being any angle except a 90 degree angle, and with a first angle being less than 90 degrees and a second angle being greater than 90 degrees in this example; FIG. 18E illustrates component 505 having at least one styled free end 613 and at least one styled side 614, and with the style design 615 having a number of sides (being sides S1, S2 and S3 in this example) that are different from each other and a number of dimensions (being dimensions 701A, 702B and 703C in this example) that are different from each other; and FIG. 18F illustrates component 506 having at least one styled free end 616 and at least one styled side 617, and with the style design 618 having at least two sides (being sides S4 and S5 in this example) that become thinner (or narrower) towards a free end thereof. It will be understood that some embodiments of the invention have none of, at least one of or any combination of (but not limited to) (i) at least one style design 361, (ii) at least one styled side 362, (iii) at least one styled free end 363, or (iv) any other variation thereof, and an unlimited number thereof can be used for (but not limited to) any respective embodiment, as well as in other ways.

Figure 19:
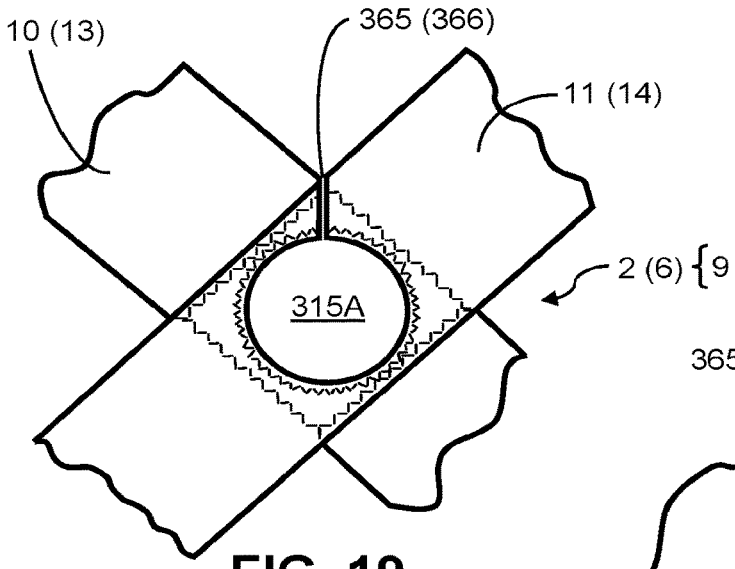
FIG. 19 is a back perspective view of a more detailed view of a variation of the garment components and of the wearable item illustrated in FIG. 2 and in FIG. 3 with a space used for an opening.

FIG. 19 is a back perspective view of an exemplary variation of the illustrated more detailed front perspective view of wearable item 2 shown in FIG. 3. In the described embodiments: wearable item 2 is used to show one embodiment of a space 365 at a location and one embodiment of an opening 366; and this embodiment of space 365 is used for aperture 315A and this embodiment of opening 366. One or multiple spaces 365 can be any size, used at any location, and used for (but not limited to) aesthetic purposes, a functional use and other uses.

Figure 20:
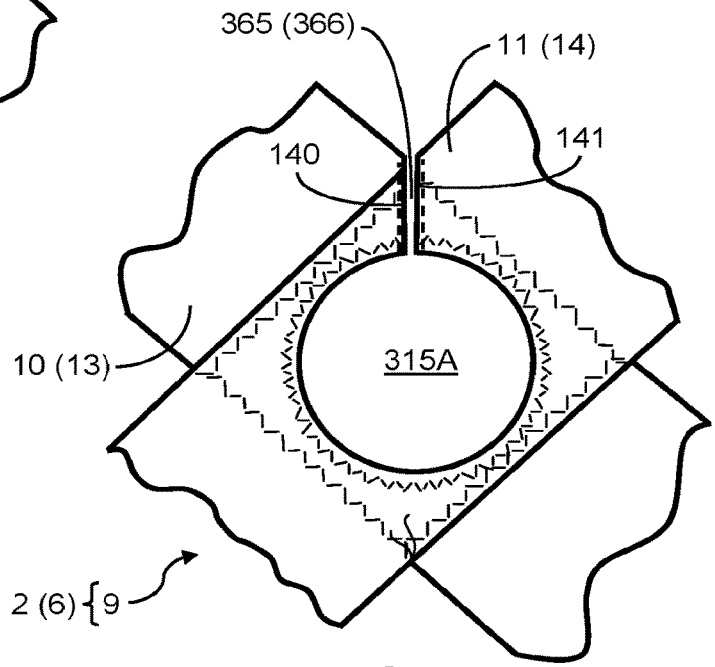
FIG. 20 is a variation of the more detailed back perspective view shown in FIG. 19, illustrating additional stitches used in the described embodiments.
Figure 21:
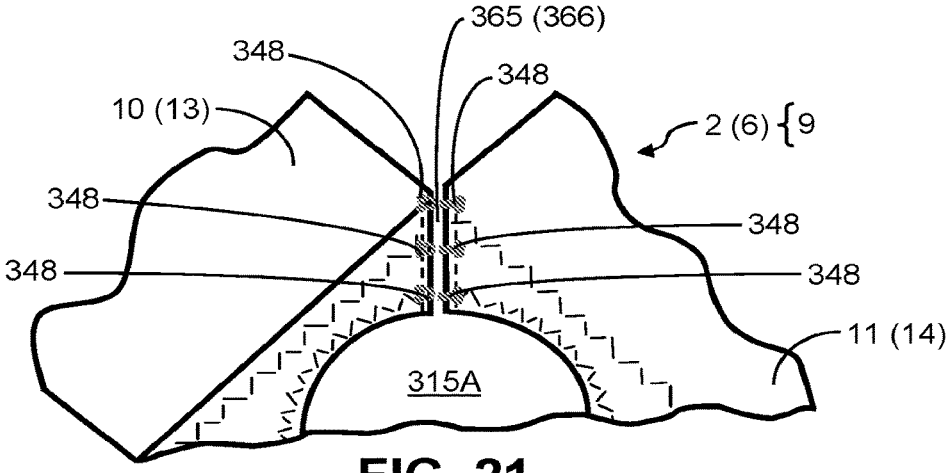
FIG. 21 illustrates another variation of the components and of the wearable item shown in FIG. 20 with some fastening devices attached thereto.

FIG. 20 is an exemplary variation of the illustrated more detailed back perspective view seen in FIG. 19, showing the described embodiments having other stitches used near other edges 140 and 141 located near the space 365 and opening 366. FIG. 21, which is also an exemplary variation of the illustrated embodiments seen in FIG. 20, shows another embodiment of fastening devices 348 (being a number of attached hook-and-eye components in this example).

Some embodiments of a variety of configurations 368 (all being an exemplary number of an exemplary variety of configurations 368, as used herein) created by the use of a number of methods 900 (all being an exemplary number of methods 900, as used herein) and in combination with at least one of any respective embodiment in at least a number of configurations (all being an exemplary number of exemplary configurations and of exemplary any respective embodiments, as used herein) will now be discussed in the following FIGS. 22A-22B to FIGS. 46A-46B (with the exception of FIG. 29 in this discussion). It will be understood that: numerous other configurations, as well as variations thereof, are also possible in other embodiments; some of the configurations shown in separate embodiments may be or may not be used interchangeably in other embodiments; and configurations that may or may not be illustrated in the exemplary embodiments herein can be used in other embodiments of the invention. Additionally, in the described embodiments: FIGS. 22A-22B to FIGS. 25A-25B illustrate wearable item 1 used in some of the described embodiments; FIG. 26 to FIGS. 28A-28B and FIGS. 30A-30B to FIGS. 32A-32B illustrate wearable item 2 used in some of the embodiments and while also comprising the described embodiments seen in FIG. 21, and with the hook-and-eye components attached together; FIGS. 32A-32B to FIGS. 36A-36B illustrate wearable item 3 used in some of the embodiments; multiple wearable items are used together in a configuration, with wearable items 2 and 3 used together in FIGS. 32A-32B; FIGS. 37A-37B to FIGS. 42A-42B illustrate wearable item 4 used in some of the embodiments; and FIGS. 43A-43B to FIGS. 46A-46B illustrate wearable item 5 used in still some of the embodiments. Additionally, in the described embodiments, the user U is a person in FIGS. 22A-22B to FIG. 27 and in FIGS. 30A-30B to FIGS. 46A-46B and the user U is an object (e.g., being a mannequin in this example) in FIGS. 28A-28B. With the exception of FIG. 29 and FIG. 34 to FIG. 35, FIGS. 22A-22B to FIGS. 46A-46B and the described embodiments have also been used to illustrate some embodiments of a number of configurations having at least two of a number of components 6 being used as at least a number of garment components 9 and at least attached 311 together.

In various embodiments of the present invention, one or multiple actions (e.g., accessorizing, adjusting, attaching, changing, criss-crossing, detaching, doing the desired number of actions, fastening, holding, grabbing, manipulating, pulling, putting on, releasing, removing, repositioning, securing, styling, taking off, tucking in, twisting, tying, undoing an action, wearing, wrapping, any variation thereof or any other desired action) are used in the number of methods 900. By way of example, in some embodiments, some of the more specific other actions that generally are used in the number of methods 900 also are, but not limited to, any of or any combination of the following: (i) an action of having at least any respective embodiment put on someone or something; (ii) an action of having at least any respective embodiment taken off someone or something; (iii) an action of making the desired change; (iv) an action of having at least any respective embodiment pulled; (v) an action of having at least any respective embodiment grabbed by someone or something; (vi) an action of having at least any respective embodiment held by someone or something; (vii) an action of redoing a number of actions; (viii) an action of doing any desired number of actions in the desired manner; (ix) an action of undoing a number of actions; (x) an action of having at least any respective embodiment manipulated; (xi) an action of having at least any respective embodiment repositioned; (xii) an action of having at least any respective embodiment adjusted; or (xiii) the desired any other action.

Figure 22A:
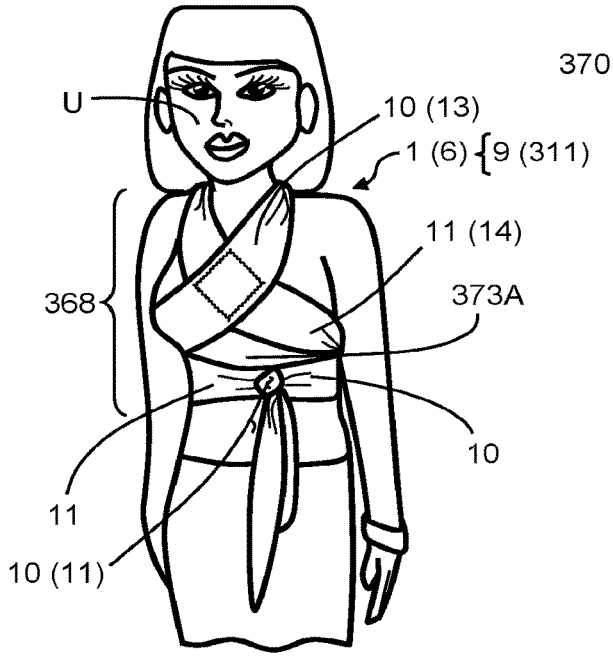
FIGS. 22A-22B are a front (A) and back (B) perspective view of the first wearable item worn in a first embodiment of a configuration and of some other embodiments.
Figure 22B:
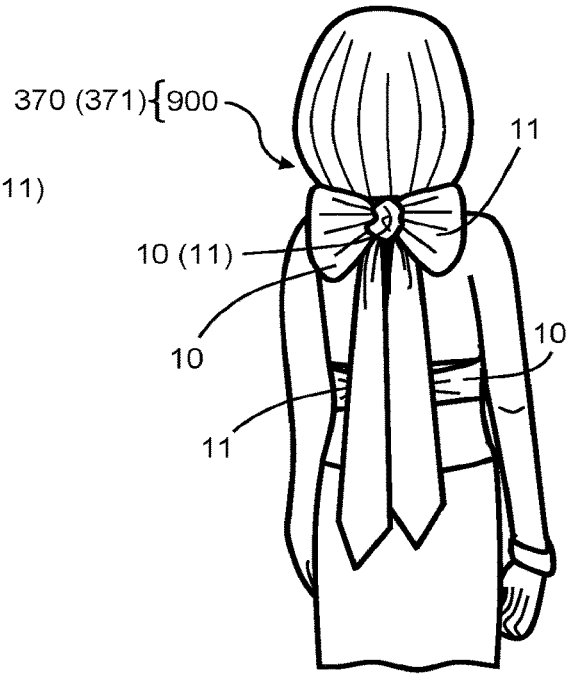

FIGS. 22A-22B are a front (A) and back (B) perspective view illustrating the following described embodiments: wearable item 1 worn in a first embodiment of a configuration; one embodiment of a wearable item worn 370 in one embodiment of a configuration; one embodiment of a wearable item used as a garment 371 (with wearable item 1 being used as a top in this example); and a first embodiment of a cut-out style configuration 373A. Other embodiments of the invention could be used as, but not limited to, other tops, any desired type and quantity of garments 371 (such as, but not limited to, a blouse, a shirt, a jump suit, a dress, a gown, and any other desired garment and in any desired garment style), or any other variation thereof. Additionally, the actions used in the described embodiment of method 900 for creating the illustrated configuration resulted in the described embodiments having: a part of components 10 and 11 wrapped around the user's neck and tied together in a large bow (as seen in FIG. 22B); another part of components 10 and 11 wrapped multiple times around the user's waist (as seen in FIGS. 22A-22B) and tied together in a knot (see FIG. 22A); and wearable item 1 appearing to have a part thereof cut-out on the front side of the user's body (as seen in FIG. 22A).

Figure 23A:
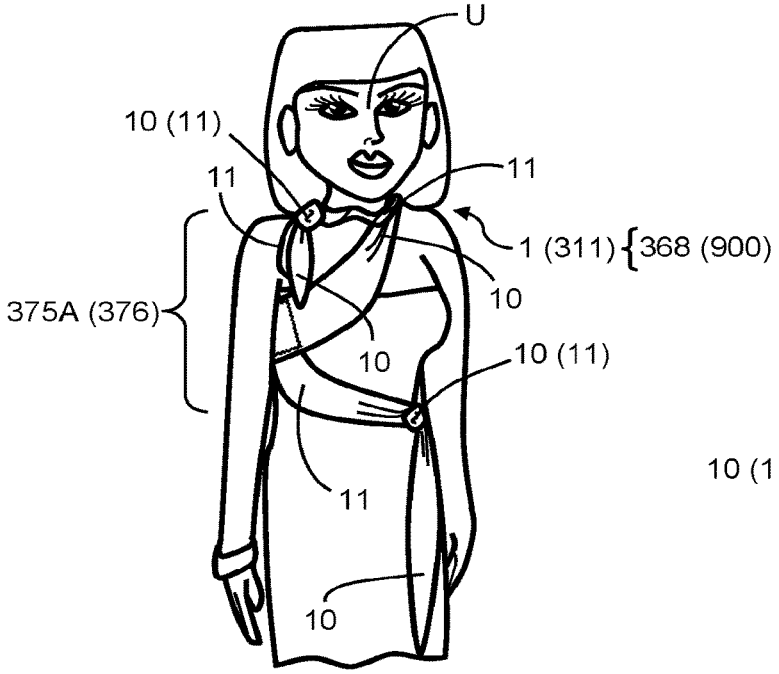
FIGS. 23A-23B are a front (A) and back (B) perspective view of the first wearable item worn in a second embodiment of a configuration and of some other embodiments.
Figure 23B:
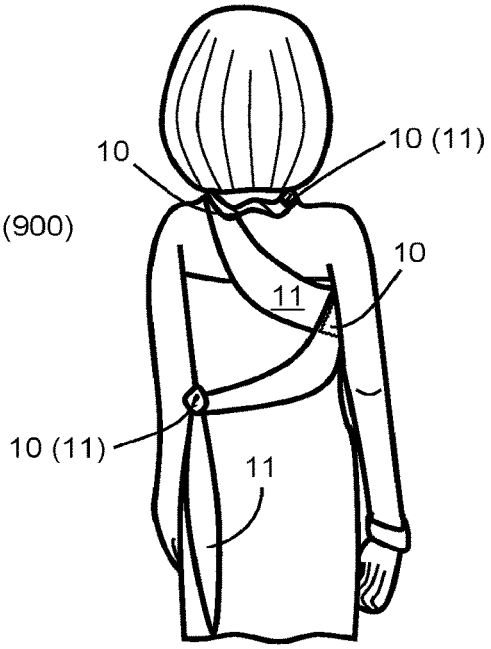

FIGS. 23A-23B are a front (A) and back (B) perspective view illustrating the following described embodiments: wearable item 1 worn in a second embodiment of a configuration; a first embodiment of a strap style configuration 375A; and one embodiment of a neckline style configuration 376. The actions used in the described embodiment of method 900 for creating the illustrated configuration also resulted in the described embodiments having: a part of wearable item 1 positioned to the user's side and below the user's armpit; a part of components 10 and 11 tied together at the user's opposite side; and another part of components 10 and 11 tied together near a side of the user's neck, 'twisted' to further modify the illustrated style, and tied together again in another knot on the user's opposite side of the neck.

Figure 24A:
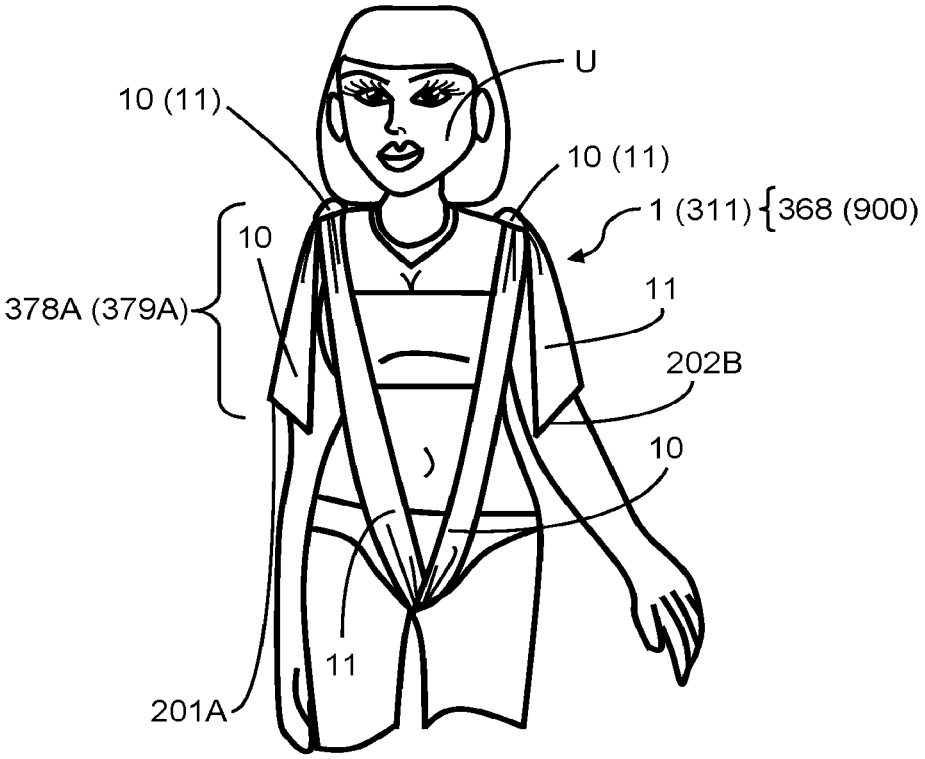
FIGS. 24A-24B are a front (A) and back (B) perspective view of the first wearable item worn in a third embodiment of a configuration and of some other embodiments.
Figure 24B:
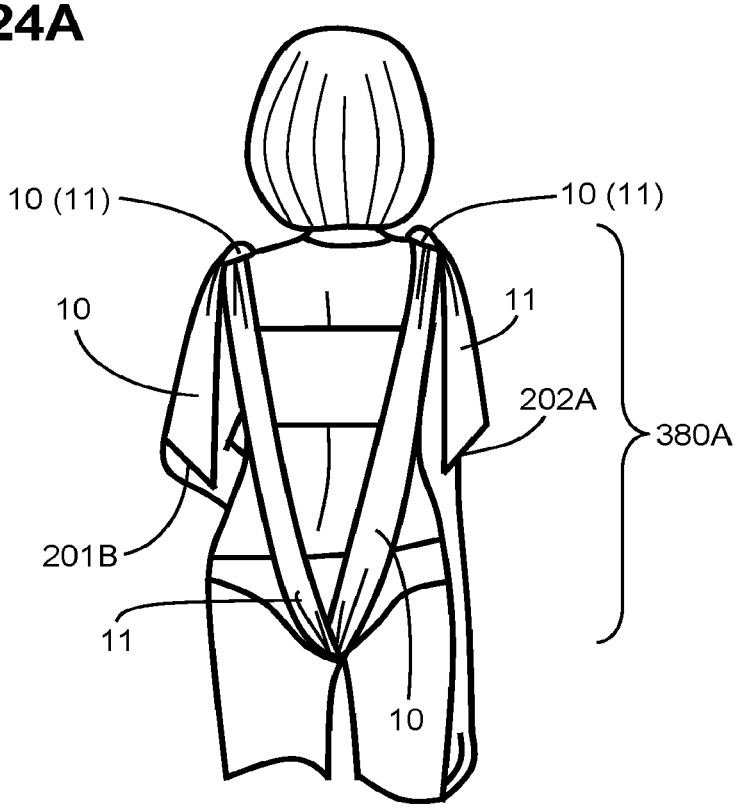

FIGS. 24A-24B are a front (A) and back (B) perspective view illustrating the following described embodiments: wearable item 1 worn in a third embodiment of a configuration; a first embodiment of a shoulder style configuration 378A; a first embodiment of a sleeve style configuration 379A; and a first embodiment of a number of items 380A (being a swimsuit and necklace in this example). The actions used in the described embodiment of method 900 for creating the illustrated configuration resulted in the described embodiments having: a part of wearable item 1 positioned between the user's legs; components 10 and 11 positioned in a manner that has made them appear to be a thinner width; components 10 and 11 also tied together over both of the user's shoulders to create the illustrated first embodiment of a shoulder style configuration 378A; and the free ends 201A and 201B of component 10 and the free ends 202A and 202B of component 11 hanging freely over the user's arm to create the appearance of this first embodiment of a sleeve style configuration 379A. In addition, in the described embodiments, wearable item 1 is shown being worn over the swimsuit and with the necklace to accessorize and further change the style of the garment in this example. As a reminder, it will be understood that other embodiments of the invention can be accessorized in other ways.

Figure 25A:
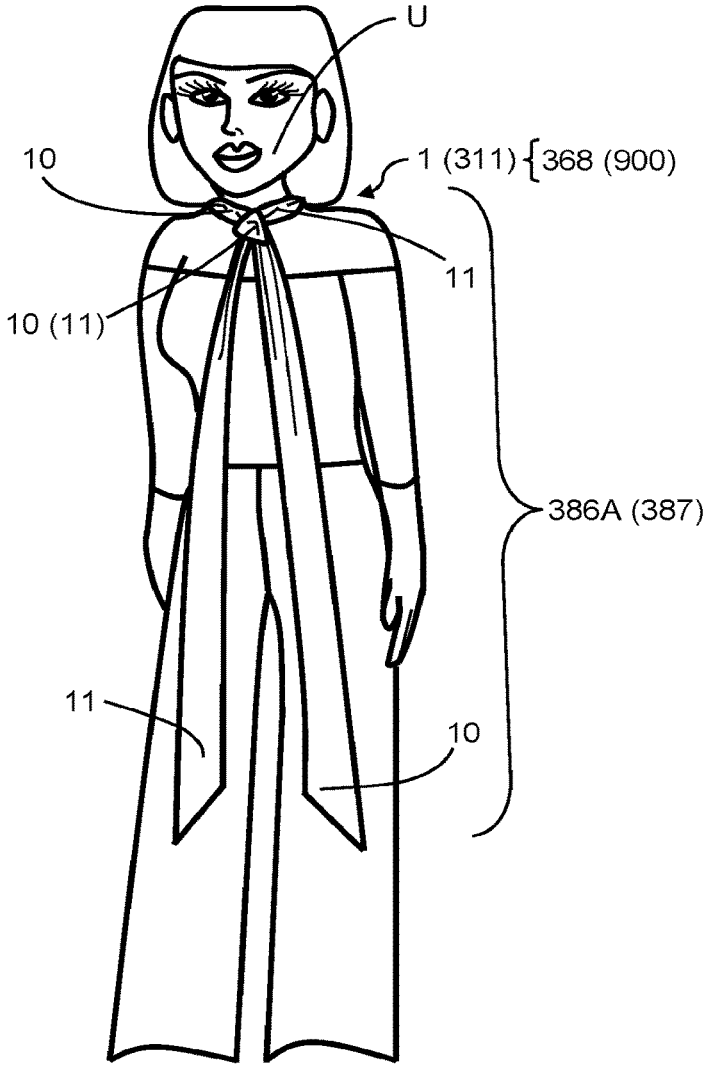
FIGS. 25A-25B are a front (A) and back (B) perspective view of the first wearable item worn in a fourth embodiment of a configuration and of some other embodiments.
Figure 25B:
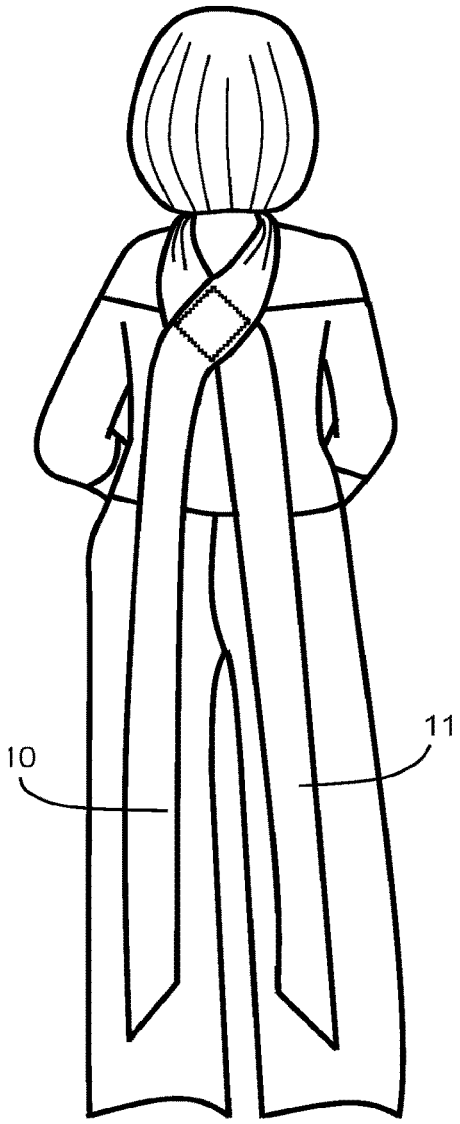

FIGS. 25A-25B are a front (A) and back (B) perspective view illustrating the following described embodiments: wearable item 1 worn in a fourth embodiment of a configuration; a first embodiment of a sleeveless style configuration 386A; and one embodiment of a wearable item used as, but not limited to, an accessory item 387. In the described embodiments: wearable item 1 is shown without any sleeve and is used to further accessorize the illustrated outfit being worn by the user U in this example; and this embodiment of the accessory item 387 is made from the use of wearable item 1 in the exemplary illustrated style used in the described FIGS. in this example. The actions used in the described embodiment of method 900 for creating the illustrated configuration resulted in the described embodiments having: a part of wearable item 1 positioned behind the user's body (as shown in FIG. 25B); components 10 and 11 tied together on the front side of the user's body (as shown in FIG. 25A); and a part of components 10 and 11 hanging freely without being tied to anything (see FIG. 25B). As a reminder, it will be understood that other embodiments of the invention can be used as (but not limited to) an unlimited number of other accessory items 387, which can also be used in other ways.

Figure 26:
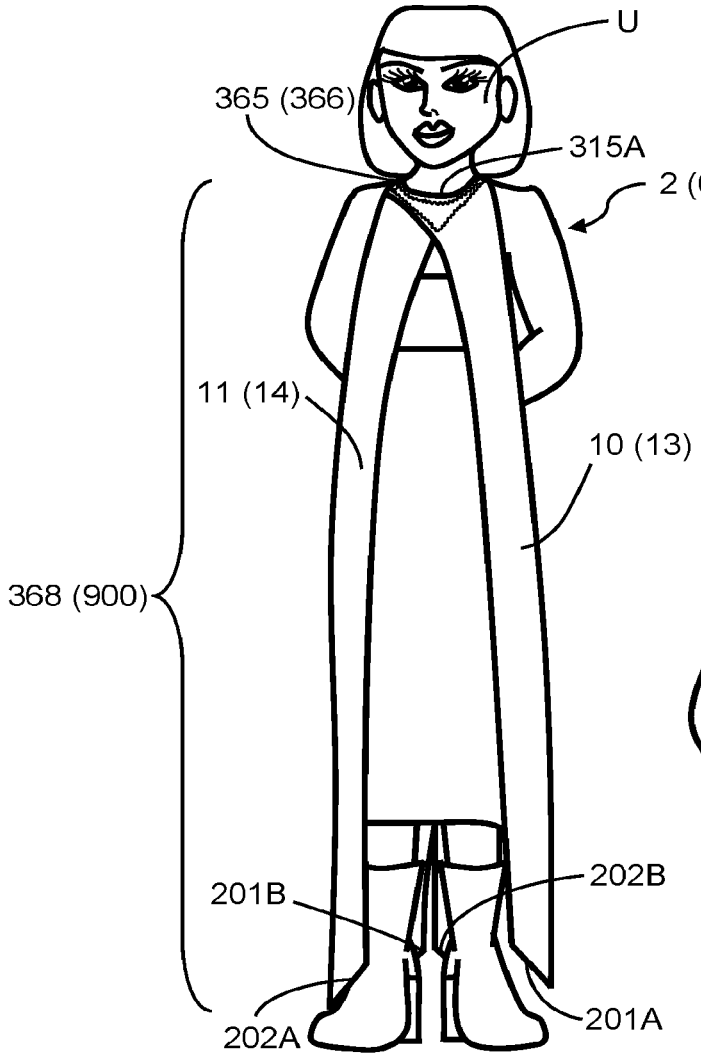
FIG. 26 is a front perspective view of the second wearable item worn in a first embodiment of a configuration and of some other embodiments.
Figure 27:
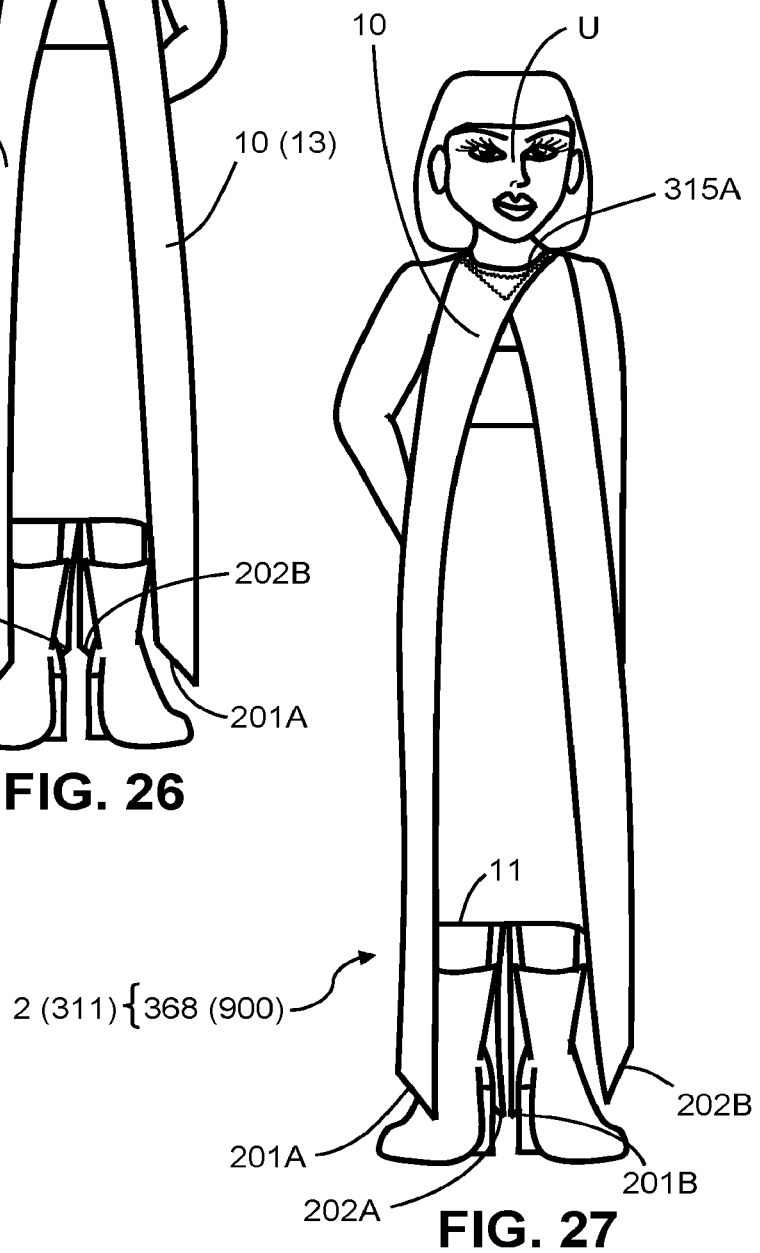
FIG. 27 is a front perspective view of the second wearable item worn in a second embodiment of a configuration and of some other embodiments.

FIG. 26 illustrates a front perspective view of the described embodiment of wearable item 2 worn in a first embodiment of a configuration. FIG. 27 illustrates a front perspective view of the described embodiment of wearable item 2 worn in a second embodiment of a configuration. FIG. 26 and FIG. 27 also illustrate the described embodiment of one embodiment of an aperture 315A being used for at least inserting a part of a body (being the user's head and neck in these examples). The design of the free ends 201A, 201B, 202A and 202B and the actions used in the described embodiment of method 900 for creating the illustrated configuration resulted in the described embodiments having: components 10 and 11 hanging freely; and wearable item 2 having the appearance of the style shown in FIG. 26 (created with free ends 201A and 202A positioned to the front of the user U in this example), but the appearance of another exemplary style in FIG. 27 (which illustrates wearable item 2 worn but rotated to a side and with free ends 201A and 202B positioned to the front of the user U in this example).

Various embodiments of the wearable item and of the desired any other embodiment can have a characteristic of, but not limited to, being able to be positioned to other sides, locations, and the like, and it will be understood that a number of those embodiments could also be manipulated and used in other ways while being at the respective other side(s), location(s), and so forth in other embodiments of the invention. By way of example, in the described embodiments, wearable item 2 and the embodiments seen in FIG. 21 of space 365 for opening 366 and fastener devices 348 (which are too small to be illustrated, but the general location thereof will be indicated in some of the FIGS. in this discussion of wearable item 2) will be shown at different locations in the following FIGS. to demonstrate how some embodiments of the invention may implement some aspects of this concept. Additionally, the actions used in the described embodiment of method 900 for creating the illustrated configurations in FIG. 26 and in FIG. 27 resulted in the described embodiments having: the space 365 for opening 366 and fastener devices 348 positioned to a side of the user's neck, as seen in FIG. 26; and the space 365 for opening 366 and fastener devices 348 positioned to the back side of the user's body (not illustrated) in FIG. 27.

Figure 28A:
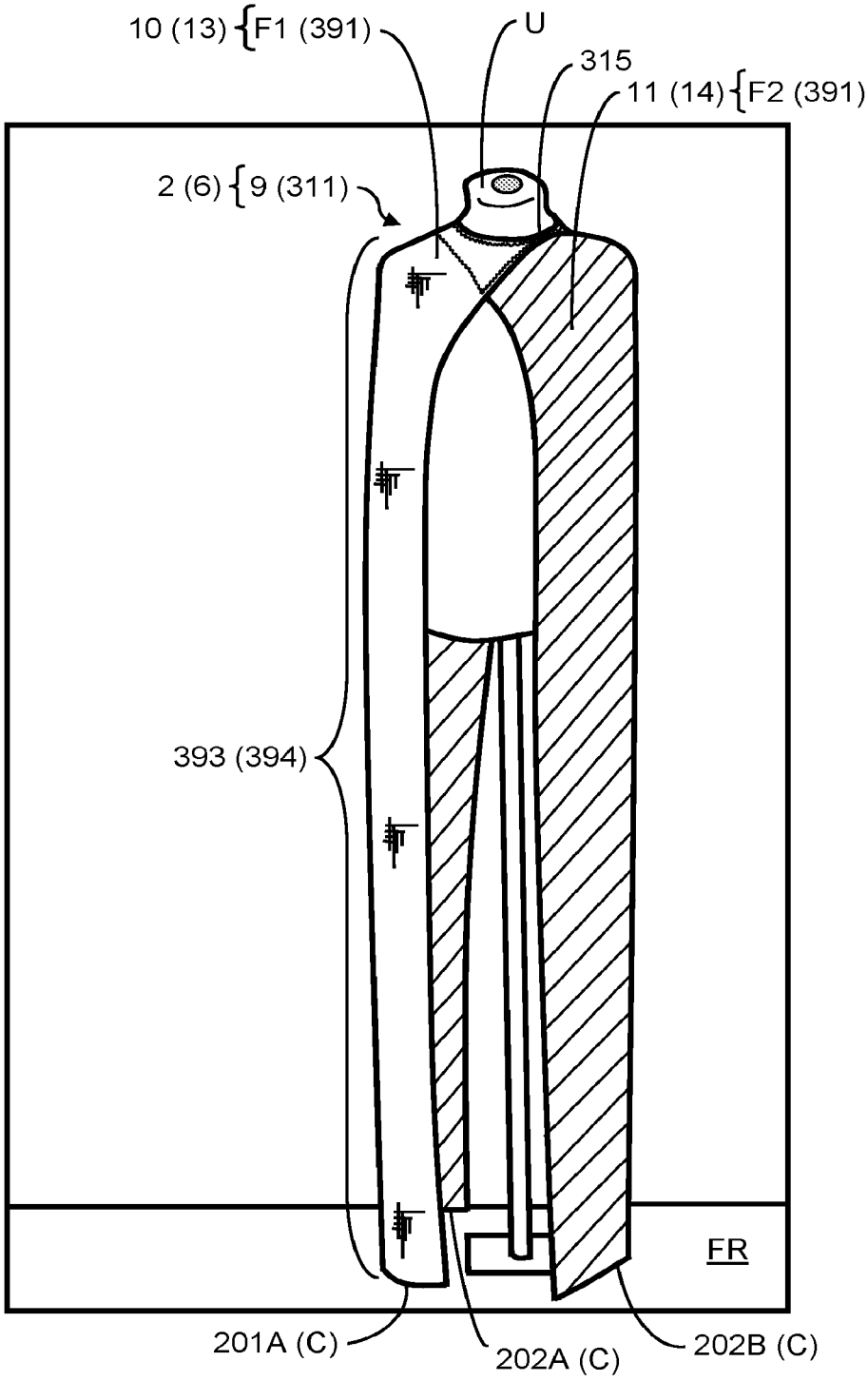
FIGS. 28A-28B are a front angled (A) and back angled (B) perspective view of the second wearable item, illustrating one embodiment of a wearable item used as a decorative item, and of some other embodiments.
Figure 28B:
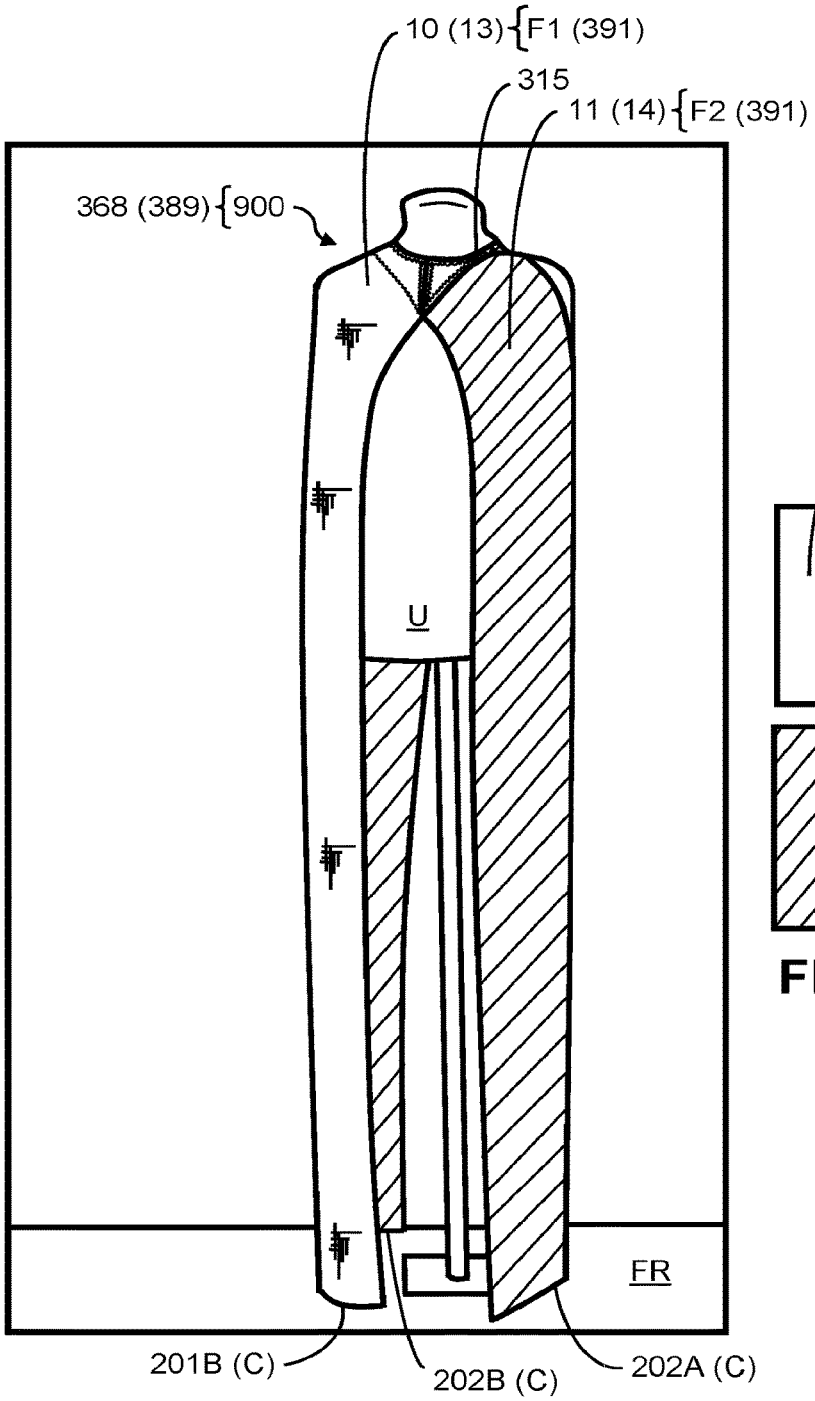
Figure 29:
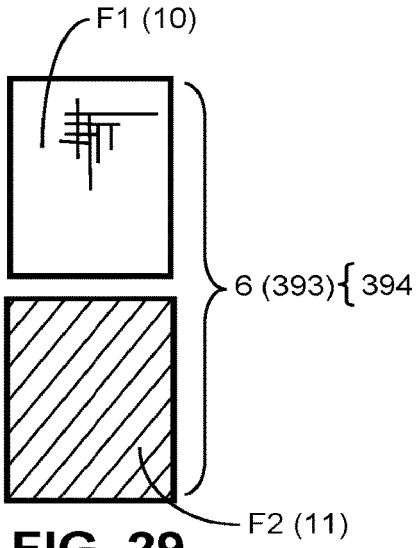
FIG. 29 illustrates front perspective views of one embodiment of at least one material and of some other embodiments.

FIGS. 28A-28B are a front angled perspective view in FIG. 28A and a back angled perspective view in FIG. 28B illustrating one embodiment of a wearable item (being wearable item 2 in this example) used as, but not limited to, a decorative item 389. In the described embodiments, wearable item 2 is shown being worn on the mannequin and for decorative purposes in this example. Various embodiments of the wearable item and of the desired any other embodiment can be used as, but not limited to, a decorative item 389 in a number of configurations. Additionally, various embodiments of the wearable item and of the desired any other embodiment could be used for any of or any combination of, but not limited to, the following: (i) being a decorative item 389 used to decorate, but not limited to, home interiors, furniture, displays, windows, showrooms, indoor areas, outdoor areas, and other items and places; (ii) being used as, but not limited to, an unlimited number of any desired decorative item 395 or any other variation thereof; or (iii) being used in other ways.

The described embodiments illustrated in FIGS. 28A-28B also illustrate: an exemplary embodiment of a floor FR; one embodiment of the present invention having a length that is floor-length 391, with components 10 and 11 used in the described embodiments and with a part thereof used for this embodiment of the exemplary embodiment of a floor length 391 in this example; free end 201A and free end 201B (hidden in this view behind component 11) of component 10 and free ends 202A and 202B of component 11 having contact C with the illustrated floor FR (in FIG. 28A); free end 201B and free end 201A (hidden in this view behind component 11) of component 10 and free ends 202A and 202B of component 11 having contact C with the floor FR (as seen in FIG. 28B); one embodiment of at least one material 393; one embodiment of at least one fabric 394; and one embodiment of at least one material 393 that is also at least one fabric 394. Additionally, in the described embodiments, the at least one material 393 and at least one fabric 394 are a first fabric F1 used for component 10 and a second fabric F2 used for component 11 (as seen in FIGS. 28A-28B and in FIG. 29), and they are both stretchable fabrics in this example.

Various embodiments of the wearable item and of the desired any other embodiment, which can be made with or without the use of any surface treatment, can be made from a vast variety of materials 393 (e.g., textiles, naturally-made materials, artificially-made materials, trims, paper, plastic, metals, stones, plants, fibers and other materials) and may be, but not limited to, natural, synthetic, semi-synthetic, reversible, non-reversible, transparent, not transparent, opaque, translucent, luminous, non-luminous, plain, decorated, sheer, designed having one or multiple things attached thereto, designed having nothing attached thereto, or may have other attributes, characteristics, properties, or variations thereof. One or multiple linings may be used in other embodiments. Furthermore, fabrics 394 such as, but not limited to, any or any combination of a knit fabric, a fabric with Lyrca content, a woven fabric, a plain fabric, a blended fabric, a reflective fabric, a quilted fabric, a flocked fabric, a flame resistant fabric, an absorbent fabric, a breathable fabric, a moisture wicking fabric, a heat reflecting fabric, an eco-friendly fabric, an antimicrobial fabric, an odor resistant fabric, a wrinkle-free fabric, a technological fabric, wool, cotton, silk, fur, leather, pleather, velvet, suede, chiffon, nylon, polyester, denim, spandex, crepe, rayon, viscose, satin, jute or other fabrics could be used in other embodiments. Moreover, a fabric 394 that can be draped easily and that is stretchable is generally recommended and used in various embodiments of the invention.

Figure 30A:
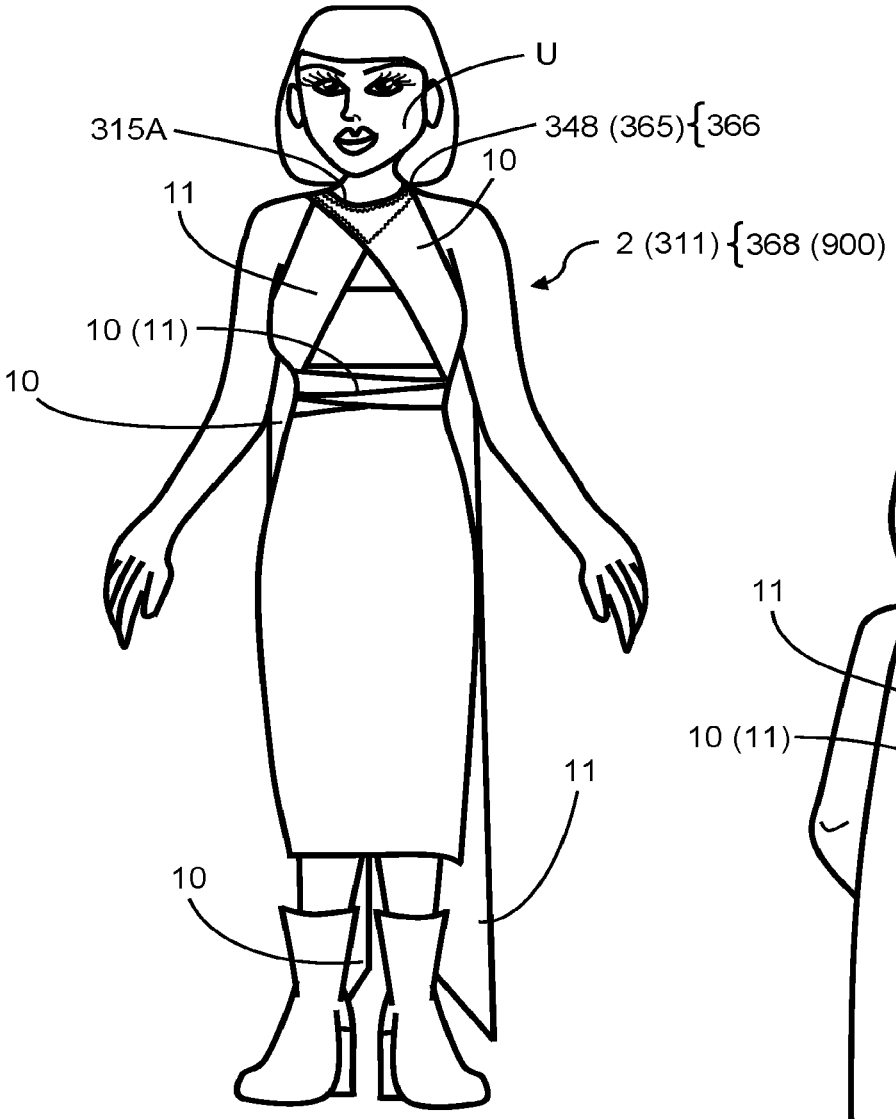
FIGS. 30A-30B are a front (A) and back (B) perspective view of the second wearable item worn in a third embodiment of a configuration and of some other embodiments.
Figure 30B:
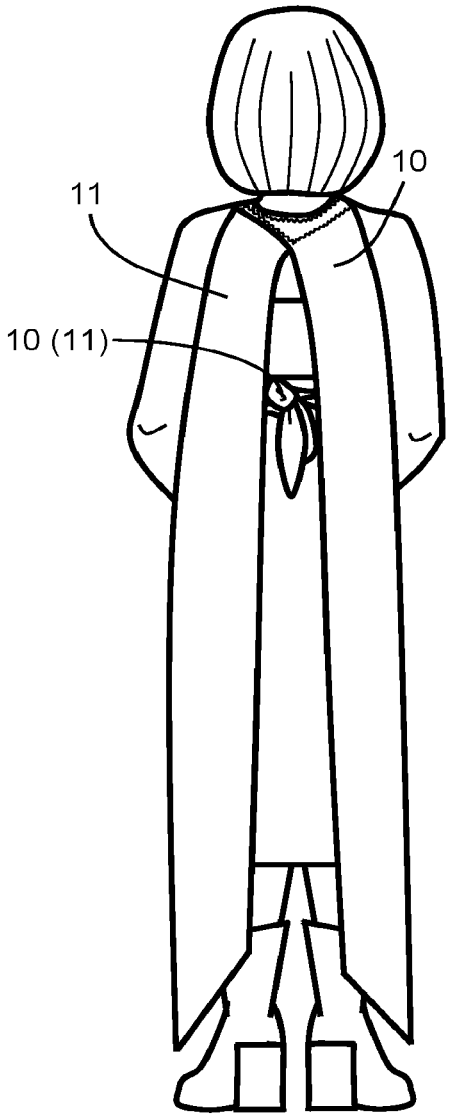

FIGS. 30A-30B are a front (A) and back (B) perspective view illustrating the described embodiment of wearable item 2 worn in a third embodiment of a configuration. The actions used in the described embodiment of method 900 for creating the illustrated configuration resulted in the described embodiments having: wearable item 2 positioned having the space 365 for the opening 366 and fastener devices 348 on another side (of the user's neck in this example); a part of wearable item 2 positioned behind the user's body and hanging freely (as seen in FIG. 30B); and a part of components 10 and 11 wrapped around the user's waist (as seen in FIGS. 30A-30B) and another part thereof tied together on the back side of the user's body (as seen in FIG. 30B).

FIG. 30B also illustrates the described embodiments of components 10 and 11 secured together in an exemplary way. Other embodiments of the wearable item and of the desired any other embodiment may have at least a number of components 6 that are secured together, visible or 'hidden' (which refers to not being seen). Additionally, various embodiments of the wearable item and of the desired any other embodiment could be used for, but not limited to, a number of configurations that have at least one component 6 positioned to be at least hidden or not hidden. By way of example, in the described embodiments, the visible tied parts of components 10 and 11 could have been positioned and secured at a side that is 'hidden' or covered by component 10 or 11 as a possible alternative configuration to hide the appearance of the secured parts, or another method could have been used to hide a part thereof. By another way of example, in the described embodiments, the visible tied parts of components 10 and 11 could have been positioned and secured at another side that is not hidden or covered by component 10 or 11 as a possible alternative configuration to make the secured parts visible, or another method could have been used to not hide a part thereof. In other embodiments, other methods can be used for creating any hidden and visible components, configurations, and the desired any other embodiment, as well as for positioning and using such components, configurations, and so forth. Other embodiments of the invention can also be secured, as well as hidden, in other ways.

Figure 31:
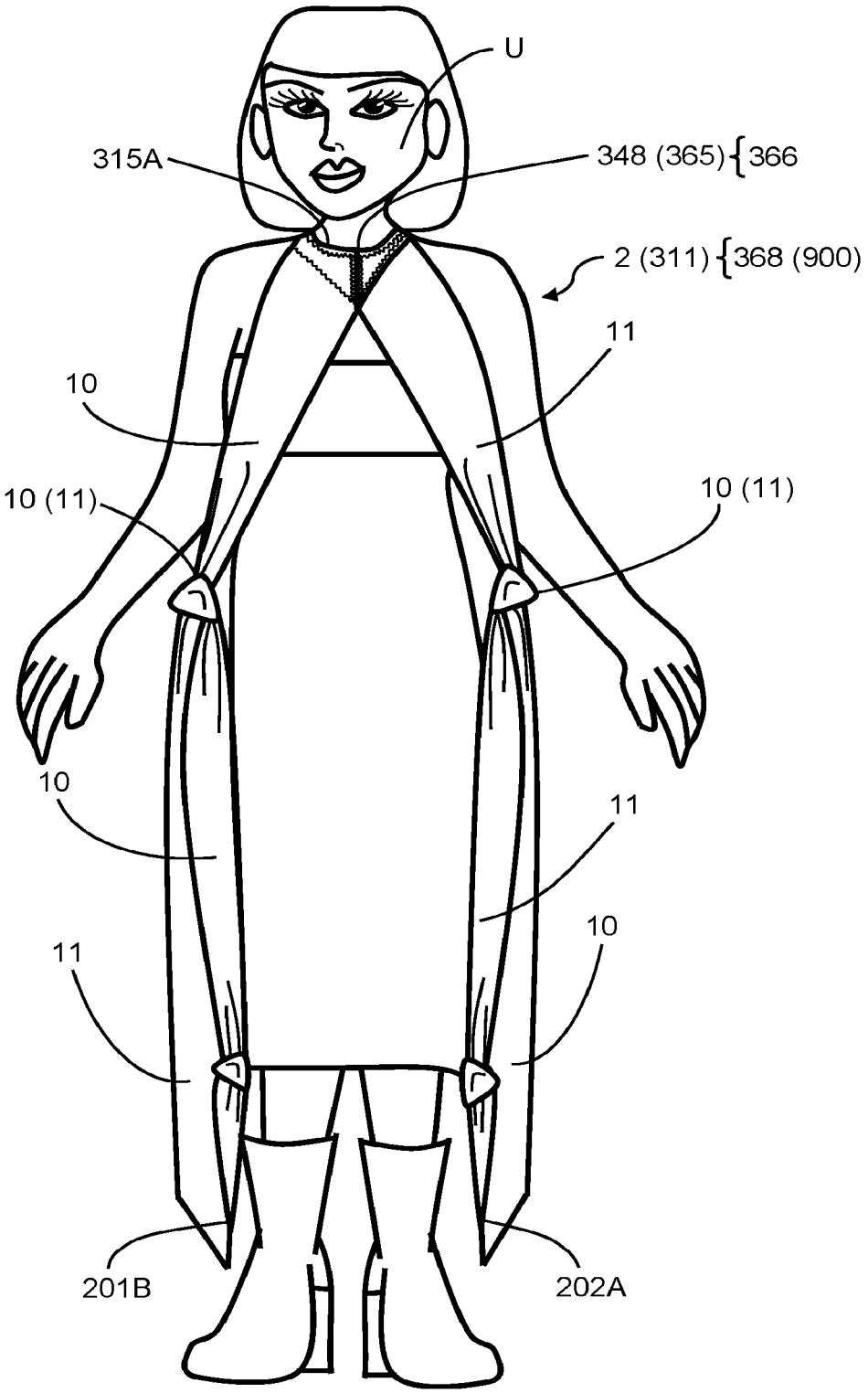
FIG. 31 is a front perspective view of the second wearable item worn in a fourth embodiment of a configuration and of some other embodiments.

FIG. 31 is a front perspective view of the described embodiment of wearable item 2 worn in a fourth embodiment of a configuration. The actions used in the described embodiment of method 900 for creating the illustrated configuration resulted in the described embodiments having: a part of wearable item 2 tied together at multiple sides of the user's body, with the item positioned with the space 365 for the opening 366 and fastener devices 348 on the front side of the user's body; and a part of components 10 and 11 tied together at each lateral side of the user's body and with another part thereof tied in a knot (near free ends 201B and 202A in this example) for decorative purposes in this example.

Figure 32A:
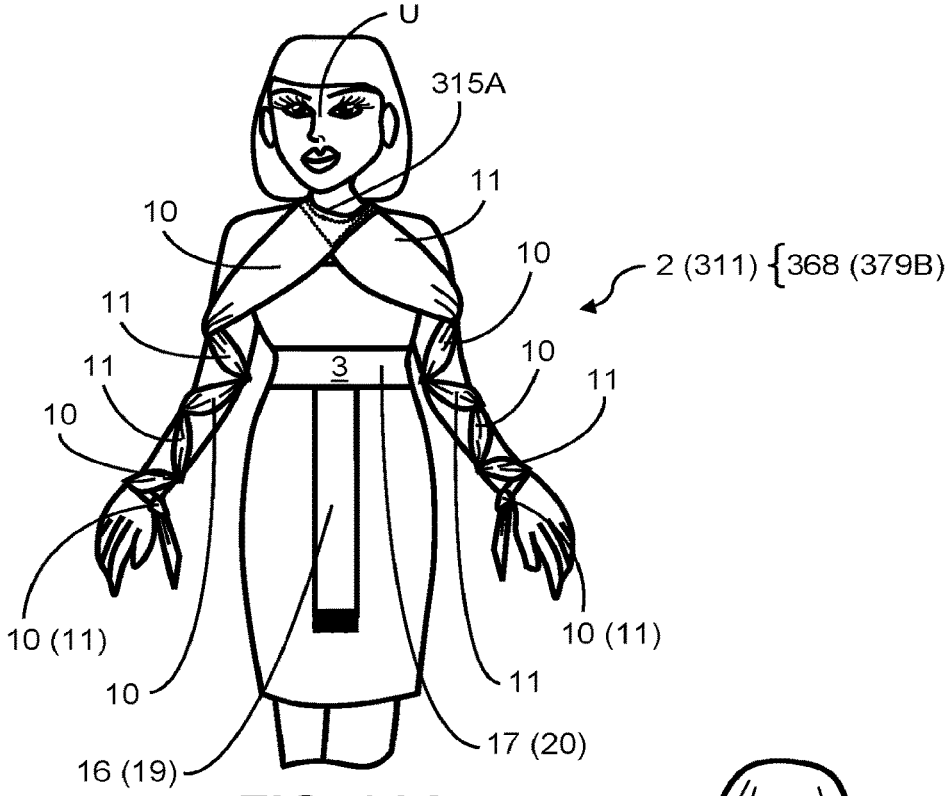
FIGS. 32A-32B are a front (A) and back (B) perspective view of multiple wearable items used together in a configuration, illustrating the second wearable item worn in a fifth embodiment of a configuration and the third wearable item worn in a first embodiment of a configuration in the described embodiments, and of some other embodiments.
Figure 32B:
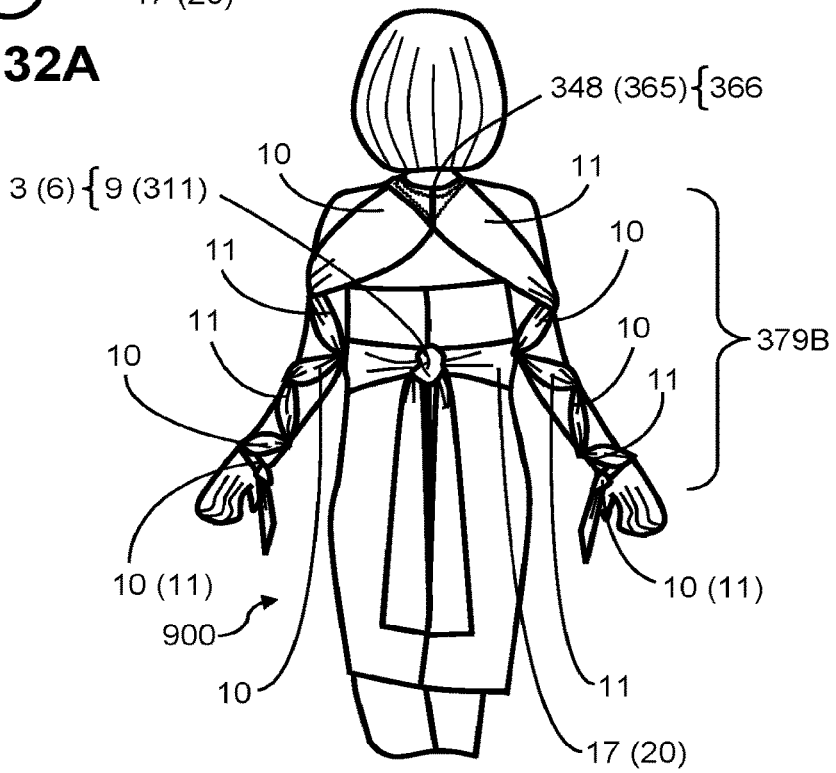

FIGS. 32A-32B are a front (A) and back (B) perspective view illustrating the following described embodiments: wearable item 2 worn in a fifth embodiment of a configuration; wearable item 3 worn in a first embodiment of a configuration; one embodiment of multiple wearable items at least worn together in a number of configurations, with wearable items 2 and 3 worn together in these embodiments; and a second embodiment of a sleeve style configuration 379B. Other embodiments of, but not limited to, the wearable item and the desired any other embodiment can be used together, as well as in other ways. Additionally, the actions used in the described embodiment of method 900 for creating the illustrated configuration also resulted in the described embodiments having: wearable item 2 used in this example for the second embodiment of a sleeve style configuration 379B; a part of wearable item 2 wrapped a number of times around each of the user's arms; a part of components 10 and 11 twisted and tied together at a location (which is near each of the user's wrists in this example) and in the form of a number of exemplary criss-crosses, and being used to create the illustrated second embodiment of the sleeve style configuration 379B in this example (as seen in FIGS. 32A-32B); a part of wearable item 2 positioned with the space 365 for the opening 366 and fastener devices 348 on the back side of the user's body (as seen in FIG. 32B); and wearable item 3 worn with components 16 and 17 and while being in the configuration similar to the illustration seen in FIGS. 4A-4B, with component 16 hanging freely (as shown in FIG. 32A and also in FIG. 33A) and component 17 worn around the user's waist and with parts thereof tied together (as shown in FIG. 32B and also in FIG. 33B) in this example.

Figure 33A:
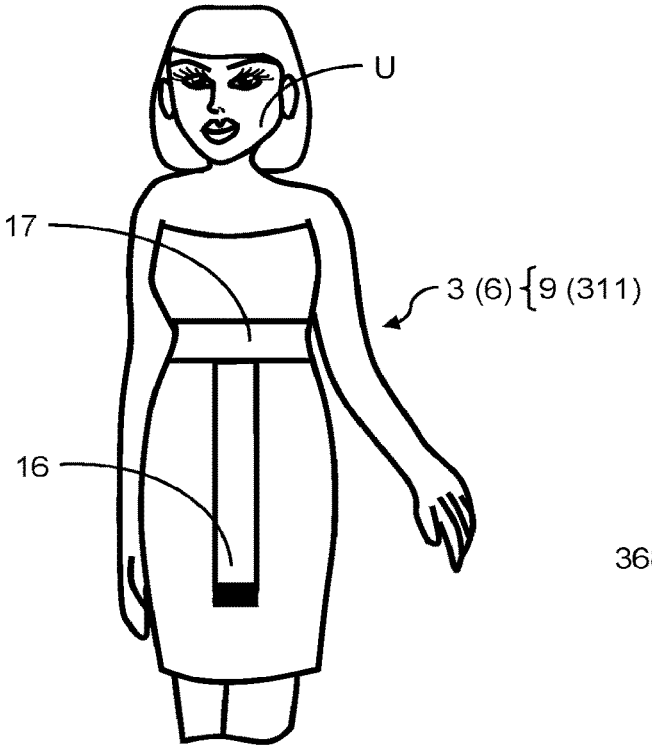
FIGS. 33A-33B are a front (A) and back (B) perspective view of the third wearable item worn in the first embodiment of a configuration and of some other embodiments.
Figure 33B:
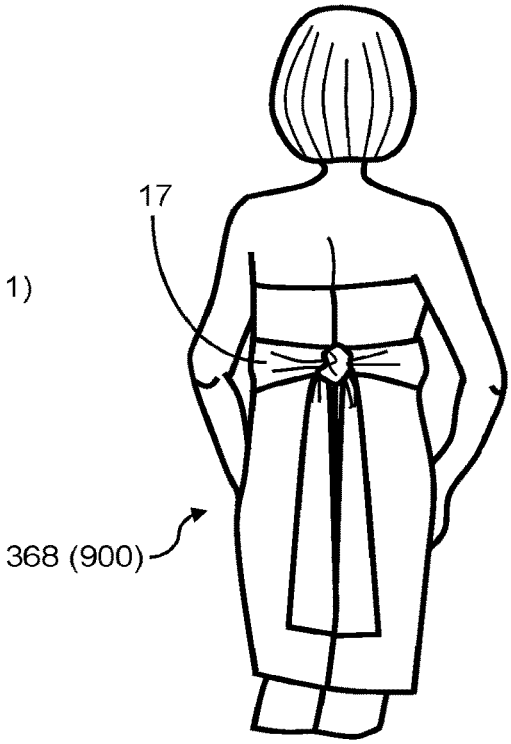

FIGS. 33A-33B are a front (A) and back (B) perspective view of the described embodiment of wearable item 3 worn in the first embodiment of a configuration and without wearable item 2.

Figure 34:
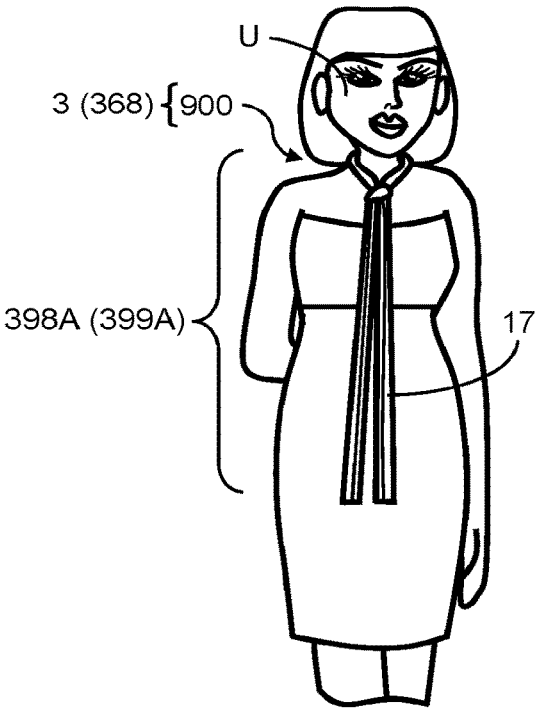
FIG. 34 is a front perspective view of the third wearable item worn in a second embodiment of a configuration and of some other embodiments.
Figure 35:
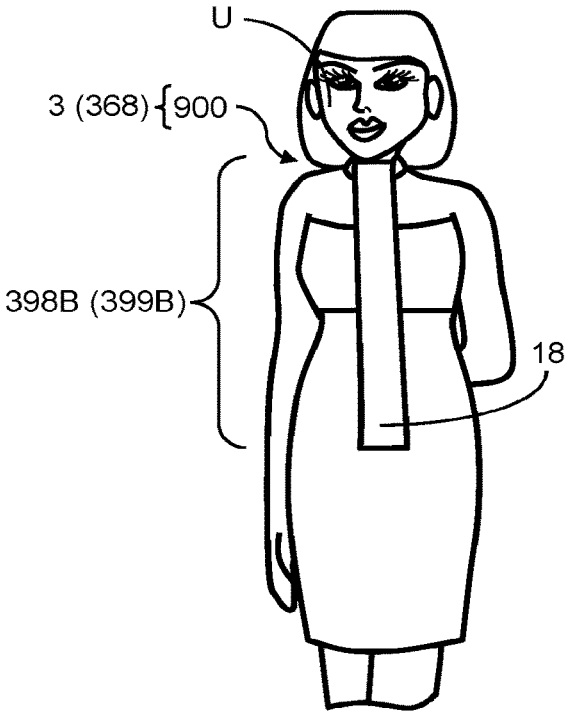
FIG. 35 is a front perspective view of the third wearable item worn in a third embodiment of a configuration and of some other embodiments.

FIG. 34 is a front perspective view illustrating the following described embodiments: wearable item 3 worn in a second embodiment of a configuration; a first embodiment of a configuration not having at least two of the number of components 6 attached together 398A; and a first embodiment of a strapless style configuration 399A. FIG. 35 is a front perspective view illustrating the following described embodiments: wearable item 3 worn in a third embodiment of a configuration; a second embodiment of a configuration not having at least two of the number of components 6 attached together 398B; and a second embodiment of a strapless style configuration 399B. As a reminder, it will be understood that a number of other components 6, parts and the desired any other embodiment can be used in, but not limited to, any or any combination of (i) a number of configurations not having at least two of the number of components 6 attached together, (ii) in any variation thereof, or (iii) in other ways.

Additionally, the actions used in the described embodiment of method 900 for creating the illustrated configurations resulted in the described embodiments having: component 17 folded in half (with the VELCRO® ends thereof attached together in this example), positioned at a location and around the user's neck, tied together and hanging freely in the illustration shown in FIG. 34; and component 18 folded in half (with the VELCRO® ends thereof attached together in this example), worn on an accessory item (being a necklace in this example, and which is inserted through an aperture created between the folded part of component 18 and the attached VELCRO® ends thereof of in this example), positioned at a location and around the user's neck, tied together and hanging freely to create the illustrated look in FIG. 35.

Figure 36A:
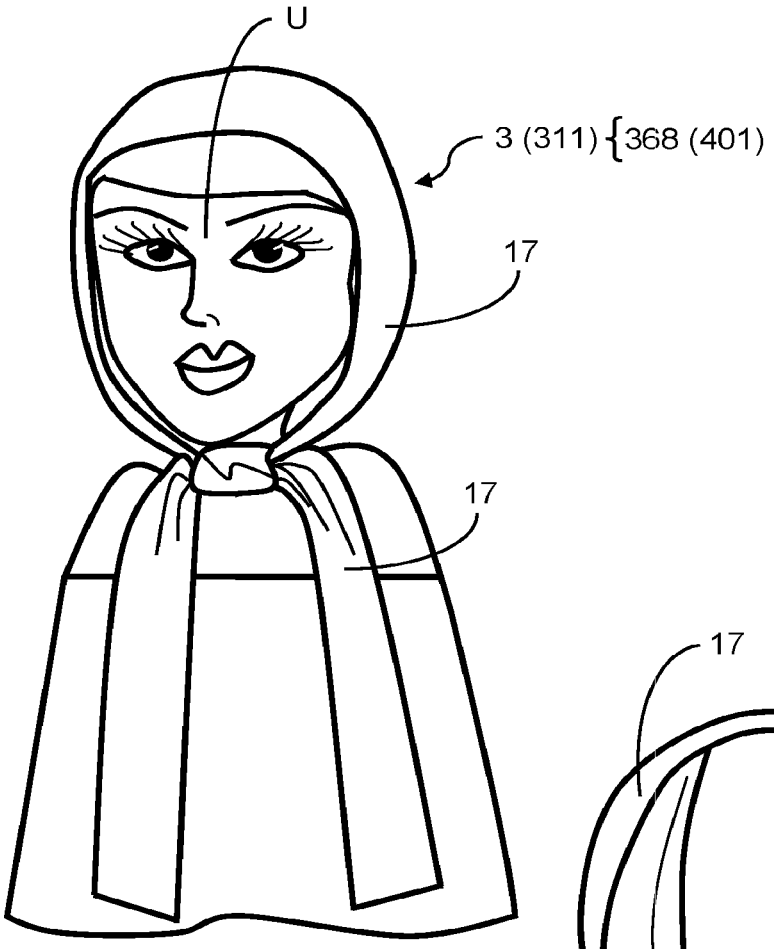
FIGS. 36A-36B are a front (A) and back (B) perspective view of the third wearable item worn in a fourth embodiment of a configuration and of some other embodiments.
Figure 36B:
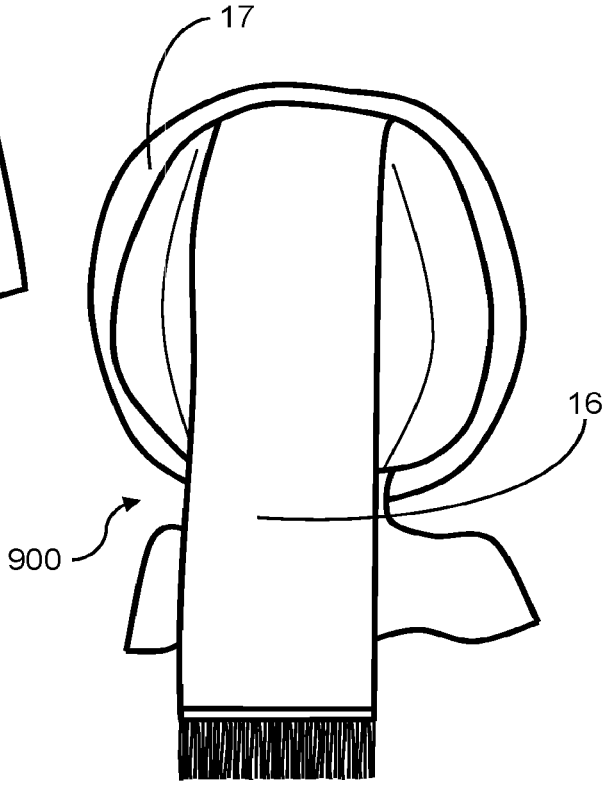

FIGS. 36A-36B are a front (A) and back (B) perspective view illustrating the following described embodiments: wearable item 3 worn in a fourth embodiment of a configuration; and one embodiment of a configuration having at least one configuration of any headwear 401 (being created with wearable item 3 in this example). The actions used in the described embodiment of method 900 for creating the illustrated configuration and this embodiment of the headwear 401 resulted in the described embodiments having: component 17 worn around the user's head and tied together at a location (as shown in FIG. 36A); component 16 hanging freely behind the user's head and attached to component 17 (as seen in FIG. 36B); and wearable item 3 used for creating the illustrated exemplary headwear used in this example. As a reminder, it will be understood that a number of other components 6, parts and the desired any other embodiment can be used in, but not limited to, any or any combination of (i) a number of configurations having at least any headwear 401, (ii) in any variation thereof, or (iii) in other ways.

Figure 37A:
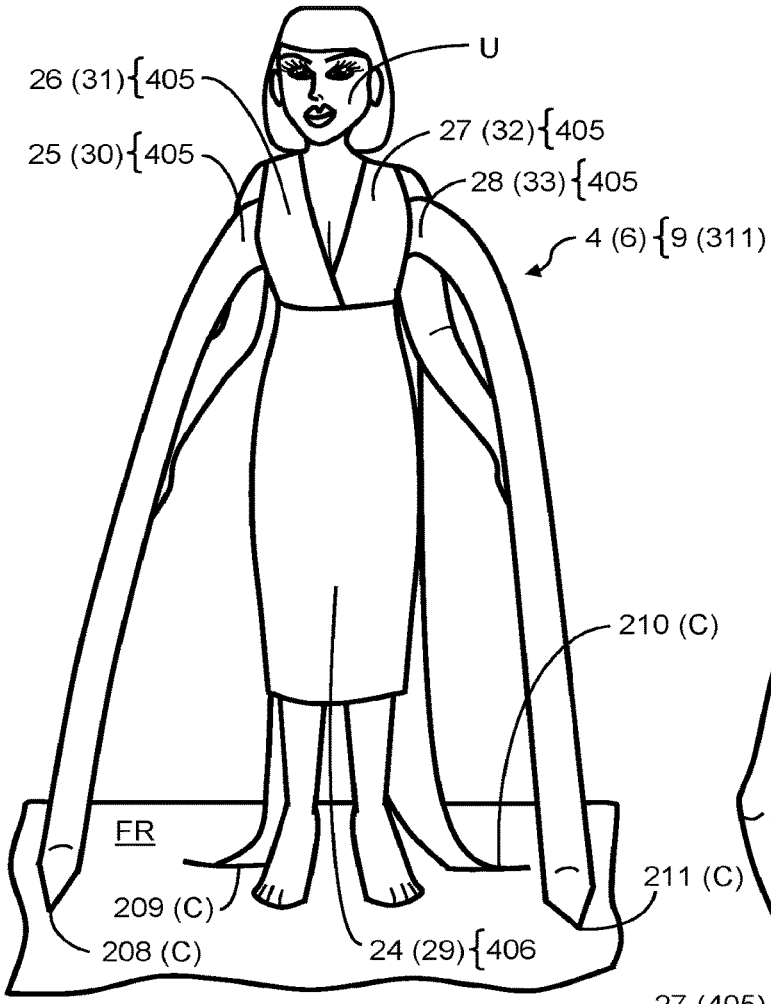
FIGS. 37A-37B are a front (A) and back (B) perspective view of the fourth wearable item worn in a first embodiment of a configuration and of some other embodiments.
Figure 37B:
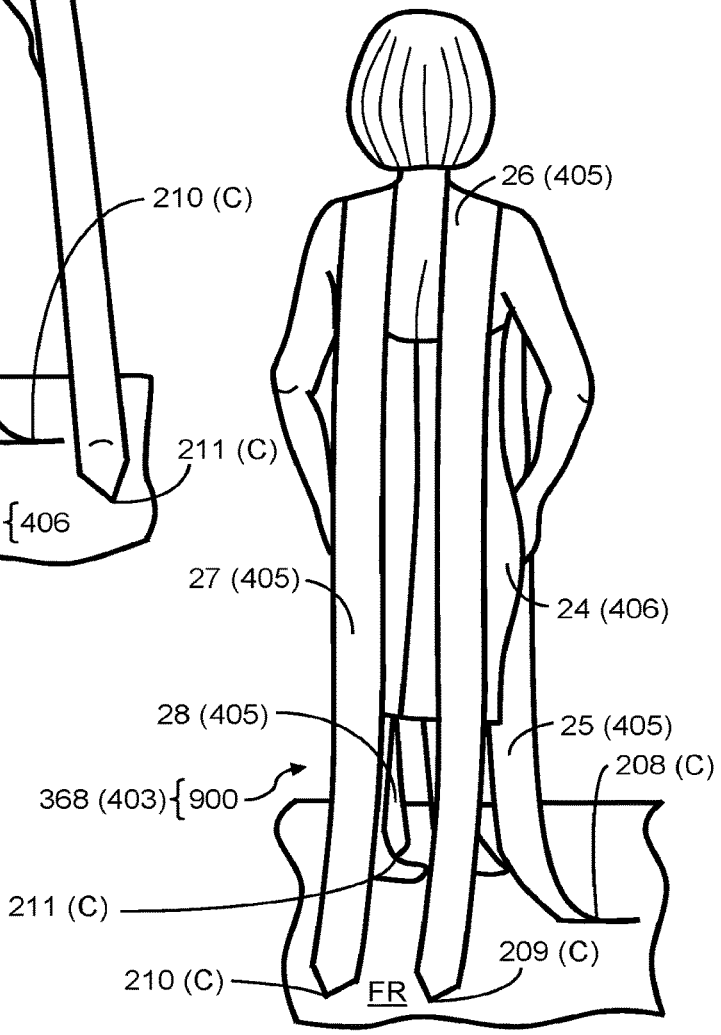

FIGS. 37A-37B are a front (A) and back (B) perspective view illustrating the following described embodiments: wearable item 4 worn in a first embodiment of a configuration; and one embodiment of a wearable item being worn by itself 403 (with wearable item 4 being used in this example). Various embodiments of the wearable item and of the desired any other embodiment may be worn independently (i.e., without any other item) in a number of configurations. By way of example, in the described embodiments, the user U is shown wearing wearable item 4 without any shoes and accessories. Other embodiments of the present invention may be worn by itself 403 in other ways. Additionally, the actions used in the described embodiment of method 900 for creating the illustrated configuration also resulted in the described embodiments having: wearable item 4 worn with component 24 worn from the user's mid-torso to slightly below the user's knees; and component 26 positioned over one of the user's shoulders and component 27 positioned over another shoulder (as shown in FIGS. 37A-37B). In the described embodiments, components 25 and 28 are also each shown held in one of the user's hands in FIG. 37A.

In the described embodiments, as well as in comparison to this embodiment of the illustrated exemplary floor FR used in the illustrated FIGS. in this example: one embodiment of the present invention having a length being at least longer than floor-length 405 is shown, with (i) wearable item 4 and (ii) components 26, 27, 28 and 29 and a part thereof being used in the described embodiments and for some exemplary embodiments of a length being at least longer than floor-length 405 in this example; free end 208 of component 25, free end 209 of component 26, and free end 210 of component 27 and free end 211 of component 28 are shown having contact C with the illustrated floor FR.

Figure 38A:
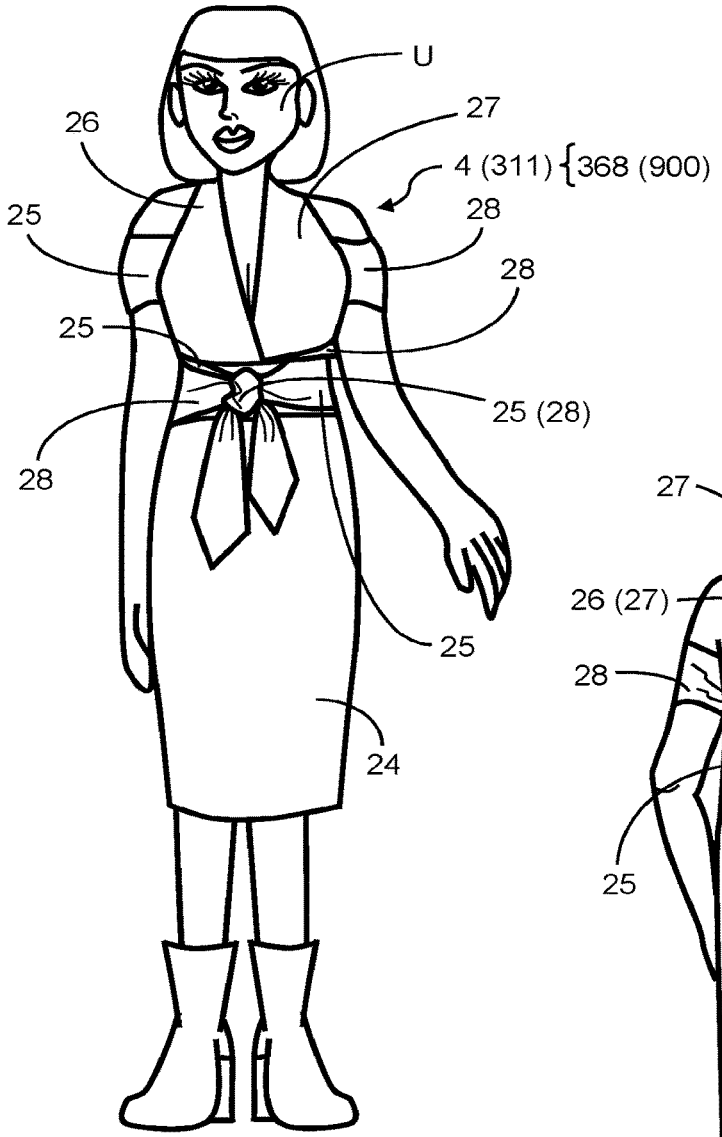
FIGS. 38A-38B are a front (A) and back (B) perspective view of the fourth wearable item worn in a second embodiment of a configuration and of some other embodiments.
Figure 38B:
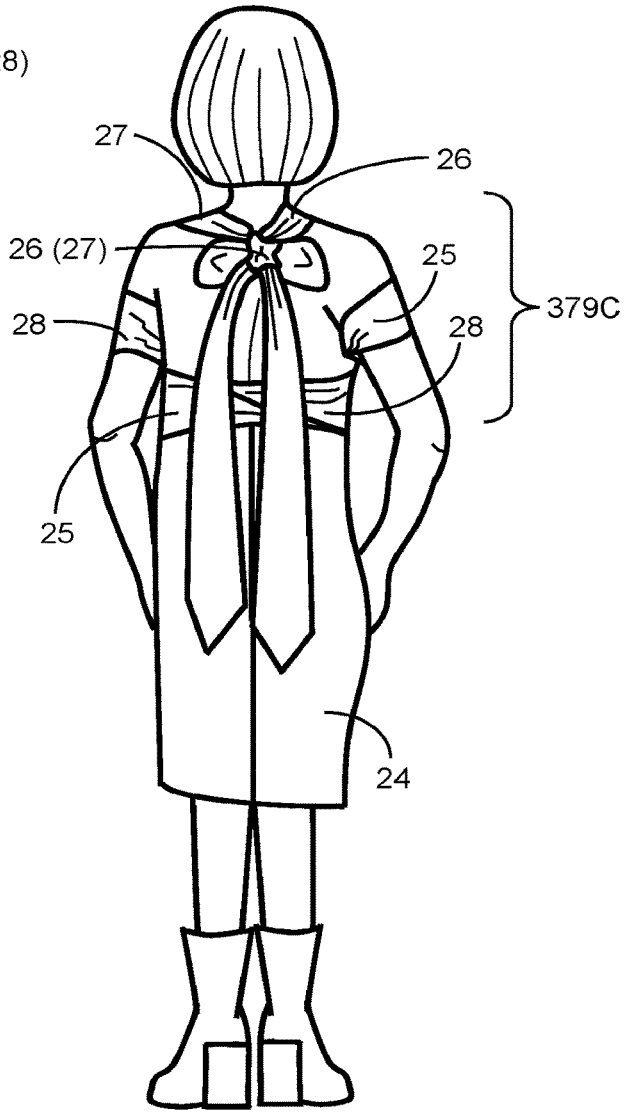

FIGS. 38A-38B are a front (A) and back (B) perspective view illustrating the following described embodiments: wearable item 4 worn in a second embodiment of a configuration; and a third embodiment of a sleeve style configuration 379C. The actions used in the described embodiment of method 900 for creating the illustrated configuration resulted in the described embodiments having: components 26 and 27 positioned behind the user's neck and tied together in a bow (as seen in FIG. 38B); component 25 partially wrapped around one of the user's arms (from the front side (as seen in FIG. 38A) to the back side (as seen in FIG. 38B)) then back around the user's mid-torso area a number of times (as shown in FIGS. 38A-38B); component 28 partially wrapped around another one of the user's arms (from the front side to the back side) then back around the user's mid-torso area a number of times (as shown in FIGS. 38A-38B); components 25 and 28 tied together (as shown in FIG. 38A); and one embodiment of a length being at least shorter than floor-length 406 (with wearable item 4 and component 24 being used in the described embodiments and for some exemplary embodiments of a length being at least shorter than floor-length 406 in this example, with component 24 shown not having any contact with the floor FR in the illustrated look).

The looseness, tightness, and fit of one or multiple components 6, of any wearable item and of the desired any other embodiment can be manipulated and adjusted in the desired manner, and in some embodiments, generally affect at least one of any or any combination of, but not limited to, the following: (i) the position of the respective embodiment; (ii) how some embodiments of the invention are used; (iii) the kinds of configurations used in various embodiments of the invention; or (iv) the comfort and fit of, but not limited to, the respective embodiment.

Figure 39A:
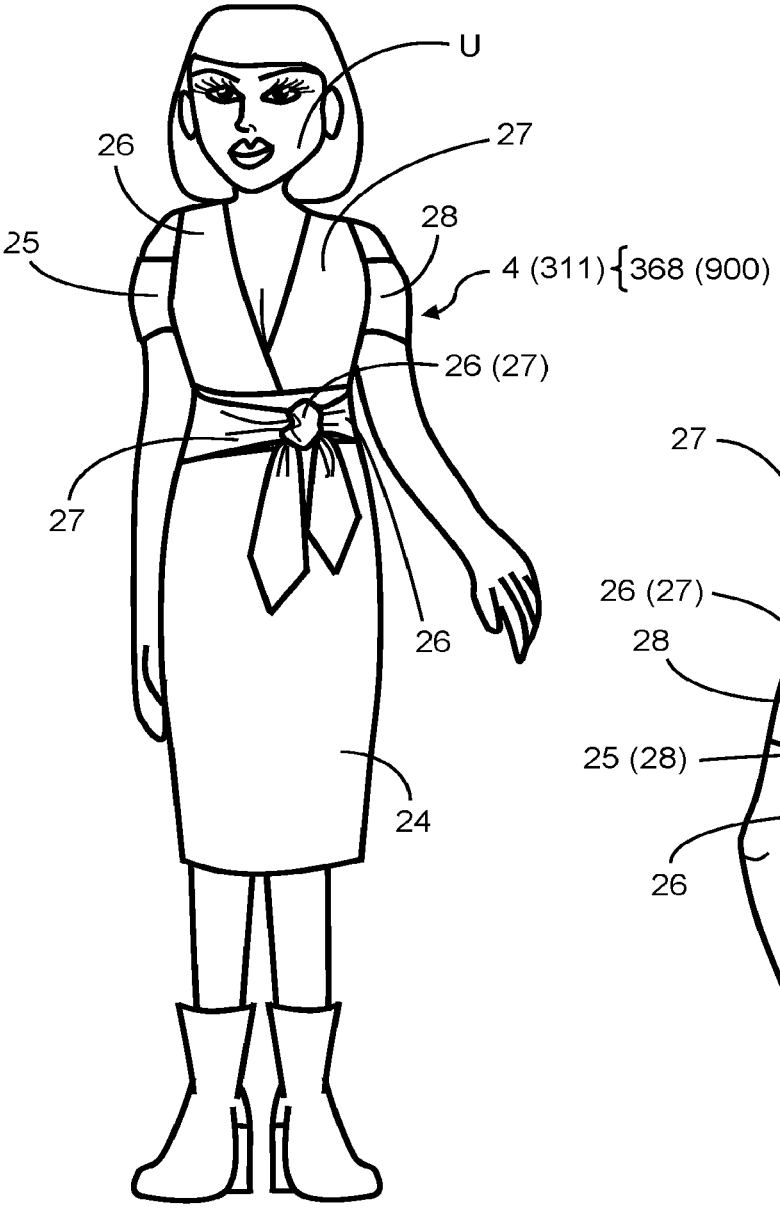
FIGS. 39A-39B are a front (A) and back (B) perspective view of the fourth wearable item worn in a third embodiment of a configuration and of some other embodiments.
Figure 39B:
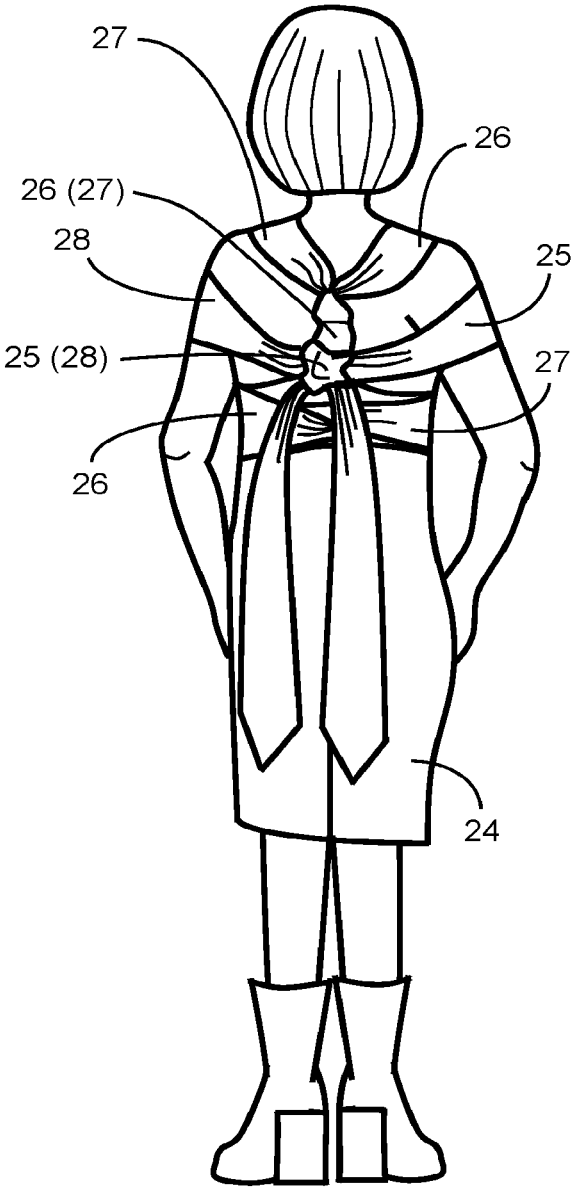

FIGS. 39A-39B are a front (A) and back (B) perspective view illustrating the described embodiment of wearable item 4 worn in a third embodiment of a configuration. The actions used in the described embodiment of method 900 for creating the illustrated configuration resulted in the described embodiments having: components 26 and 27 positioned behind the user's neck, twisted together down the user's back (as shown in FIG. 39B), wrapped a number of times around the user's mid-torso area (as shown in FIGS. 39A-39B), and tied together (as seen in FIG. 39A); component 25 partially wrapped around one of the user's arms (from the front side (as seen in FIG. 39A) to the back side (as seen in FIG. 39B)) and component 28 partially wrapped around another one of the user's arms (from the front side to the back side); and components 25 and 28 tied together at a location in this example (as shown in FIG. 39B).

Figure 40A:
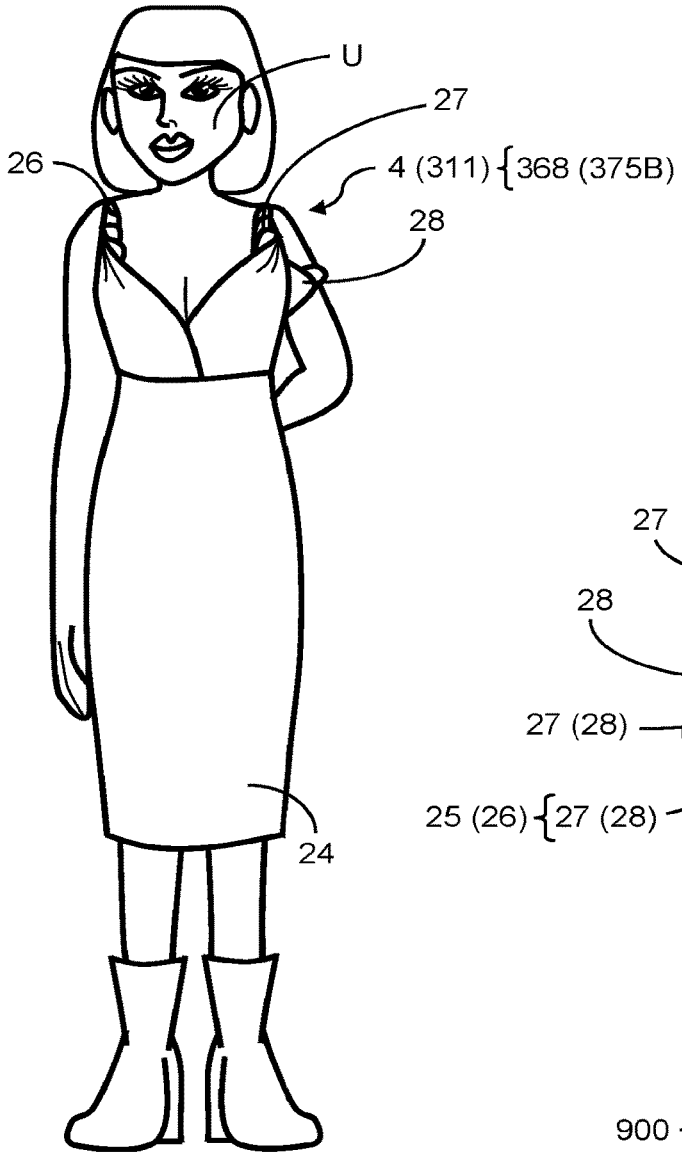
FIGS. 40A-40B are a front (A) and back (B) perspective view of the fourth wearable item worn in a fourth embodiment of a configuration and of some other embodiments.
Figure 40B:
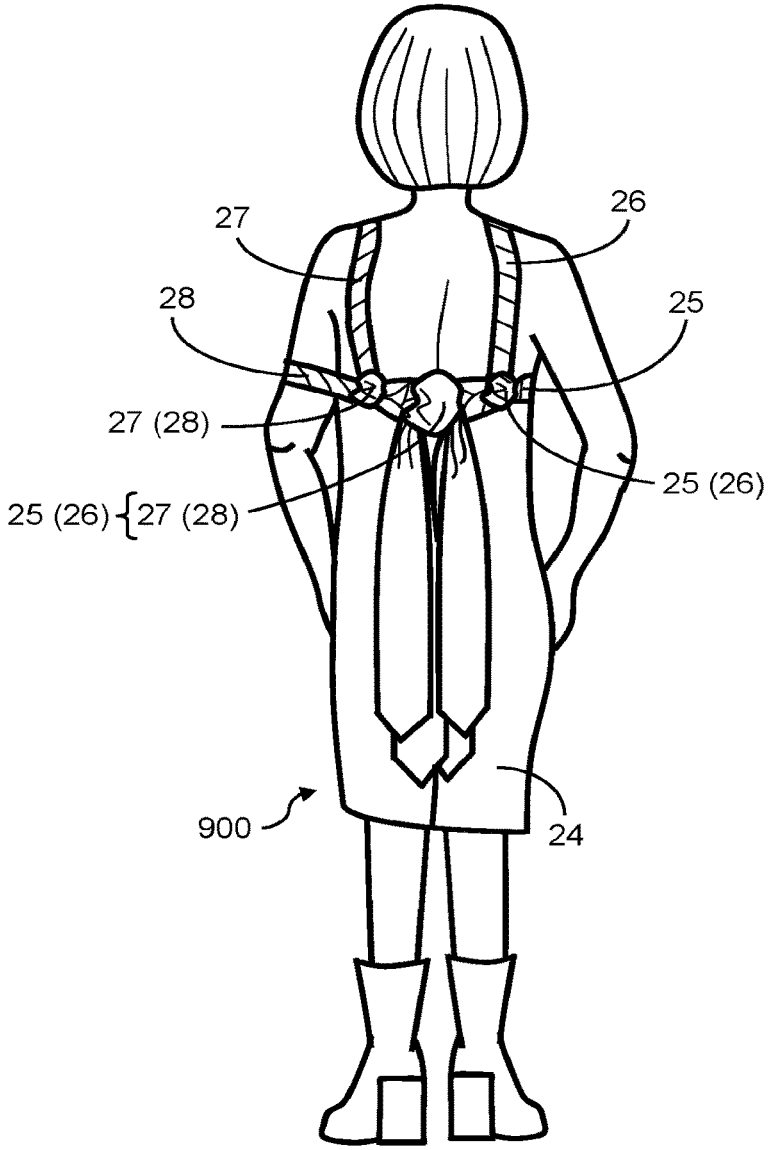

FIGS. 40A-40B are a front (A) and back (B) perspective view illustrating the following described embodiments: wearable item 4 worn in a fourth embodiment of a configuration; and a second embodiment of a strap style configuration 375B. The actions used in the described embodiment of method 900 for creating the illustrated configuration resulted in the described embodiments having: components 26 and 27 twisted in a direction a number of times, positioned over the user's shoulders (as shown in FIGS. 40A-40B) and on the user's back (see FIG. 40B); component 25 twisted in a direction a number of times (as shown in FIGS. 40A-40B) and positioned behind the user's torso (see FIG. 40B); component 28 twisted in a direction a number of times, positioned partially over one of the user's arms (as shown in FIGS. 40A-40B), and positioned behind the user's torso (see FIG. 40B); and components 25, 26, 27 and 28 all twisted together (as shown in FIGS. 40A-40B, with the exception of component 25 not being seen in FIG. 40A in this example), positioned and styled at a location (as shown in FIG. 40B), and secured together, with a band (not illustrated) used in this example.

Figure 41A:
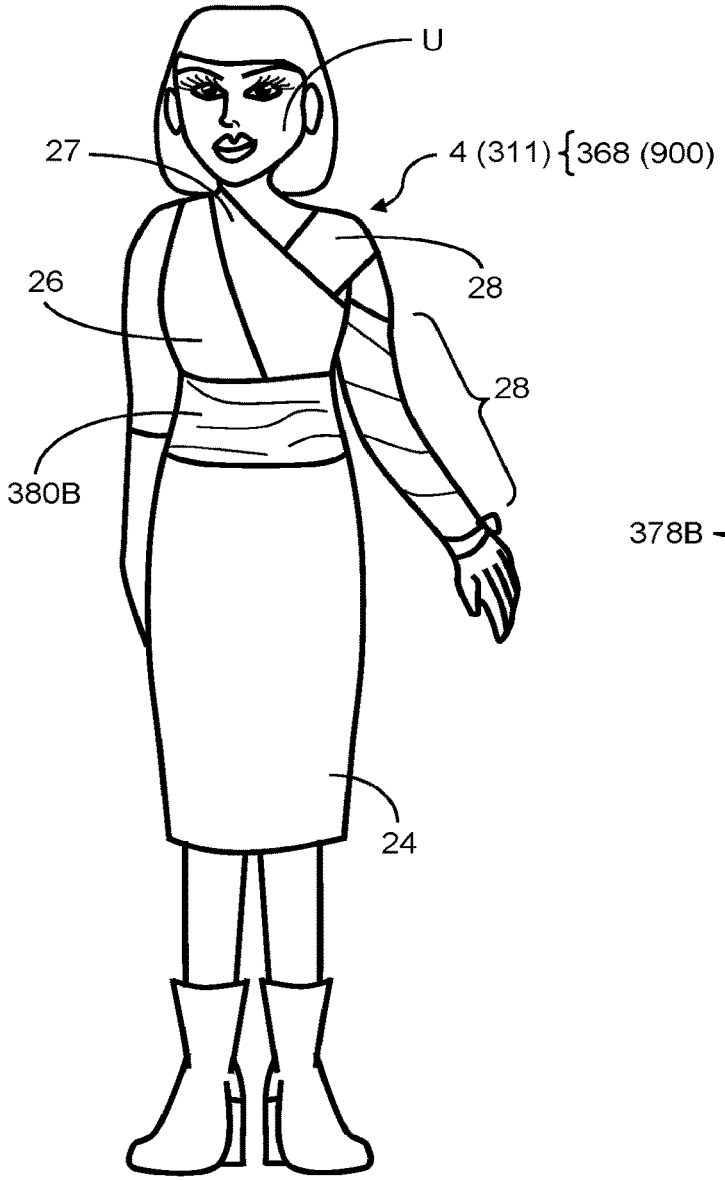
FIGS. 41A-41B are a front (A) and back (B) perspective view of the fourth wearable item worn in a fifth embodiment of a configuration and of some other embodiments.
Figure 41B:
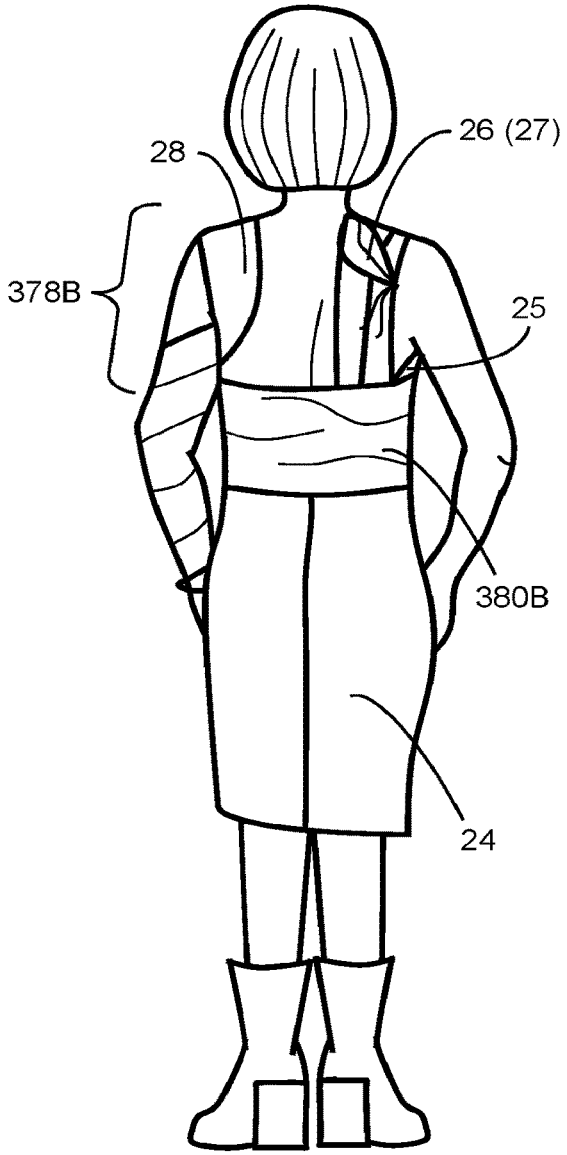

FIGS. 41A-41B are a front (A) and back (B) perspective view illustrating the following described embodiments: wearable item 4 worn in a fifth embodiment of a configuration; a second embodiment of a shoulder style configuration 378B; and a second embodiment of a number of items 380B (being a tube top in this example). The actions used in the described embodiment of method 900 for creating the illustrated configuration resulted in the described embodiments having: components 26 and 27 positioned together over one of the user's shoulders (as shown in FIGS. 41A-41B) and twisted together a number of times in a direction (as shown in FIG. 41B); component 28 positioned diagonally over the user's other shoulder and wrapped around the respective arm extending from the illustrated shoulder a number of times (as shown in FIGS. 41A-41B); free end 211 (not illustrated) tucked in the twisted part of component 28 to secure the component in place in this example; and component 25 and the free ends of components 26 and 27 (not illustrated) hidden by the use of the tube top in this example.

Figure 42A:
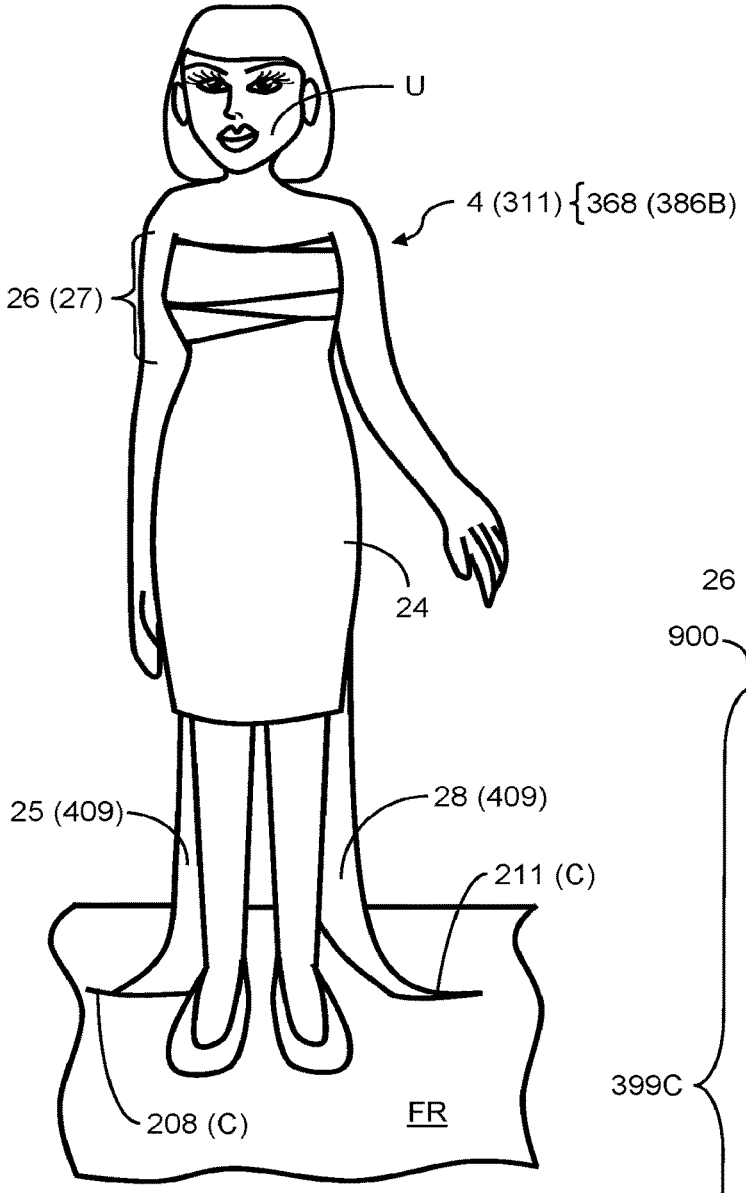
FIGS. 42A-42B are a front (A) and back (B) perspective view of the fourth wearable item worn in a sixth embodiment of a configuration, illustrating one embodiment of a wearable item having a part being at least used as a train, and of some other embodiments.
Figure 42B:
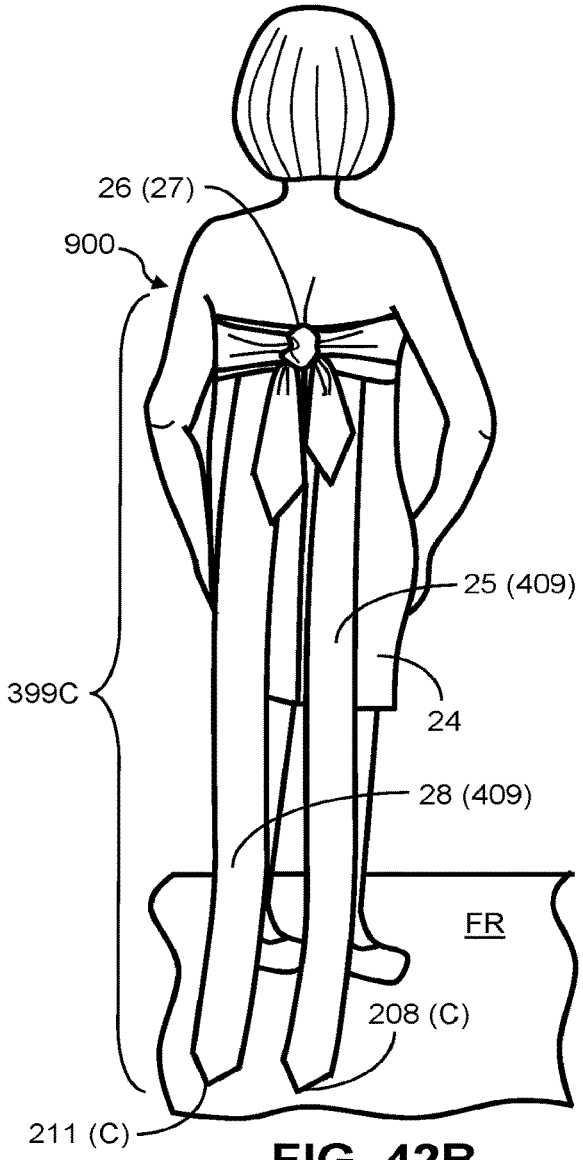

FIGS. 42A-42B are a front (A) and back (B) perspective view illustrating the following described embodiments: wearable item 4 worn in a sixth embodiment of a configuration; a second embodiment of a sleeveless style configuration 386B; a third embodiment of a strapless style configuration 399C; and one embodiment of a garment train 409 (being created with wearable item 4 and components 25 and 28 in this example). The actions used in the described embodiment of method 900 for creating the illustrated configuration resulted in the described embodiments having: components 26 and 27 wrapped around the user's chest and upper torso area in a direction a number of times and overlapping (as seen in FIGS. 42A-42B), and then tied together at a location (as seen in FIG. 42B); and components 25 and 28 hanging freely, having contact C with the illustrated floor FR (with free ends 208 and 211 illustrated having contact C in this example), and appearing to trail behind in an exemplary way on the floor FR (see FIG. 42A) to create this embodiment of the garment train 409.

In various embodiments of the present invention, one or multiple components 6 are used in a manner that could result in, but not limited to, some embodiments of the wearable item and of the desired any other embodiment having a part thereof that at least trails behind (i.e., at least follows or drags along behind) a user U. As a reminder, it will be understood that: other methods could be used for creating or at least having other embodiments of a garment train 409; and other embodiments of the invention may be used for, but not limited to, the desired number of unlimited garment train styles, lengths and any other variation thereof.

It can be observed that a wearable item can appear to be longer or shorter in some embodiments of the present invention, which can be influenced by the manner in which the item is manipulated, the position of various components, and by a variety of other factors. By way of example, component 24 was positioned higher above the user's chest and secured in place, resulting in a shorter-length garment in this example. However, other embodiments of the wearable item and of the desired any other embodiment can be positioned, manipulated and used at other lengths, heights and dimensions to achieve the desired result.

Figure 43A:
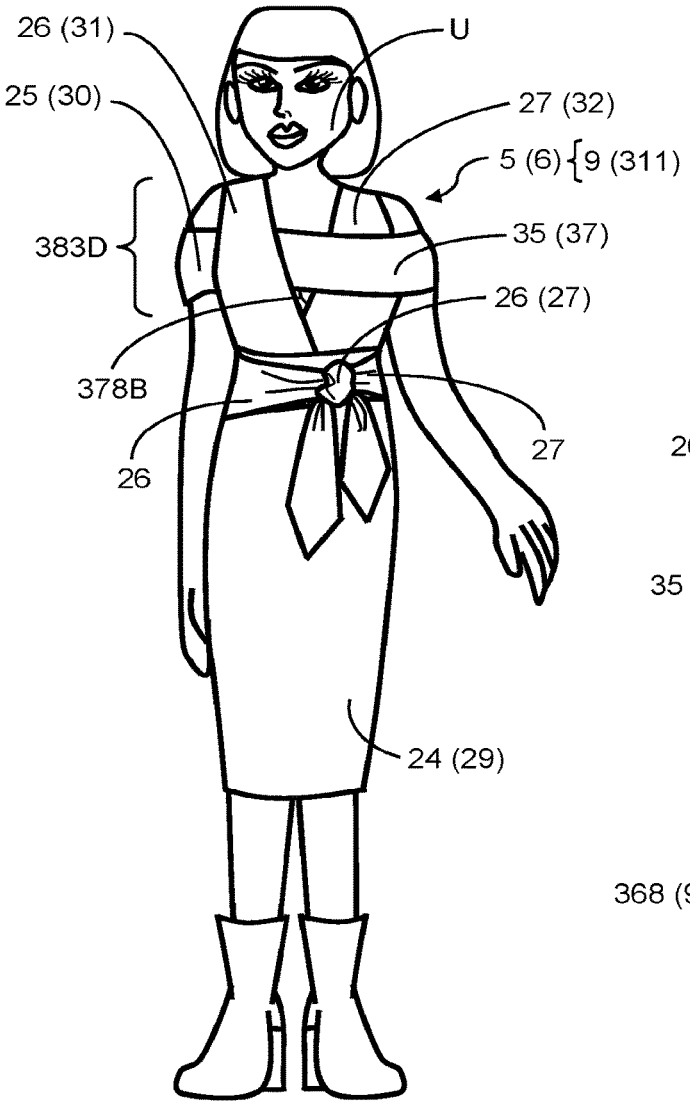
FIGS. 43A-43B are a front (A) and back (B) perspective view of the fifth wearable item worn in a first embodiment of a configuration and of some other embodiments.
Figure 43B:
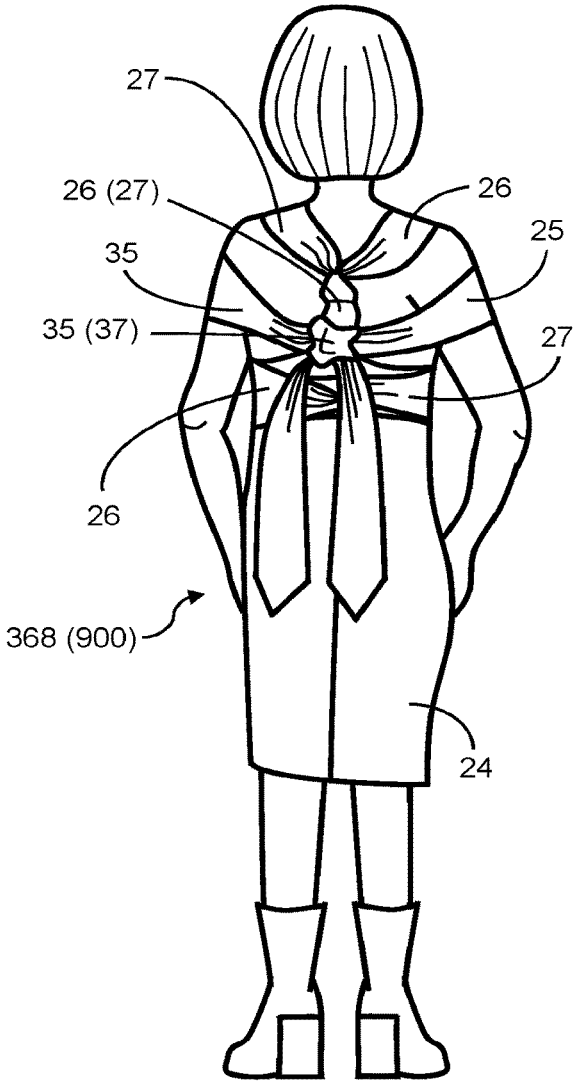

FIGS. 43A-43B are a front (A) and back (B) perspective view illustrating the following described embodiments: wearable item 5 worn in a first embodiment of a configuration; a second embodiment of a cut-out style configuration 378B; and a fourth embodiment of a sleeve style configuration 383D. In the described embodiments, wearable item 5 has been designed in a manner that resulted in the item having the appearance of another exemplary aperture, which is located at the location of the presently described second embodiment of the cut-out style configuration 378B (as shown in FIG. 43A) in this example. The actions used in the described embodiment of method 900 for creating the illustrated configuration resulted in: a configuration having components 25 worn over one of the user's arms, component 35 worn over the user's other arm (as shown in FIGS. 43A-43B), and both components 25 and 35 tied together in a knot (see FIG. 43B) to create this embodiment of the sleeve style configuration 383D in this example; and a configuration having component 35 positioned over component 27 and with components 26 and 27 being worn on the user's shoulders (as seen in FIG. 43A), twisted together multiple times (see FIG. 43B), and wrapped around the user's waist on the user's back and front multiple times (while overlapping each other) and then tied together in a knot (see FIG. 43A).

Figure 44A:
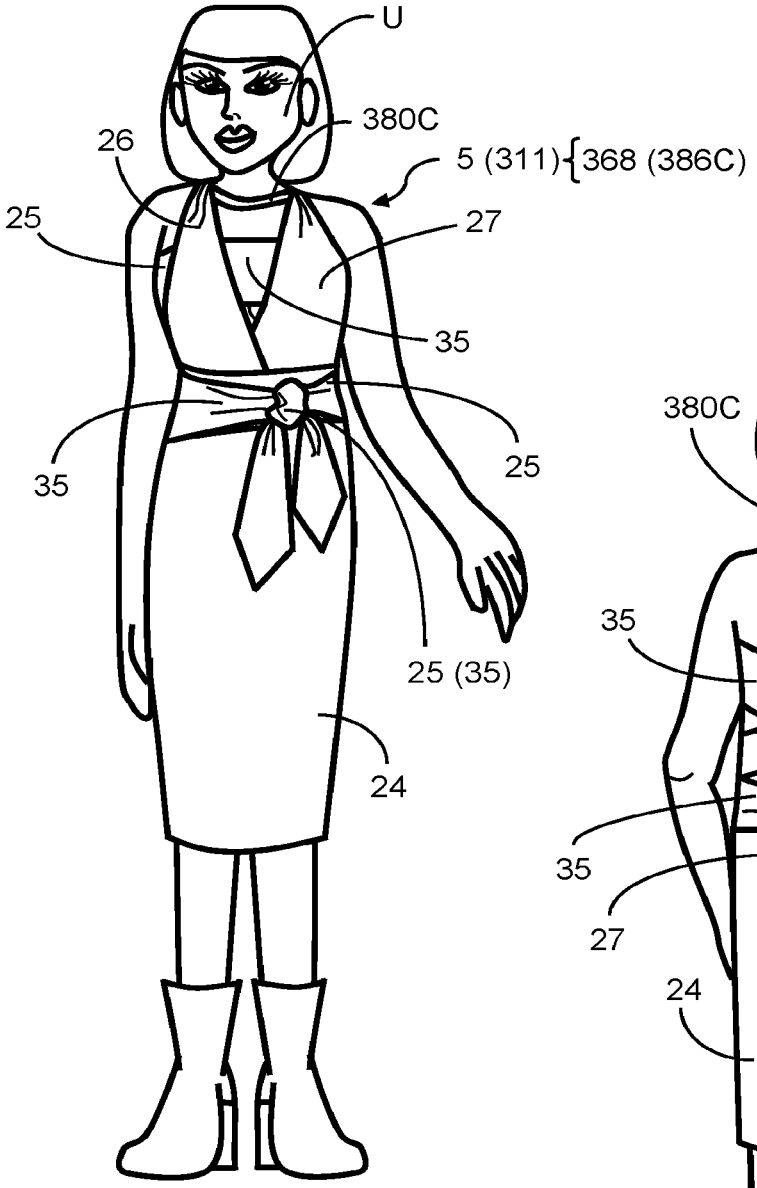
FIGS. 44A-44B are a front (A) and back (B) perspective view of the fifth wearable item worn in a second embodiment of a configuration and of some other embodiments.
Figure 44B:
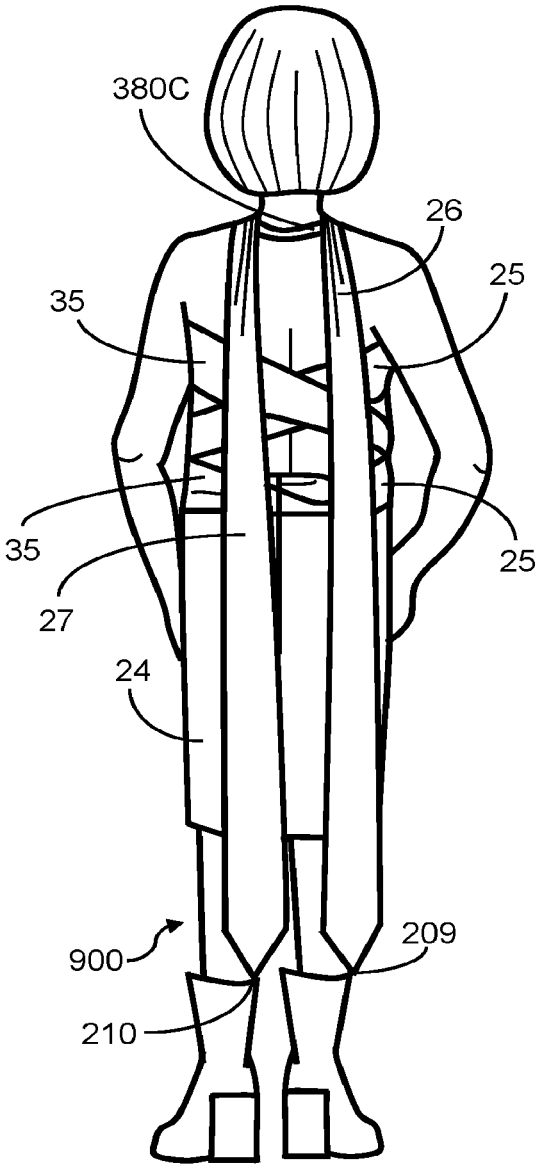

FIGS. 44A-44B are a front (A) and back (B) perspective view illustrating the following described embodiments: wearable item 5 worn in a second embodiment of a configuration; a third embodiment of a number of items 380C, and which is a necklace in this example; and a third embodiment of a sleeveless style configuration 386C. The actions used in the described embodiment of method 900 for creating the illustrated configuration resulted in the described embodiments having: components 26 and 27 wrapped around the third embodiment of a number of items 380C in a direction a number of times (as seen in FIGS. 44A-44B) and with the ends (being free ends 209 and 210 in this example) hanging freely (as seen in FIG. 44B); components 25 and 35 not worn over any of the user's arms, but on the user's torso; component 35 positioned under component 27 (as seen in FIG. 44A); and both components 25 and 35 criss-crossed over each other on the user's back (as seen in FIG. 44B) and wrapped around the user's waist on the user's back and front multiple times (see FIGS. 44A-44B), and then tied together in a knot (as seen in FIG. 44A).

Figure 45A:
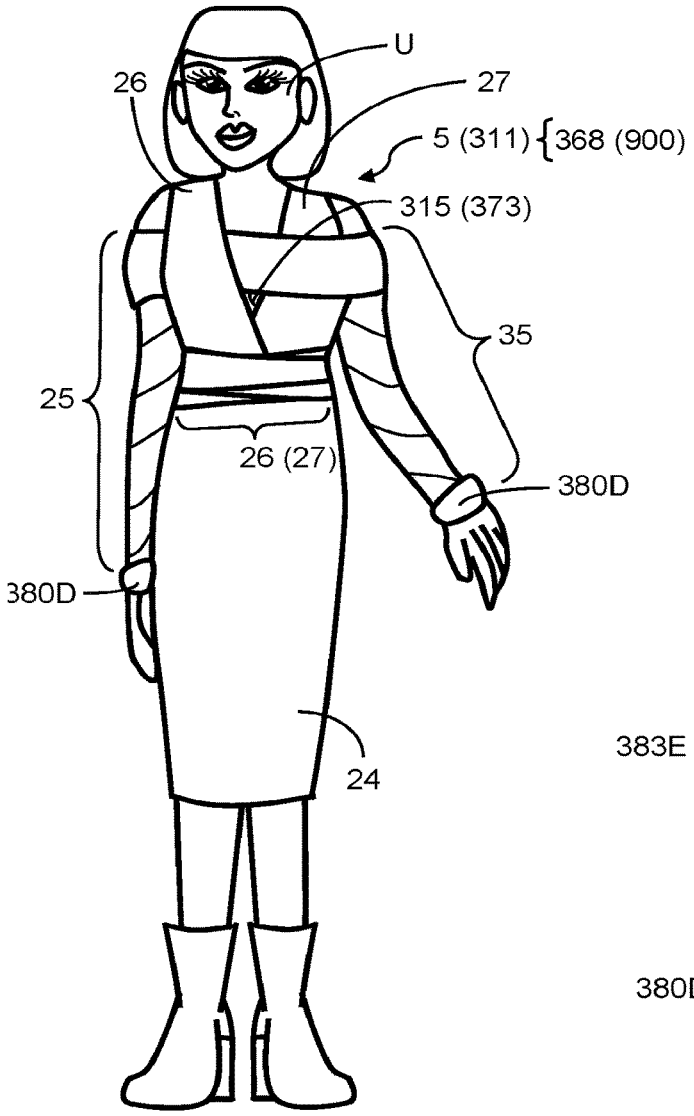
FIGS. 45A-45B are a front (A) and back (B) perspective view of the fifth wearable item worn in a third embodiment of a configuration and of some other embodiments.
Figure 45B:
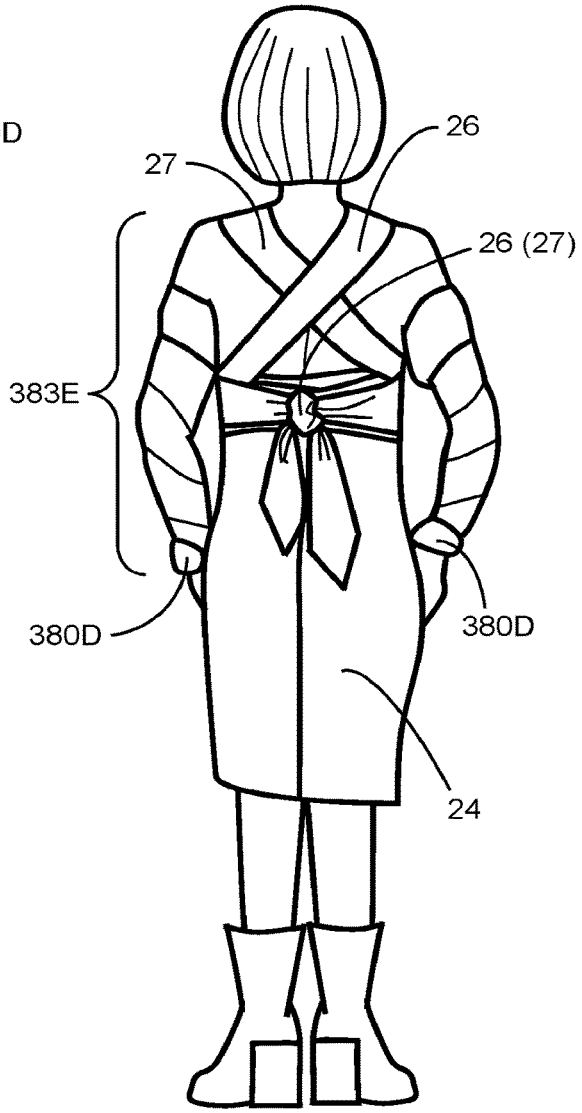

FIGS. 45A-45B are a front (A) and back (B) perspective view illustrating the following described embodiments: wearable item 5 worn in a third embodiment of a configuration; a fourth embodiment of a number of items 380D, which are a number of bracelets and shown being worn on each arm and near the user's wrist in this example; and a fifth embodiment of a sleeve style configuration 383E. In the described embodiment, wearable item 5 is used to show this embodiment of the sleeve style configuration 383D. The actions used in the described embodiment of method 900 for creating the illustrated configuration resulted in the described embodiments having: both components 26 and 27 criss-crossed over each other on the user's back (as shown in FIG. 45B), wrapped a number of times around the user's waist in a number of directions and overlapping (as shown in FIGS. 45A-45B), and tied together in a knot at a location (as shown in FIG. 45B); component 35 positioned over one of the user's arms and wrapped a number of times around the respective arm in a direction that is downward in the illustrated embodiment; component 25 positioned over the user's other arm and wrapped a number of times around the respective arm in a direction that is downward in the illustrated embodiment; free end 214 (not illustrated) tucked in the twisted part of component 25 to secure the component in place; free end 213 (not illustrated) tucked in the twisted part of component 35 to secure the component in place; and both free ends 214 and 215 hidden by the use of the fourth embodiment of the number of items 380D in this example.

Figure 46A:
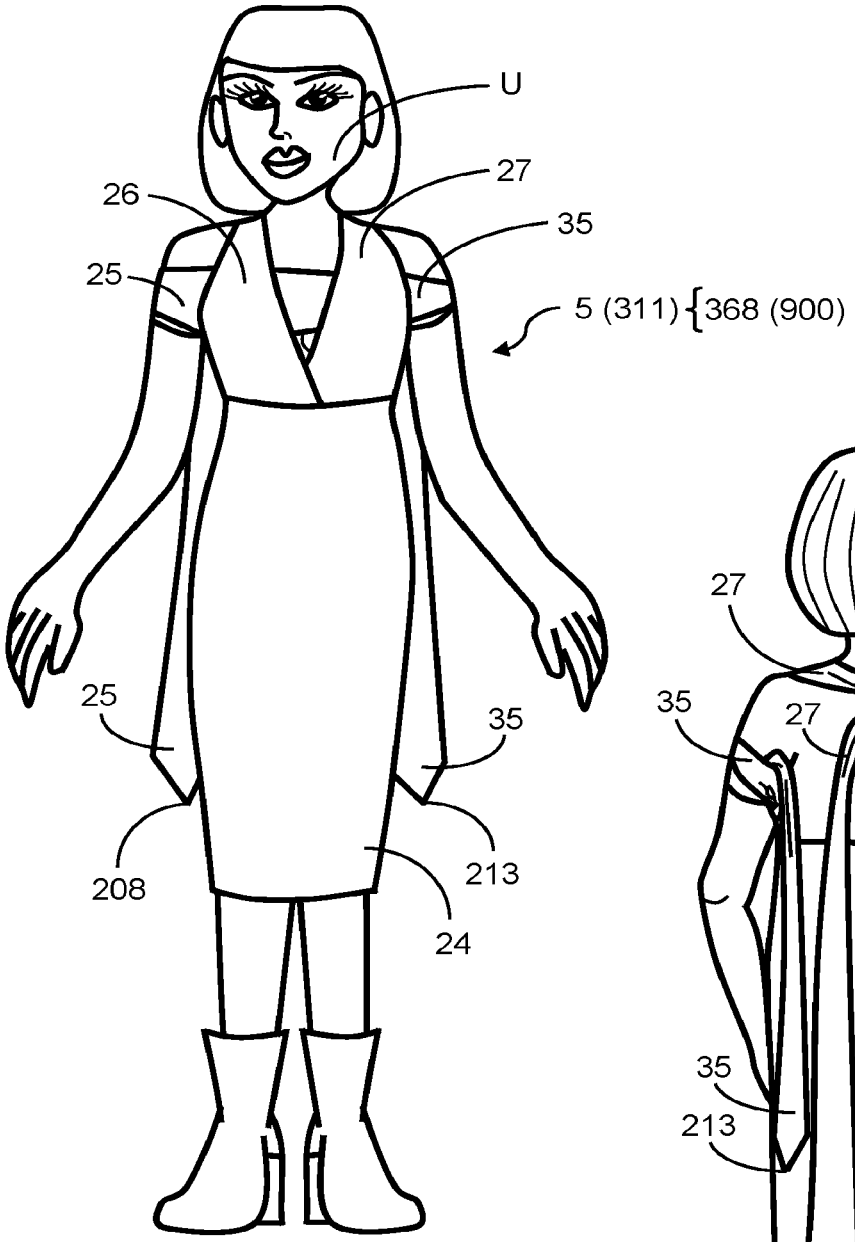
FIGS. 46A-46B are a front (A) and back (B) perspective view of the fifth wearable item worn in a fourth embodiment of a configuration and of some other embodiments.
Figure 46B:
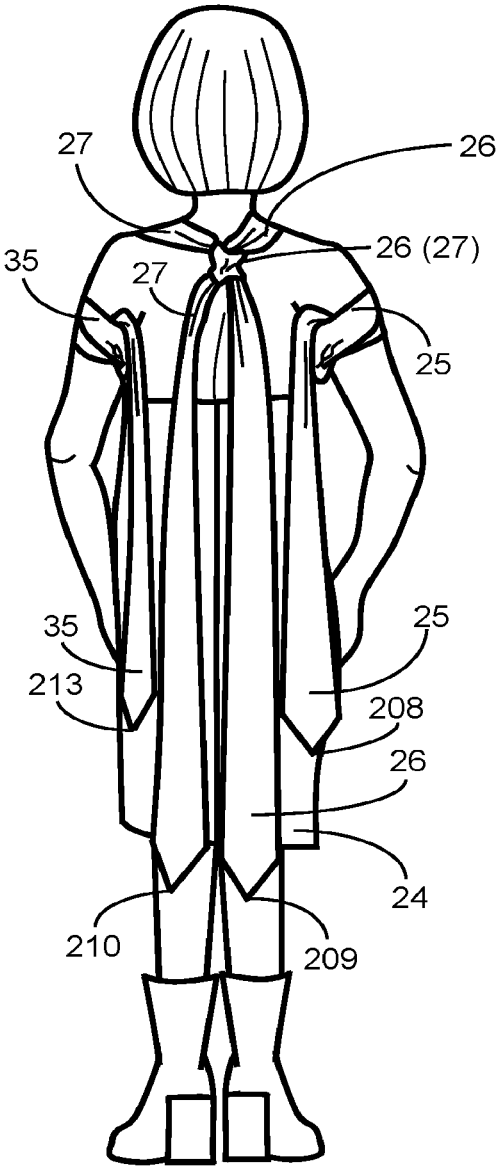

FIGS. 46A-46B are a front (A) and back (B) perspective view illustrating the described embodiment of wearable item 5 worn in a fourth embodiment of a configuration. The actions used in the described embodiment of method 900 for creating the illustrated configuration resulted in the described embodiments having: components 26 and 27 positioned behind the user's neck and tied together in a knot (as seen in FIG. 46B); component 25 wrapped a number of times around one of the user's arms in a direction in the form of a loop that is slightly loose (as shown in FIGS. 46A-46B), with a part thereof inserted through the loop in a direction being from the bottom of the loop through the top of the loop located near the user's arm (as shown in FIG. 46B) in the illustrated embodiment, and the rest thereof seen hanging freely; component 35 wrapped a number of times around the user's other arm in a direction in the form of a loop that is slightly loose (as shown in FIG. 46B), with a part thereof inserted through the loop in a direction being from the bottom of the loop through the top of the loop located near the user's same arm (as shown in FIG. 46B) in the illustrated embodiment, and the rest of the component seen hanging freely; and all the free ends 208, 209, 210 and 213 hanging freely (as shown in FIGS. 46A-46B).

Figure 47:
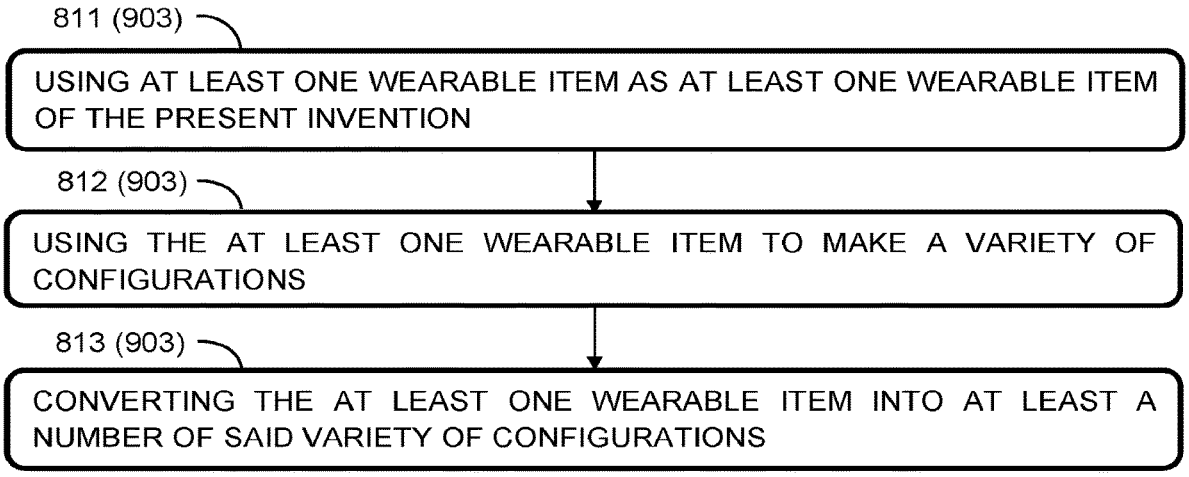
FIG. 47 is a flow diagram outlining one embodiment of a method of using a wearable item.

FIG. 47 is a flow diagram outlining a method 903 of using, but not limited to, a wearable item. In accordance with some embodiments of the present invention, the method 903 includes the steps of: using, but not limited to, at least one wearable item that is versatile and used as at least one wearable item in a number of configurations, and which has the attributes, characteristics, features, and the inventive qualities and principles of at least any wearable item (as well as any other embodiment) of the present invention (at 811); using, but not limited to, the at least one wearable item to make a variety of configurations (at 812); and converting the at least one wearable item into at least a number of the variety of configurations (at 813). In other embodiments, the method 903 may be used in other ways and for other purposes. Other methods can be used in other embodiments of the method 903, and other variations, improvements, characteristics and the like of the method 903 are possible in still other embodiments.

Although the embodiments disclosed herein demonstrate some embodiments of the present invention being used in exemplary configurations while being worn, other embodiments of the invention can be used for a number of other purposes without being or having to be worn at all.

Although diverse features and various embodiments of the invention have been shown and described, these do not constitute a definition of all possible embodiments and those skilled in the art will understand that the present invention is applicable to many other embodiments. All such modifications and variations are intended to be included herein within the scope of the present invention and protected by the following claims.

The benefits, advantages, solutions to problems, and any element(s) that may cause any benefit, advantage, or solution to occur or become more pronounced are not to be construed as a or any critical, required, or essential feature(s) or element(s) of any or all the claims. The invention is defined solely by the appended claims including any amendments made during the pendency of this application and all equivalents of those claims as issued.

All terms used in the claims are intended to be given their broadest reasonable constructions and their ordinary meanings as understood by those knowledgeable in the art described herein unless an explicit indication to the contrary is made herein. In particular, use of the singular articles such as "a", "the", "said", etc. should be read to recite one or more of the indicated elements unless a claim recites an explicit limitation to the contrary.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

Furthermore, while some embodiments described herein include some but not other features included in other embodiments, combinations of features of different embodiments are meant to be within the scope of the invention, and form different embodiments, as would be understood by those skilled in the art. By way of example, in the following claims, any of (but not being limited to) the claimed embodiments could be used in any combination.

Claim elements and steps herein have been numbered and/or lettered solely as an aid in readability and understanding. Any such numbering and lettering in itself is not intended to and should not be taken to indicate the ordering of elements and/or steps in the claims.

I claim:

1. A method for using a wearable item, comprising:
using the wearable item in as a versatile garment; and
styling the wearable item in a variety of configurations, and wherein the wearable item comprises a lower body portion and a pair of panel segments, and styling the wearable item in the variety of configurations at least comprises:
using the pair of panel segments having each panel segment of the pair of panel segments comprise a first panel and a second panel;
using the first panel having a first end and a fourth end being opposite the first end;
using the first panel having a second end and a third end being each adjacent both the first end and the fourth end;
using the first end of the first panel being only attached to a portion of the lower body portion; and
using the second panel being only attached to the first panel at either the second end or the third end at an intersecting area.

2. The method for using the wearable item as claimed in claim 1, further comprising styling the first panel in at least one of a plurality of different ways.

3. The method for using the wearable item as claimed in claim 1, further comprising styling the second panel in at least one of a plurality of different ways.

4. The method for using the wearable item as claimed in claim 1, further comprising: styling the first panel and the second panel in at least one of a plurality of different ways; and positioning the lower body portion in at least one of a plurality of different locations depending upon a style of wear of the wearable item.

5. The method for using the wearable item as claimed in claim 1, further comprising wearing the wearable item in a configuration of the variety of configurations including a strapless style configuration.

6. The method for using the wearable item as claimed in claim 1, further comprising wearing the wearable item in a configuration of the variety of configurations including a sleeveless style configuration.

7. The method for using the wearable item as claimed in claim 1, further comprising wearing the wearable item in a configuration of the variety of configurations including a sleeve style configuration.

8. The method for using the wearable item as claimed in claim 1, further comprising wearing the wearable item in a configuration of the variety of configurations including a strap style configuration.

9. The method for using the wearable item as claimed in claim 1, further comprising wearing the wearable item in a configuration of the variety of configurations including a neckline style configuration.

10. The method for using the wearable item as claimed in claim 1, further comprising wearing the wearable item in a configuration of the variety of configurations including a garment train in at least one configuration.

11. The method for using the wearable item as claimed in claim 1, wherein styling the wearable item in the variety of configurations further comprises using the second panel in a horizontal direction.

12. A method for using a wearable item, comprising:
using the wearable item as a versatile garment; and
styling the wearable item in a variety of configurations, and wherein the wearable item comprises a lower body portion and an upper body portion, and styling the wearable item in the variety of configurations at least comprises:

using a pair of panel segments in the upper body portion;

using the pair of panel segments having each panel segment of the pair of panel segments comprising a first panel and a second panel;

using the first panel having a first end and a fourth end being opposite the first end;

using the first panel having a second end and a third end being each adjacent both the first end and the fourth end;

using the first end of the first panel being only attached to a portion of the lower body portion; and using the second panel being only attached to the first panel at either the second end or the third end at an intersecting area.

13. The method for using the wearable item as claimed in claim 12, further comprising styling the first panel in at least one of a plurality of different ways.

14. The method for using the wearable item as claimed in claim 12, further comprising styling the second panel in at least one of a plurality of different ways.

15. The method for using the wearable item as claimed in claim 12, further comprising: styling the first panel and the second panel in at least one of a plurality of different ways; and positioning the lower body portion in at least one of a plurality of different locations depending upon a style of wear of the wearable item.

16. The method for using the wearable item as claimed in claim 12, further comprising wearing the wearable item in a configuration of the variety of configurations including a strapless style configuration.

17. The method for using the wearable item as claimed in claim 12, further comprising wearing the wearable item in a configuration of the variety of configurations including a sleeveless style configuration.

18. The method for using the wearable item as claimed in claim 12, further comprising wearing the wearable item in a configuration of the variety of configurations including a sleeve style configuration.

19. The method for using the wearable item as claimed in claim 12, further comprising wearing the wearable item in a configuration of the variety of configurations including a strap style configuration.

20. The method for using the wearable item as claimed in claim 12, further comprising wearing the wearable item in a configuration of the variety of configurations including a neckline style configuration.

21. The method for using the wearable item as claimed in claim 12, further comprising wearing the wearable item in a configuration of the variety of configurations including a garment train in at least one configuration.

22. The method for using the wearable item as claimed in claim 12, wherein styling the wearable item in the variety of configurations further comprises using the second panel in a horizontal direction.

23. A method for using a wearable item, comprising:

using the wearable item as a versatile garment; and wearing the wearable item having a lower body portion and a pair of panel segments in at least one configuration of a variety of configurations, wherein the wearable item comprises:

a first panel and a second panel in each panel segment of the pair of panel segments;

the first panel having a first end and a fourth end opposite the first end;

the first panel having a second end and a third end each adjacent both the first end and the fourth end;

the first end of the first panel only attached to a portion of the lower body portion; and the second panel only attached to the first panel at either the second end or the third end at an intersecting area.

24. A method for using a wearable item, comprising:

using a wearable item in many ways, for a variety of configurations and as a versatile garment; and wearing a wearable item having a lower body portion and an upper body portion in at least one configuration of a variety of configurations, wherein the wearable item comprises:

a pair of panel segments in the upper body portion;

a first panel and a second panel in each panel segment of the pair of panel segments;

the first panel having a first end and a fourth end opposite the first end;

the first panel having a second end and a third end each adjacent both the first end and the fourth end;

the first end of the first panel only attached to a portion of the lower body portion; and the second panel being only attached to the first panel at either the second end or the third end at an intersecting area.

* * * * *